US005425567A

United States Patent [19]

Albecker, III

[11] Patent Number: 5,425,567

[45] Date of Patent: Jun. 20, 1995

[54] BACKRESTS/LEGLESS LEISURE CHAIRS AND METHODS FOR MAKING CUSHIONS

[76] Inventor: Walter J. Albecker, III, 838 S. May, Chicago, Ill. 60607

[21] Appl. No.: 899,750

[22] Filed: Jun. 17, 1992

Related U.S. Application Data

[63] Continuation-in-part of Ser. No. 721,179, Jun. 26, 1991, abandoned.

[51] Int. Cl.[6] ..... A47C 1/14; A47C 20/04

[52] U.S. Cl. ..... 297/377; 5/634; 297/452.29

[58] Field of Search ..... 297/377, 452.29, 452.30, 297/452.31, 230.1, 230.14; 5/633, 634

[56] References Cited

U.S. PATENT DOCUMENTS

| | | | |
|---|---|---|---|
| D. 167,666 | 9/1952 | Argento | 5/633 X |
| 200,504 | 2/1878 | Buell | 5/633 |
| D. 210,579 | 3/1968 | Hehn | D15/8 |
| 256,176 | 4/1882 | Turk . | |
| 305,428 | 9/1884 | Covert . | |
| 517,623 | 4/1894 | Phimmer | 5/634 |
| 815,819 | 3/1906 | Harllee . | |
| 1,063,423 | 6/1913 | Edelin . | |
| 1,156,125 | 10/1915 | Ahlborn . | |
| 1,219,437 | 3/1917 | Buttler | 297/377 |
| 1,222,175 | 4/1917 | Bobrick . | |
| 1,281,074 | 10/1918 | Russell | 5/634 |
| 1,865,030 | 6/1932 | McCauley . | |
| 2,047,035 | 7/1936 | Rosenberg | 190/42 |
| 2,140,310 | 12/1938 | Brown et al. . | |
| 2,281,629 | 5/1942 | Snow | 5/327 |
| 2,308,410 | 1/1943 | Winter | 297/377 |
| 2,429,795 | 10/1947 | Blanchard et al. . | |
| 2,593,319 | 4/1952 | Levitin et al. | 5/337 |
| 2,593,623 | 4/1952 | Stempel . | |

(List continued on next page.)

FOREIGN PATENT DOCUMENTS

| | | | |
|---|---|---|---|
| 118774 | 8/1930 | Austria | 5/634 |
| 114293 | 6/1969 | Denmark | 297/377 |
| 641771 | 7/1962 | Italy | 5/634 |

OTHER PUBLICATIONS

Vuokko or Anti Nurmesnieni from Design From Skandanavia No. 8, 1977, p. 32.

Toshiyuki Kita, Wink chair, 1980, 20th Century furniture design, p. 218.

Designer not known, "Low Down Chair", U.-Bild p. 89 1991.

*Primary Examiner*—Peter R. Brown

[57] ABSTRACT

A number of generally wedge shaped backrests and legless leisure chairs for sitting on the floor or on a bed, which orient the user's upper back at a higher angle than the user's lower back. These are ideally suited for people who want to be in a reclining type position, but yet want to do something like watch television. Most of the backrests/leisure chairs described also have a way of maintaining the lumbar region of the user's back in a relatively natural lordotic curve, some through a lumbar support member (28), and others through making a convex contour on the lower portion of the backrest-/leisure chair. All of the leisure chairs for sitting on the floor have a seat cushion (34) to prevent the user from slipping down out of place and most have a pillow (32) for a headrest. A number of ways of making a variety of types and styles of backrests/leisure chairs are disclosed including adjustable metal frames and wood frames, dual position chairs, chairs using a firm support foundation (42 and 46), chairs having armrests (36), and outdoor type styles. Also disclosed are methods for providing lumbar supports in cushions suitable for these chairs and others. One method involves putting a hollow in the back of the main cushion (26) and filling it with a high firmness support member (28). Another method comprises piercing a previously manufactured cushion (86) with injecting needles (84) to inject a firming solution into the cushion (86) to provide the internal lumbar support (88).

28 Claims, 28 Drawing Sheets

U.S. PATENT DOCUMENTS

| | | | |
|---|---|---|---|
| 2,623,574 | 12/1952 | Danisch . | |
| 2,857,957 | 10/1958 | Gay . | |
| 2,966,205 | 12/1960 | Blaschko . | |
| 3,003,815 | 10/1961 | Zinn | 297/118 |
| 3,092,224 | 6/1963 | O'Neil | 190/8 |
| 3,110,519 | 11/1963 | Chernivsky | 297/285 |
| 3,120,008 | 2/1964 | Watson | 5/327 |
| 3,189,382 | 6/1965 | Fortier | 297/351 |
| 3,195,953 | 7/1965 | Zacks | 297/397 |
| 3,273,174 | 9/1966 | Cassini | 5/327 |
| 3,293,669 | 12/1966 | Emery | 5/327 |
| 3,329,979 | 7/1967 | Drapin | 5/327 |
| 3,333,286 | 8/1967 | Biolik | 5/327 |
| 3,346,298 | 10/1967 | Champion | 297/455 |
| 3,361,471 | 1/1968 | Radford | 297/230 |
| 3,378,861 | 4/1968 | Lousberg | 5/345 |
| 3,469,882 | 9/1969 | Larsen | 297/118 |
| 3,555,582 | 1/1971 | Radford | 5/338 |
| 3,742,526 | 7/1973 | Lillard | 5/12 |
| 3,751,111 | 8/1973 | Taylor et al. | 297/DIG. 1 X |
| 3,784,993 | 1/1974 | Berkowitz | 5/308 |
| 3,822,424 | 7/1974 | Messer | 5/344 |
| 3,981,031 | 9/1976 | Schacht | 5/327 B |
| 3,995,335 | 12/1976 | Neely | 5/327 |
| 4,027,888 | 6/1977 | Wilcox | 297/284 |
| 4,064,580 | 12/1977 | Easloys | 5/327 |
| 4,116,148 | 9/1978 | Torrez | 112/262 |
| 4,171,549 | 10/1979 | Morrell et al. | 5/465 |
| 4,194,254 | 3/1980 | Torrez | 5/420 |
| 4,208,070 | 6/1980 | Geschwender | 297/118 |
| 4,410,214 | 10/1983 | Geschwender | 297/118 |
| 4,564,240 | 1/1986 | Thieme | 297/457 |
| 4,635,306 | 6/1987 | Willey | 5/431 |
| 4,810,034 | 3/1989 | Beier | 297/284 |
| 4,853,993 | 8/1989 | Walpin et al. | 5/431 |
| 4,908,891 | 3/1990 | Blagg | 5/419 |
| 4,909,573 | 3/1990 | Barry | 297/456 |
| 4,916,765 | 4/1990 | Castronovo, Jr. | 5/442 X |
| 4,970,742 | 11/1990 | Keener | 5/431 |

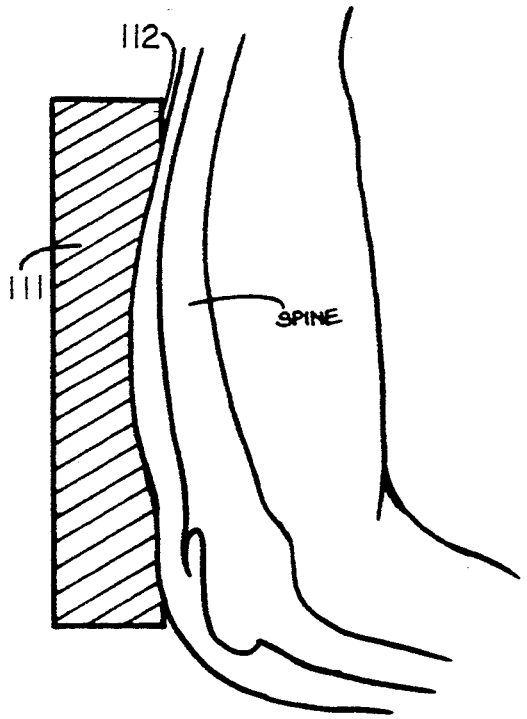
Figure 12
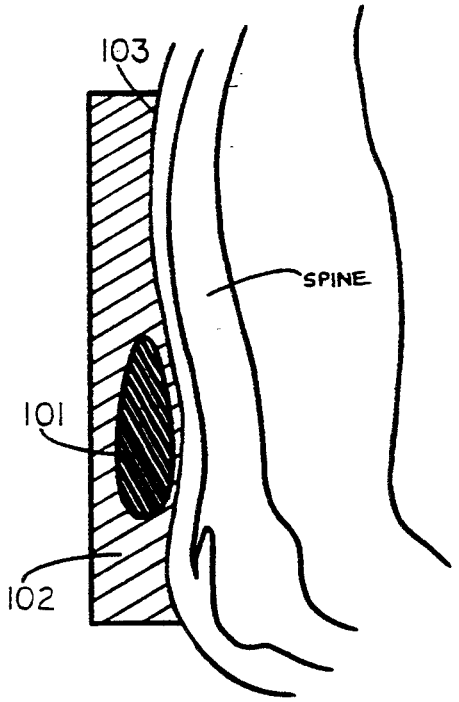
Figure 13
Figure 14
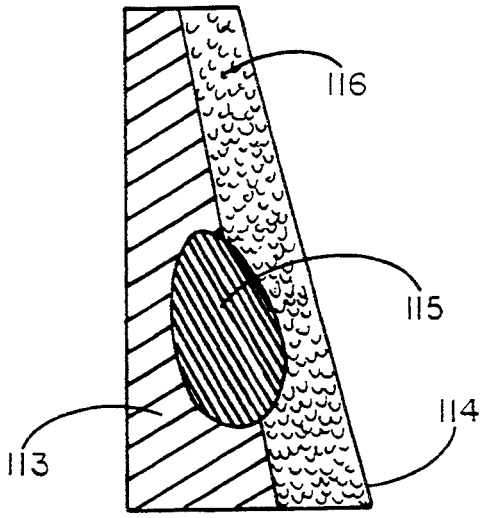

BACKRESTS/LEGLESS LEISURE CHAIRS AND METHODS FOR MAKING CUSHIONS

BACKGROUND—CROSS REFERENCE TO RELATED APPLICATION

This invention is a continuation-in-part, and incorporates an invention that I filed a patent application for on Jun. 26, 1991, The Ser. No. of that application is 07/721,179, now abandoned, and is entitled: CUSHIONS HAVING AN INTERNAL SUPPORT MEMBER AND METHOD, which application is incorporated by reference herein, in it's entirety.

Note: To avoid confusion with the present invention relating to backrests/leisure chairs all figure numbers and reference numbers on the prior application have been changed as follows: All figure numbers had seven (7) added to them, and all reference numbers have had one hundred (100) added to them. For example, what was FIG. 1 and No. 1 is now, FIG. 8 and No. 101, etc.

Also, to make it easier to distinguish between the present invention related to backrests/leisure chairs and a new cushion method, and the material included in my previous application, the material in accordance with the present invention is presented first under each standard heading (i.e. Brief Description of Drawings). After the material related to the present invention, the heading CUSHIONS DESCRIBED PREVIOUSLY will be at the beginning of each time the previous material is included.

BACKGROUND—FIELD OF INVENTION

This invention relates to furniture, and specifically to legless leisure chairs or backrests that are appropriate for use on a floor or on a bed. It also relates to methods for making ergonomically supportive cushions for chairs and the like, including those described in this application.

BACKGROUND—DISCUSSION OF PRIOR ART

BACKRESTS/LEISURE CHAIRS

For years, people have appreciated chairs and backrests which enable them to be in a position which is somewhere between sitting up straight and lying down. There are now many types of reclining chairs and lounges on the market. Most of these are large and expensive, and also cannot be used for sitting on the floor or on a bed. Many people, including the present inventor enjoy reclining on a bed, or close to the floor. To satisfy this need, a number of inventions have been developed.

U.S. Pat. No. 2,593,319 to Levitin et al discloses a foldable furniture unit for reclining on the floor. Levitin's invention is interesting, but the portion of the back support for the lower back is concave which would tend to be uncomfortable for most people. Also, it requires a fair amount of floor space when used as a recliner, making it necessary for many people to fold it up after each use.

The combined ottoman and collapsible backrest in U.S. Pat. No. 2,966,205 to Blaschko lacks a specific lumbar support, is not suitable for use on a bed, similar to the Ezekoye support in reclining position mentioned below, it does not orient the user's upper back and head to comfortably view a television placed at a normal height, does not seem to provide an effective means to keep the user from slipping down, takes up a lot of floor space when in the backrest position, which may necessitate folding and unfolding for each use, and has the limitations of a backrest that is combined with an ottoman.

The therapeutic device disclosed in U.S. Pat. No. 3,555,582 to Radford provides a wedge with a contour to provide additional support to portions of a user's body. The therapeutic device is designed to be used in a sofa or bed, and appears to be for orienting the head, neck and upper back in a position suitable for watching television or reading. This invention does not appear to do anything for the lower back.

U.S. Pat. No. 3,995,335 to Neely discloses a backrest made of a number of pillows attached to a frame, designed to enable invalids to sit up in bed. Neely's invention is bulky and clumsy, and though it may be very functional as a pillow for invalids, it is probably not best suited as a leisure chair for general use.

U.S. Pat. No. 4,064,580 to Ezekoye shows a multi-position back support; however it does not provide a means of preventing a user from slipping down, does not provide any lumbar support, doesn't have a cushion for the user's buttocks, and in the reclining position, the user basically is looking up at the ceiling.

The cushion ensemble and method of arranging cushions disclosed in U.S. Pat. No. 4,171,549 to Morrell and Gray provide a chair or lounge. The cushion ensemble appears simple and economical to manufacture, but it does not provide a clearly articulated lumbar support, is somewhat bulky and clumsy, probably requires rearrangement after each use, would be very casual if considered furniture, and probably is not very effective at preventing the user from slipping down since the seat cushion is not attached.

U.S. Pat. No. 4,410,214 to Geschwonder discloses a leisure chair which can be used in a generally upright position or in a reclining position. Although it is simple and compact, it does not provide a lumbar support, and because the back support is straight, the user has two choices, sit up straight, or recline generally facing the ceiling. There is also no headrest when the chair is in the upright position, and there is also no seat cushion when the leisure chair is used in the reclining position.

The multi-sectional backrest and pillow having the capability of assuming a series of different configurations in U.S. Pat. No. 4,970,742 to Keener does not provide a way to enable the lower back to be at a very low angle which can be very comfortable, while at the same time positioning the upper back and head in such a way that the head can watch a television comfortably when the television is at a standard height. Additionally, the backrest does not seem to provide a clearly articulated lumbar support.

Other inventions which may relate to this field include the floor rocker or video rocker sold in a number of department stores, the adjustable body positioner disclosed by Walpin in U.S. Pat. No. 4,853,993, reclining chairs like La-Z-Boy, the "Wink" chair by Kita, a lounger made by Vuokko designed by Antti Nurmesniemi from Finland, a variety of other chairs which sit close to the ground, and a variety of cushioned backrests for use in bed commonly seen in department stores.

All of the backrests/legless leisure chairs heretofore known to the present inventor suffer from one or more of the following disadvantages:

(a) They do not provide a way for the user's lower back to be very comfortable and relaxed at a low angle, while the user's shoulders and head are at an angle that can be comfortable and well suited for reading and watching television.

(b) A specific lumbar support is not provided for greater comfort and to maintain the natural lumbar lordotic curve.

(c) The design is not suited for use as a regular piece of furniture in a home, such as in a relatively formal living room.

(d) The design is relatively expensive to produce.

(e) The design is not compact and/or relatively portable.

(f) The design does not provide for use in a reclined as well as a more upright position.

(g) The design is not appropriate for adaptation for use on floors as well as beds.

(h) The design is not suited for adding armrests.

(i) The design does not provide an effective means for preventing a person from slipping down, out of the preferred position.

(j) The design does not provide for a good portion of the user's weight to be distributed over a fairly large portion of the chair, instead of being concentrated at the seat.

(k) The design does not provide for a seat cushion that substantially cushions the users buttocks, helps prevent the user from slipping down, and can also be used to enable the user to easily change position from leaning against the backrest to sitting upright without leaning against it.

CUSHIONS DESCRIBED PREVIOUSLY

The field of invention of the cushions used in the backrests/leisure chairs of the present invention which were in large portion described in my previous application is as follows:

The pursuit of making chairs more comfortable has taken two basic forms. One approach is to contour the body contacting surfaces of the chair to provide good support to critical parts of the user's body such as the lumbar region of the back. Though contouring is generally an effective solution, it can have the drawback of being relatively expensive to manufacture, and it may not be aesthetically appropriate for some styles of furniture, or people's tastes. Also, it is difficult to make a contoured cushion reversible.

The second approach deals with the inherent support of the cushion materials and internal support inserts. Many years ago, springs were used to provide support in cushions. More recently with the development of foam rubbers, a number of other approaches have been tried.

U.S. Pat. No. 2,659,418 discloses an invention to insert spiral plugs in cushions. Spiral plugs, however, are not shaped to provide optimal body support, and they are complicated to manufacture.

The use of specially designed cavities embedded in a cushion to enable the cushion to conform to the shape of the user's body is described in U.S. Pat. No. 3,193,328. Though an excellent solution, it does not provide clearly articulated lower lumbar support, and requires a relatively expensive method of manufacture involving molding two sections, and joining them.

There are also a number of inventions incorporating inflatable or solid moveable internal supports in cushions as in U.S. Pat. Nos. 4,592,588, 3,948,558, 4,807,931, 4,725,095, 4,856,844, and 4,834,455. The complexity of these makes them costly to manufacture. Though some of these are adjustable, study has shown that the distances from the seat to the lumbar do not change very substantially from one person to the next. Though there may be some advantages to adjustable lumbar supports, the benefits do not justify the cost for most situations.

Other inventions such as U.S. Pat. No. 4,534,593 call for the manufacture of a special lumbar support behind a cushion for existing seats in vehicles. This results in a cushion that is somewhat contoured from behind.

The solutions closest to the present invention would probably include those that use a firmer resilient foam next to or inside a cushion. Examples include U.S. Pat. Nos. 4,522,447, 4,161,045, 3,987,507, and 4,190,697. Though these are well conceived ideas, none offer the economy of being made from a simple slab of flexible foam.

U.S. Pat. No. 4,522,447 discloses an invention to provide good seat support through the use of different pieces of varying density cellular elastic material. It is an excellent idea, but from looking at the shapes of flexible foam used in it's construction, it appears that there would be a lot of wasted material. It also seems to require a firm flat support under the cushions to get the best effect. In addition to the cost of this support, it would limit the applications for which the cushion could be used, and would not be reversible. Though the invention discloses a backrest with a lumbar support, the lumbar support is contoured with the drawbacks mentioned for other contoured cushions above. This invention also does not suggest a way to be used with cushions using a loose fill cushioning material, in addition to just slab foam.

U.S. Pat. No. 3,751,111 discloses a variable density contour chair. Though the chair may provide some support, it involves a process where each chair is foamed in situ. This type of cushion is not made from economical slab foam. Another drawback that is pointed out in U.S. Pat. No. 4,522,447 is that when a variable density cushion is made by pouring polyurethane foam around a preformed foam block, a chemical reaction takes place which causes a hard skin to form around the preformed block.

U.S. Pat. No. 4,161,045 discloses a mattress with a number of ribs that are less compressible than the rest of the mattress. These ribs are positioned to support only the shoulders and buttocks of the one lying on the mattress. In addition to being complicated and costly to produce, it proposes giving less support to the lumbar region of the back, and more to the shoulders and buttocks. It also is not designed for chair cushions.

U.S. Pat. No. 4,190,697 describes a multidensity foam article, specifically a seat cushion with a high density base. The cushion has the following drawbacks, first it has to be made one at a time as opposed to from slab foam stock. There is not a lot of flexibility in the shape that the higher density foam can be made in, which minimizes the chance for using the method for a cushion with an effective lumbar support. It also does not have the possibility for use with a loose fill cushion.

U.S. Pat. No. 3,987,507 discloses a pressure distribution pad for wheelchairs. This pad requires three layers of cushion material with the center cushion having holes filled in with a different density foam. This solution is designed for wheelchair seats, and is not suited for lumbar support, because the holes and method cannot be used for a contoured internal support member. This invention is also not suitable for use with a loose fill cushion.

Because there is no really good solution for making most sofas and chairs supportive, most sofas and chairs sold do not have any more than plain cushions—with little lumbar or buttocks and thigh support.

OBJECTS AND ADVANTAGES OF INVENTION

Accordingly, several objects and advantages of the present invention are:

(a) To provide leisure chairs/backrests that enable the user's lower back to be at a low angle which can be very relaxing and comfortable, while at the same time positioning the upper back and head in a way that is suitable for reading or for watching television when the television is at a standard height.

(b) To provide leisure chairs/backrests that give good support for the user's lower back, especially the lumbar region. Good lumbar support is especially important in reclining type leisure chairs/-backrests, because gravity tends to flatten the natural lordotic curve of the lumbar region in the users back.

(c) To provide leisure chairs/backrests that are attractive, appropriate for use as a regular piece of furniture in a home, and can be made to suit a variety of tastes. For example, the exposed part of the frame on certain models could be made of tubular steel for a more modern look, or wood for a more traditional look, while the unseen main structure is the same regardless of look chosen. And the design can be adapted for use in a living room, recreation room, or on the beach.

(d) To provide leisure chairs/backrests that can be relatively simple and inexpensive to manufacture.

(e) To provide leisure chairs/backrests that provide efficient use of space. Many chairs, such as the Chaise Lounges which provide some of the same benefits as this chair take up a lot of floor space in a home.

(f) To provide leisure chairs/backrests that can be made adjustable and/or collapsible so that they can be more portable and compact. Methods for making some models of the leisure chairs/backrests adjustable also makes it possible to make them somewhat collapsible for shipping and storage. So in a home, they could be put in closet, or out of the way fairly easily. Other models could be made fairly portable for use on the beach or outdoors.

(g) To provide leisure chairs/backrests that could be made adjustable or dual position to suit a number of people for a number of purposes. This could enable users to be in either a reclining position, or a more upright position. Such a feature would provide for greater individual comfort and usefulness.

(h) To provide backrests that can be used on a bed or a sofa.

(i) To provide legless leisure chairs that can be used on the floor. Many people enjoy sitting close to the floor. There are a number of other countries where sitting close to the floor is the main way people sit in homes. In America, many people enjoy sitting close to the floor for reading, to be in front of a fireplace, or while watching television. Since most televisions are only a couple feet above the floor level, this provides leisure chairs near the floor with a line of sight advantage over traditional height chairs, enabling people to look at television at about eye level instead of looking down on the television. This enables the user to recline further while still being able to see the television.

(j) To provide leisure chairs/backrests that can have armrests attached if desired.

(k) To provide leisure chairs/backrests that are substantial, secure, and well made.

(l) To provide leisure chairs/backrests that will tend to keep the user in the right position, by preventing the user from slipping down to a less than desirable position.

(m) To provide leisure chairs/backrests that distribute the user's weight to the backrest as well as to the seat area, for greater comfort.

(n) To provide leisure chairs/backrests that can be used with an adapted work surface to be useful for doing work on a computer or desk top surface while in a reclined position.

(o) To provide leisure chairs/backrests that are ideal for people who are tired at the end of the day.

(p) To provide backrests for beds and sofas that enable the user to get comfortable in a way that is simple and convenient, instead of having to move a number of pillows and/or cushions around in an awkward way that often gives unsatisfactory results.

(q) To provide leisure chairs with a seat cushion that cushions the user's buttocks, helps prevent the user from slipping down, and is appropriate for sitting up in a regular floor sitting position. The latter will enable a user to change from the position of leaning against the backrest to an upright sitting position without leaning against the backrest. Since it is usually uncomfortable to sit in one position for a long time, this makes it possible and convenient to change positions when desired.

CUSHIONS DESCRIBED PREVIOUSLY

The objects and advantages of the cushions used in the backrests/leisure chairs of the present invention which were in large portion described in my previous application are:

(a) To provide cushions, in many common shapes and sizes, with an internal support member, that will work in conjunction with the primary cushion material to support the user's body.

(b) To provide cushions that give good support to key areas of the user's body, but without the support having to alter the cushion aesthetically. This means that although the invention is for both contoured and noncontoured cushions, it is not necessary to contour or alter the design or shape of the cushion to achieve the desired effect.

(c) To provide an economical cushion with an internal support member that naturally balances the work of sitting to minimize stress, strain and fatigue to key parts of the user's body.

(d) To provide a way to make a wide variety of cushions ergonomically supportive.

(e) To provide cushions for chairs and the like with good support, that can be made reversible if desired.

(f) To provide an internal support member for cushions that are either removable, or fixed in place on chairs and the like.

(g) To provide good user body support to cushions with varying degrees of firmness. A soft cushion could be made supportive, and also a firm cushion could be made supportive.

(h) To provide both loose fill and solid flexible foam rubber cushions with good user body support.

(i) To provide cushions that can be very soft and comfortable, and yet provide very good support to the user's body.

(j) To provide a clearly defined lumbar support in backrest cushions.

(k) To provide balanced support to the thighs and buttocks in seat cushions.

(l) To provide a method for putting an insert in a cushion without forming a hard skin on the surface of the insert.

(m) To provide a simple and economical way to make cushions with internal support members that can be used both for solid flexible foam rubber cushions, and can also be used for cushions that have loose or fiber fill material as the front or body contacting layer of the cushion.

(n) To provide a way to produce cushions with an internal support member which can be made from economical slab polyurethane type foam and also can be done with minimal wasted material.

Still further objects and advantages will become apparent from a consideration of the ensuing description and drawings.

BRIEF DESCRIPTION OF THE DRAWINGS

In the drawings, closely related figures have the same number, but different alphabetic suffixes.

FIG. 12 is an illustration showing how a typical backrest cushion not embodying the present invention fails to provide good support, and as a result, the user's back is in an unnatural alignment.

FIG. 13 is an illustration showing how a typical backrest embodying the present invention does provide good support, and as a result, the user's back is in a comfortable and more natural position.

FIG. 14 is a side or cross section view of a backrest cushion embodying the present invention with loose or fiber fill material as the front or body contacting portion of the cushion.

DESCRIPTION OF INVENTION

Figure 1A:
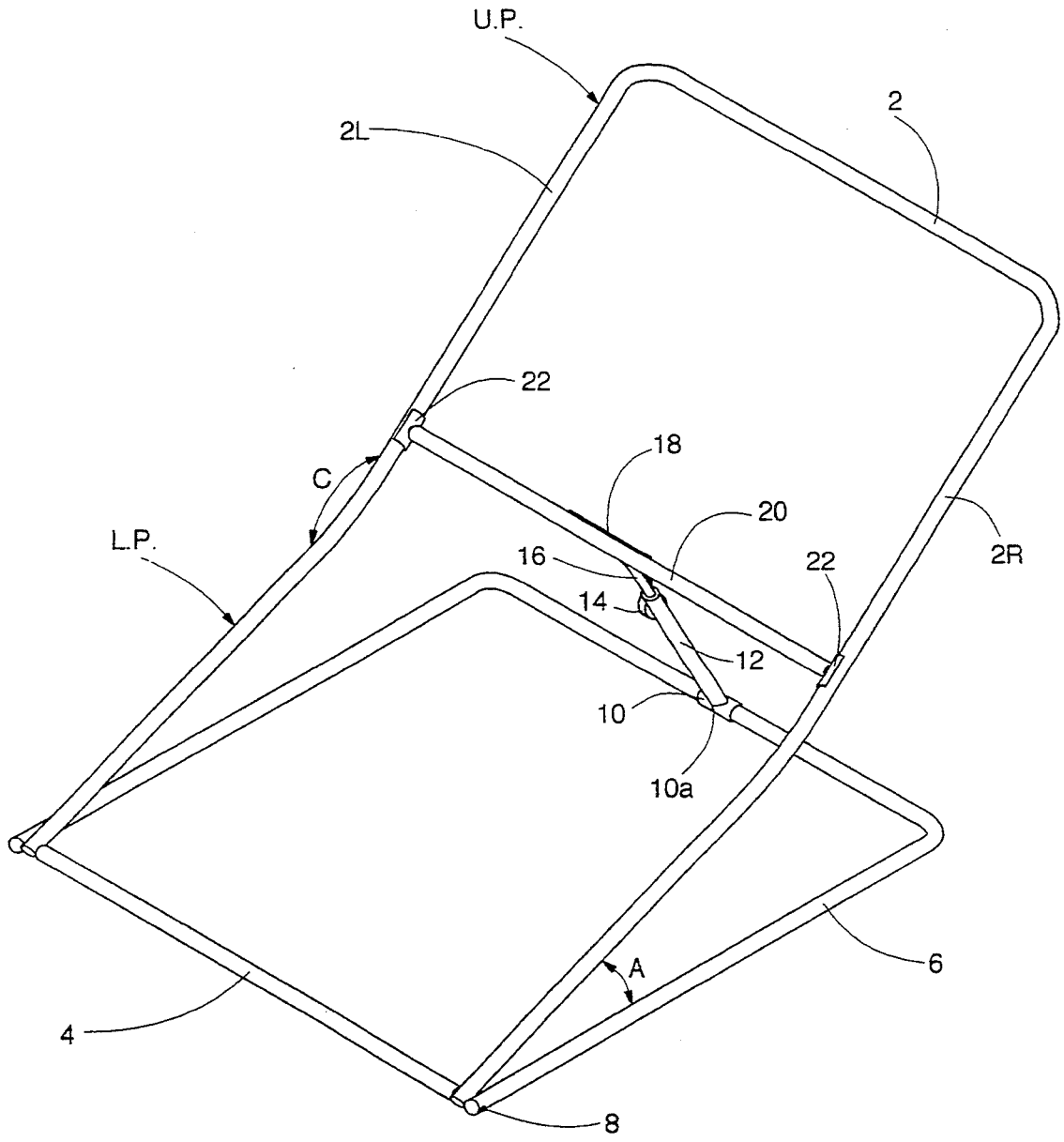
FIG. 1A is an isometric view of the support frame of a typical embodiment of the present invention with an adjustment mechanism.

FIG. 1A is an isometric view of a generally wedge shaped support frame of a typical embodiment of the present invention with an adjustment mechanism. The support structure has a main U shaped frame 2 with identical obtuse angles C positioned identically at a midpoint on the left 2L and right 2R sides of the main U shaped frame 2. The obtuse angle C divides the main U shaped frame 2 into an upper portion U.P. and a lower portion L.P. In a preferred embodiment, the obtuse angle C is about 165 degrees, though it could be between about 160 degrees and about 170 degrees. The bottom ends of the main U frame 2 meet the spacer bar 4 between them, and the base U shaped frame 6 is pivotally secured on the outer portion of the main U shaped frame 2 at this point. The main U frame 2 and the spacer bar 4 form the occupant supporting member and when combined become a generally rectangular shaped main backrest frame.

In a preferred embodiment, the spacer bar 4 is a tube with a secured insert at each end which is suitable for having a screw screwed into it. A screw 8 is screwed from the base U shaped frame 6, through the main U shaped frame 2, into the insert in the spacer bar 4. This is done on both the left and right sides of the spacer bar 4. It may be desirable to put some kind of washer between the main U shaped frame 2 and the base U shaped frame 6 to space them slightly, and to make it a smoother pivoting joint at the point where the screw 8 joins them together.

In the center of the base U shaped frame 6, there is a pivoting fitting 10, which is attached to the lower telescoping tube 12. On the pivoting fitting 10 there is a pivoting track **10*a* that corresponds to a screw head or other protrusion strategically placed on the base U shaped frame 6, for the purpose of keeping the pivoting fitting 10 from sliding horizontally on the base U shaped frame 6. The lower telescoping piece 12 has an upper telescoping piece 16 inserted inside. To secure the position of the upper telescoping piece 16, there is a securing knob with a threaded stud 14 which is screwed into a threaded base which has been mounted on the lower telescoping piece 12, so that when it is tightened, it locks the upper telescoping piece in place. It may be desired to have the upper telescoping piece have holes in it, so that when the securing knob 14 is tightened with the stud going into a hole, the upper telescoping piece becomes securely locked in place with no chance for moving. Of course there are other ways of achieving a similar result known to those knowledgeable in the art related to this invention. The telescoping pieces are made in such a way that they fit closely into one another, so that when they are secured in place with the securing knob 14, the effect is as if they were one firm support pole. The upper telescoping piece 16 is attached to the pivoting crossbar 20 with a welded joint. To add strength to the welded joint, and to provide stability to the overall frame, a triangular stabilizing gusset 18 is welded to both the upper telescoping piece 16, and the pivoting cross bar 20**.

The pivoting cross bar 20 is secured to cross bar pivoting fittings 22. The cross bar pivoting fittings 22 can consist of a stud which fits inside the pivoting cross bar 20 to form a pivoting joint.

The parts mentioned above when assembled as described form a generally wedge shaped frame as shown in FIG. 1A. The main U shaped frame 2 and the base U frame 6 meet to form angle A as shown, with the main U shaped frame 2 as the slope of the wedge. Since the frame is adjustable, in a preferred embodiment, the angle A is between about 20 degrees and about 70 degrees, which means that the slope of the lower portion of the generally wedge shaped frame is between about 20 degrees and about 70 degrees. The main U shaped frame 2 not only becomes the slope of the generally wedge shaped frame, but also will be referred to as the face of the generally wedge shaped frame. The obtuse angle C orients the upper portion U.P. of the face of the frame at a higher angle than the lower portion L.P.

Variations

It should be pointed out that the generally wedge shaped frame of this invention also can be made with a number of variations. Some variations are shown in FIGS. 1J, 1K, 4, 5, and 6. There are also variations which can be made to the frame shown in FIG. 1A. The telescoping pieces 12 and 16 are shown round and use a gusset 18 to provide stability. The telescoping pieces can also be made generally rectangular instead of round. For example, the tubing shown has an outside diameter of about 1", so the lower telescoping piece could be made of a rectangular tube with outside dimensions of 1" by about 10". The 10" portion of this rectangular tube would run in a side to side direction, while the 1" portion would run in a front to back direction. The upper telescoping portion would also be rectangular, but be slightly smaller than the lower portion so it could fit in the lower portion. The upper telescoping piece would be attached to a much greater portion of the pivoting cross bar 20, which would give it much stability, and probably eliminate the need for the stabilizing gusset 18. Of course the pivoting fitting 10 would have to be made wider (if the pivoting fitting 10 was 3" wide with a 1⅛" outside diameter, for a rectangular lower telescoping piece, it might be 10" wide with the same outside diameter) to fit under a rectangular lower telescoping piece. Similar to making the telescoping pieces wider, the frame could also be made using more than one telescoping supports, and of course the lower portions of such telescoping supports could be secured to one another (though they do not have to be exactly next to each other) with some kind of brace for additional stability. With any changes in the height adjustment mechanisms, there may need to be changes to the related pieces such as the securing knob and threaded base 14. Such changes should be known to those knowledgeable in the art related to this invention. Also, there are other ways of making height adjustments other than a telescoping support as shown, these include hydraulic or pneumatic lifts, threaded adjustment mechanisms, geared adjustment mechanisms, scissor type lifts, etc.

It is also possible to make the generally wedge shaped frame without the pivoting cross bar 20, and the upper telescoping piece 16 could be secured directly to the main U shaped frame 2 at the top on the section between 2L and 2R. This might require a pivoting fitting similar to 10 but wider, and would also use the stabilizing gusset 18 secured to the pivoting fitting and the upper telescoping piece 16. There are certainly a number of other ways of making the frame of this invention, including having an "upper" telescoping piece like 16 come from the spacer bar 4, while having the ends of the base U frame pivotally secured to points on the upper portion U.P. of the main U frame instead of near the spacer bar 4. In this way the telescoping pieces would be horizontal, and the "base" U frame would be generally vertical.

Another way of making the frame would be to use something similar to a third U shaped frame instead of the telescoping piece. The ends of the third U shaped frame could be pivotally attached to the section of the base U frame 6 that the telescoping piece 12 is attached to, but at points closer to each of the bends near the sides of the base U frame 6. Each of the ends of the third U shaped frame would be attached with a pivoting fitting similar to 10, and the third U shaped frame would be placed generally vertically to correspond with stepped notches that could be attached to the back portion of the main U frame from the obtuse angle C to a higher point on the upper portion U.P. With this method, the higher the third U frame is placed in notches on the main U frame, the lower the angle A would be, and conversely the lower the third U frame is attached to the main U frame, the higher the angle A would be. This is similar to the embodiment shown in FIGS. 6A–6E. If a frame was made of a relatively thin-walled tubular steel or the like, at some of the high stress points (like near the pivoting points 22 and 10) there could be a piece of a tube or bar that had a diameter just smaller than the tubing, put inside of the tubing and spot welded to provide additional strength at these points. These and the embodiments shown in other drawings suggest only a few of the possibilities, and someone knowledgeable in the art related to this invention, could suggest other methods of making this frame. Additionally, a preferred material for making this frame is tubular steel, but of course other materials such as aluminum, fiberglass, plastic, wood, glue laminated wood, etc. could be used.

Figure 1B:
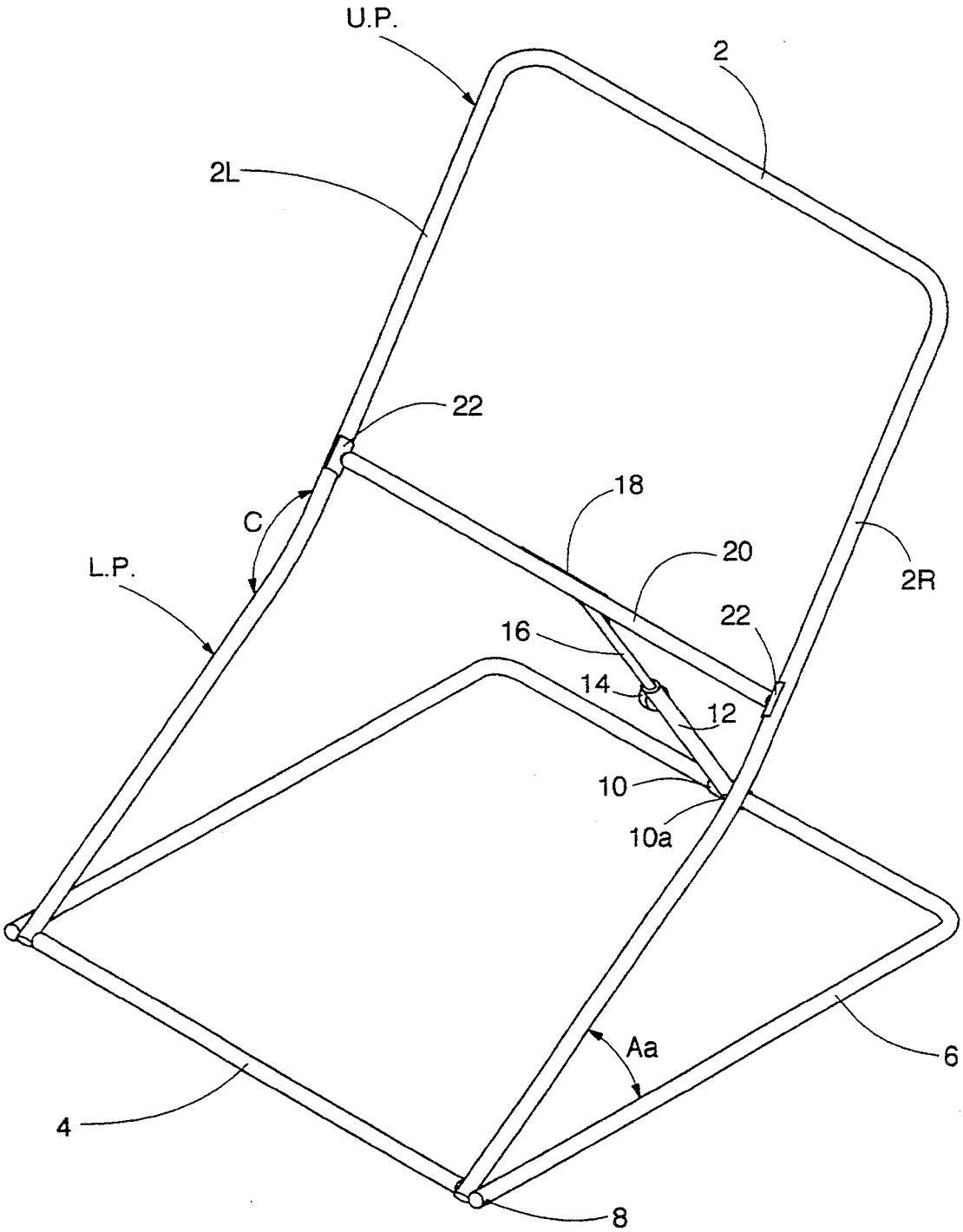
FIG. 1B is an isometric view of the support frame shown in FIG. 1A, but adjusted to an upright position.

FIG. 1B is an isometric view of exactly the same frame shown in FIG. 1A, but adjusted to a more upright position. To accomplish this, the securing knob 14 would have been loosened, the top of the main U frame 2 would have been raised to a desired height, while the base U frame 6 stayed in the same position. When the main U frame 2 is in the desired position, the securing knob 14 would again be tightened to lock the telescoping support pieces 12 and 16 into the proper position. In this position, more of the upper telescoping support piece 16 is visible, and the angle A is greater, and is now designated by Aa.

Figure 1C:
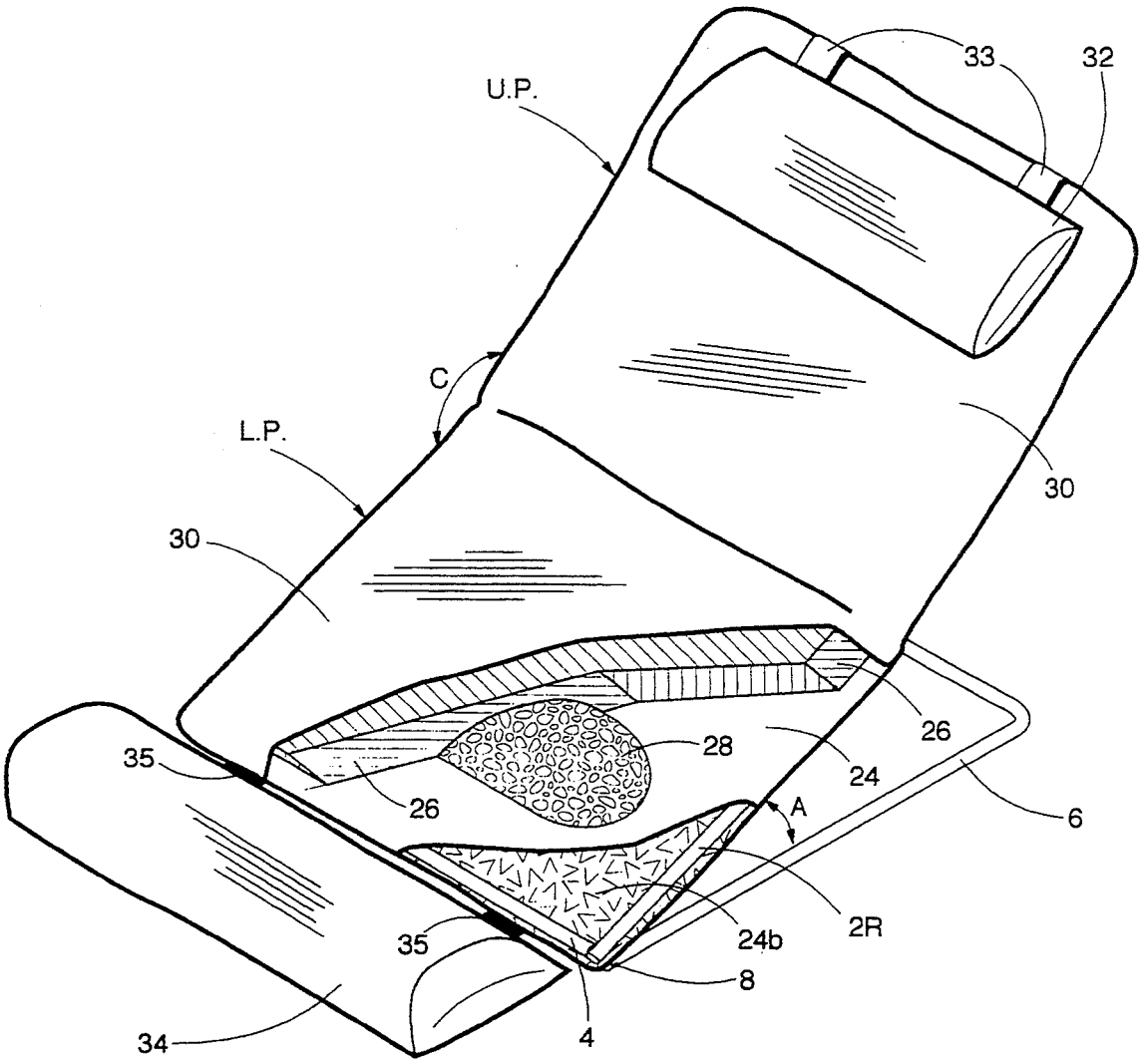
FIG. 1C is an isometric view of the embodiment shown in FIGS. 1A and 1B, but also showing the support sheet, lumbar support, cushions and upholstery with a cutaway.

FIG. 1C is an isometric view of the embodiment shown in FIGS. 1A and 1B, but with a support sheet 24, cushions 26, 32 and 34, upholstery 30, and a lumbar support 28 shown in a cutaway view to make it clear how they are assembled with the frame. In the drawing, the support sheet 24 is made of a fabric suitable for supporting the weight of a user, such as canvas. When the support sheet 24 is used with a generally wedge shaped frame like shown in FIGS. 1A and 1B, together the support sheet 24 and the frame make two similarly sized support surfaces. The support sheet is generally like an ordinary pillowcase in it's construction. Of course, the top corners can be rounded to follow the shape of the main U frame 2. To understand how the support sheet 24 relates to the frame, it is necessary to refer to both FIGS. 1A and 1C. On the backside of the support sheet, there must be a hole for the upper telescoping piece 16, and stabilizing gusset to come through. This hole will probably be about 1" high, and 8" wide (or about as wide as the stabilizing gusset 18). Though the upholstery 30 can be sewn onto the support sheet 24, and the cushion 26 inserted between the upholstery 30 and the support sheet 24, for purposes of better understanding the support sheet 24 and how it goes on the frame, this will be ignored until later. The support sheet 24 will look like a cover for the main U frame 2 with a hole in the back. It will then be pulled over the main U frame 2. Picture pulling a pillow case over the main U frame 2 shown in FIG. 1A. Starting at the top of the main U frame 2, the bottom of the support sheet 24 would be pulled until it is about 4" from the top. At this point, the securing knob 14 would be loosened, and the upper telescoping piece 16, would be raised and separated from the lower telescoping piece 12. With the upper telescoping piece 16 free to pivot, it will be pivoted toward the top of the main U frame 2, to make it parallel with the upper portion U.P. of the sides of the main U frame 2. This will enable the bottom edge of the support sheet 24 to be pulled all the way down to where the spacer bar 4 is. While the support sheet 24 is being pulled in place over the main U frame 2, the hole on the back side will pass what is normally the bottom of the upper telescoping piece 16 (though now it is near the top of the main U shaped frame). As the hole passes this point, the upper telescoping piece 16 needs to be guided through the hole. Once the upper telescoping piece 16 is guided through the hole, the support sheet 24 can be pulled the remainder of the way so that the bottom ends up near or at the spacer bar 4. The support sheet 24 can then be secured to the spacer bar 4 either by sewing the bottom end closed after it covers the spacer bar 4, or by using a flap as part of the support sheet 24 that goes around the spacer bar and is secured with velcro, snaps, or by sewing. There are certainly other ways of doing this which would be known to those knowledgeable in the art related to this invention, including using a single ply sheet of fabric with casing on the sides to go up over the sides 2L and 2R of the main U frame 2 using the same principle as is used to put a canvas backrest on a director's chair. Also, there are other types of support sheets that could be used. Among the other types of support sheets which are anticipated would be plywood, webbing, springs and wire, fiberglass, plastic and the like, and a steel sheet or screen. Of course these and other types of support sheets would use a very different method of construction, which would be known to those knowledgeable in the art related to this invention.

Attached to the support sheet in FIG. 1C, could be the head pillow straps 33, the seat cushion straps 35, and the upholstery 30. Though there are a variety of ways of securing the upholstery to the support sheet or to the main U shaped frame, the currently preferred method would be to sew the upholstery 30 to the outer perimeter of the support sheet 24 in such a way that there will be a substantial pocket formed for the main cushion 26 to be inserted therein. To accomplish this, the upholstery 30 would have to be large enough to completely cover the main cushion 26 (except for the area on the bottom of the cushion which would sit directly above the support sheet 24). This upholstery 30 would then be sewn around the top and sides of the support sheet 24 in a way to permit the finished upholstery to form a pocket for the main cushion 26. In this method, the support sheet 24 would be made together with the upholstery 30, then the main cushion 26 with the lumbar support 28 attached would be put in the pocket between the support sheet 24 and the upholstery 30. When this is accomplished, the support sheet (with the upholstery 30 and main cushion 26 with lumbar support 28 in the pocket) would then be pulled over the main U frame 2 as described above. The upholstery 30 may also have a flap similar to the flap described above for the support sheet 24 to close the bottom with methods similar to those described above. Another preferred method which is not shown in the drawing would be to just simply upholster the main cushion 26 with the lumbar support 28 in a conventional manner similar to that used for removable cushions on conventional chairs or on outdoor furniture. With this done, the cushion could be placed over the support sheet 24 which would have been previously put over the main U frame 2 in the method described above, and attached with straps or another appropriate method.

When reference is made to possibly attaching straps to the support sheet, it means that there could be holes in the support sheet near the top and the bottom so that straps could be secured around the bottom spacer bar 4 and the top section of the main U frame 2. Another way to secure straps would be to sew them directly to the support sheet. In this way, even though the straps are not directly secured to the support frame, since the support sheet 24 is secured to the support frame, the straps would be secured to the support frame through the support sheet. Also the straps may be adjustable and have buckles so that each "strap" may actually be made of two straps.

The head pillow 32 in a preferred embodiment is filled with a softer material than the main cushion 26. The filling could be a loose filling such as feathers, shredded polyurethane foam, dacron, etc., or could be a very soft polyurethane foam material, preferably with an ILD (Indentation Load Deflection on 4" at 25%) of about 12 pounds. The straps for the head pillow 33 would be attached either directly to the main U shaped frame 2, or to the support sheet 24. In a preferred embodiment, the straps 33 are adjustable so that the pillow can be adjusted to suit personal preferences. Though a preferred embodiment uses straps for the head pillow, these straps are not essential to the head pillow working properly, but it makes things a little more convenient. Also, though a soft material for the head pillow 32 is suggested, it is understood that personal preferences vary, and that some people prefer a firm pillow.

The seat cushion 34 is attached to the spacer bar 4 with straps for seat cushion 35. Unlike the head pillow straps 33 mentioned above, these straps 35 or a similar means of securing the seat cushion 34 to the frame are essential to the proper working of the backrest/leisure chair of this embodiment. The reason these straps are so important is that when a person is sitting on the backrest/leisure chair, there is a natural tendency to slide down caused by gravity. The seat cushion 34 is designed to prevent the user from sliding down, and needs to be secured so that the user won't slide down and move the seat cushion 34 while he or she slides down. It is not necessary that the seat cushion be secured directly to the support frame, if it is secured to the support sheet 24 or something else which is secured to the frame, it will be indirectly secured to the frame. Other means of securing the seat cushion to the frame may be substituted for straps, such as securing the upholstery of the seat cushion 34 directly to the support sheet 24. In a preferred embodiment, the seat cushion 34 is filled with a firmer material than the main cushion 26. The reason for this is that in addition to preventing the user from sliding down, a lot of the user's weight is concentrated on the seat cushion 34. The seat cushion 34 can be filled with loose fill such as feathers, shredded polyurethane foam, dacron, etc., or could be a relatively firm polyurethane foam material, preferably with an ILD (Indentation Load Deflection on 4" at 25%) of about 40 pounds. If a loose fill material is used, it can be packed much more tightly than for the head pillow 32 mentioned above. The seat cushion 34 can be made with a material about as firm as the main cushion 26, but if it is, it probably should be thicker. It is also possible to make the seat cushion 34 in layers, with the bottom layer(s) of firmer material and the top layer(s) of a softer material. No matter what is done, the seat cushion 34 should be more supportive than the main cushion 26 (an exception might be if the main cushion 26 is made of a relatively firm material or is relatively thick).

The purpose of the lumbar support 28 is to support the lumbar region of the user's back in a relatively natural lordotic curve. The lordotic curve is a normal curve in a human's lower back. Lumbar refers to the region of the spine where the lordotic curve is. In a preferred embodiment, the main cushion 26 is made of a flexible polyurethane foam with an ILD of about 20 pounds, and is about 4 inches thick. It should be pointed out that the ILD could be between about 10 pounds and 30 pounds. The back side of the main cushion 26 has a generally semi-elliptically shaped hollow in the shape of the lumbar insert 28. The center of the hollow is positioned to line up with the center of the lumbar region of a typical user's back. In a preferred embodiment, the center of the hollow is between about 7" and about 9" from the bottom edge of the main cushion 26. The bottom edge is near the bottom spacer bar 4, and the back side of the main cushion 26 is contacting the support sheet 24. In a preferred embodiment, the lumbar support 28 is about 2" thick at it's center, is about 9" wide, and is about 17" long. In a preferred embodiment, the lumbar support 28 is made of a flexible polyurethane foam with an ILD of about 50 or 60 pounds. It should be pointed out that the dimensions and characteristics of the lumbar support 28 and the main cushion 26 can vary to meet comfort requirements, aesthetic considerations, or economic constraints.

The lower portion L.P. is designed to support a user's back from the sacrum to a middle range of the occupant's thoracic vertebrae. The desired middle range is known as a kyphotic curve. In a preferred embodiment, the lower portion L.P. of the main cushion 26 as measured from the bottom of the main cushion 26 to the obtuse angle C is about 16". The upper portion U.P. is designed to support the user's back from the middle range of the occupant's thoracic vertebrae to the top of the user's skull. In a preferred embodiment, the upper portion of the main cushion 26 as measured from the obtuse angle C to the top of the main cushion is about 20". These measurements can vary somewhat, especially if the backrest leisure chair is designed for children or for people of heights different from fairly average U.S. heights. In the claims, the upper portion U.P. and lower portion L.P. will be referred to as two similarly sized support surfaces.

Figure 1D:
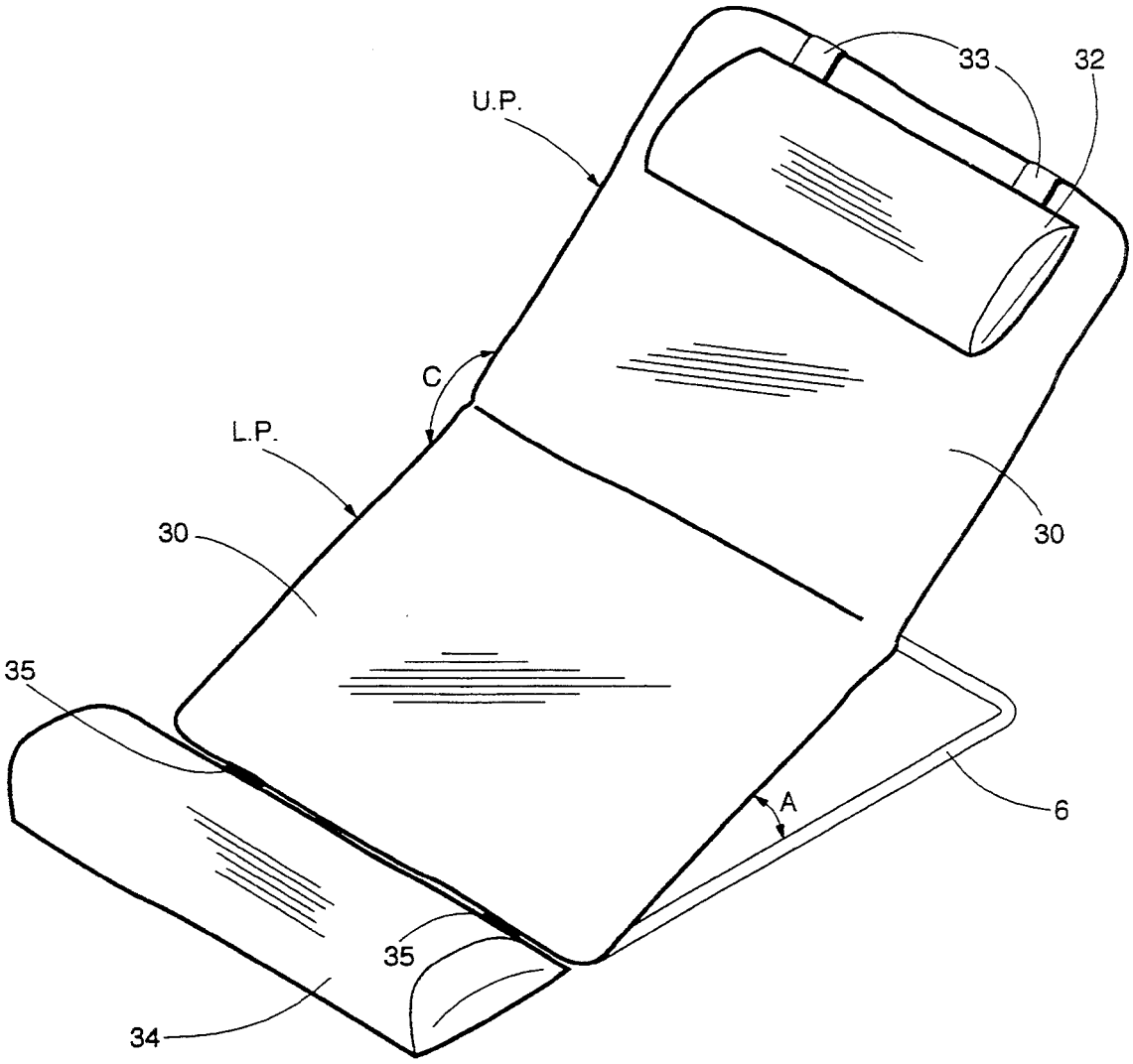
FIG. 1D is an isometric view of the embodiment shown in FIGS. 1A, 1B, and 1C with the upholstery on it.

FIG. 1D is an isometric view of the embodiment shown in FIGS. 1A, 1B and 1C, but in a finished form with all the cushions and upholstery in place.

Figure 1E:
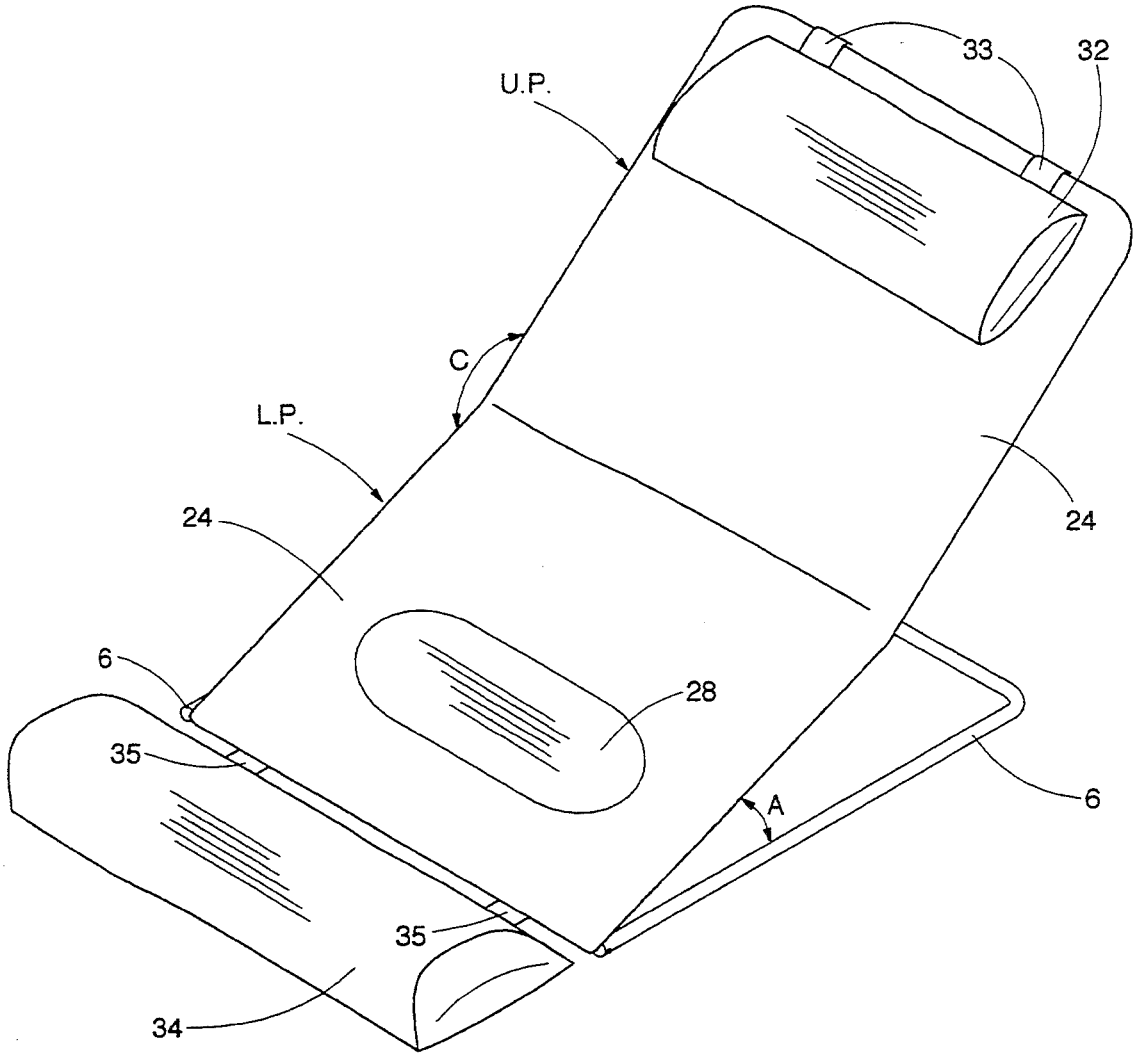
FIG. 1E is an isometric view of the embodiment shown in FIGS. 1A and 1B with only a support sheet, lumbar support, head pillow, and seat cushion.

FIG. 1E is an isometric view of the embodiment shown in FIGS. 1A, 1B, and 1C, but without the main cushion 26 shown in FIG. 1C. In this embodiment, the main cushion 26 has been eliminated, and it is a bit like a lawn chair or director's chair without cushions, except with a lumbar support 28. The lumbar support 28 is a cushion pad mounted to the surface of the support sheet designed to support the natural lordotic region of the lumbar region of the user's back. This may be shaped like the lumbar support 28 shown in FIG. 1C, but it may be made of a softer material since it will be almost directly touching the user's back. This would certainly be a more economical way of making the backrest/leisure chair, and it would be especially suited for use at the beach, or a similar relatively casual purpose. Of course this embodiment would be lighter and more compact without the main cushion. The lumbar support 28 would be covered with a fabric, probably of the same material as the material used for the support sheet 24. One way to achieve the same effect is by eliminating the lumbar insert 28 and contouring the frame as in FIG. 4.

Figure 1F:
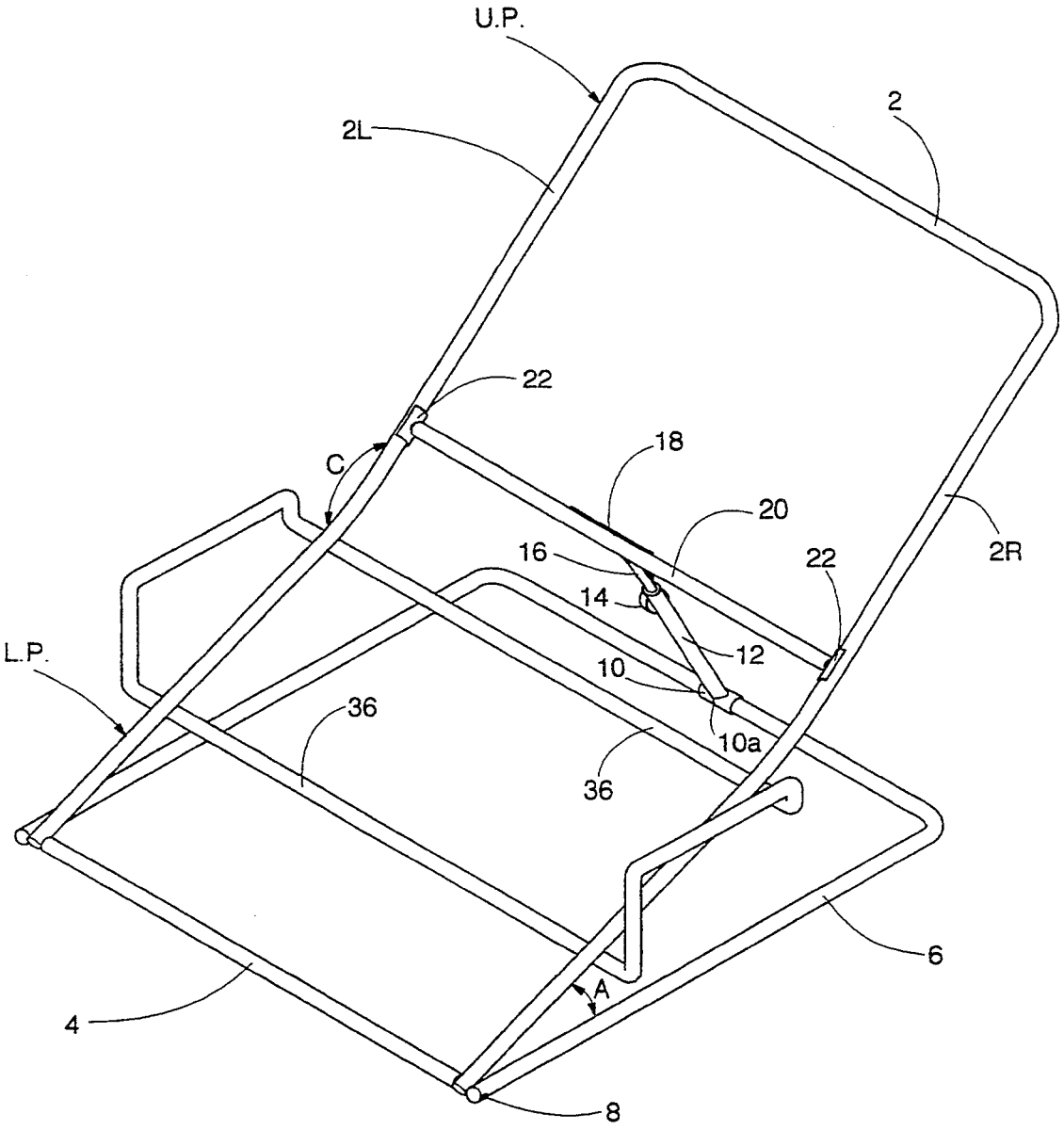
FIG. 1F is an isometric view of the support structure shown in FIGS. 1A, and 1B with a frame for armrests attached.

FIG. 1F is an isometric view of the embodiment shown in FIGS. 1A and 1B, but with a frame for armrests. In a preferred embodiment, the armrest frame 36 would be installed after the support sheet 24 etc. shown in FIG. 1C is installed as described. After the support sheet is installed, the armrest frame 36 can be secured to the main U frame 2 with screws at the four points where the armrest frame 36 contacts the main U frame 2. The screws would be screwed from the armrest frame 36 through to the main U frame 2. The armrest frame 36 is designed to be functional for use on the backrest/leisure chair when the chair is at either a reclining position, or a more upright position. The armrest frame 36 can be made in a variety of shapes and types of construction, which should be obvious to those knowledgeable in the art and skill related to this invention.

Figure 1G:
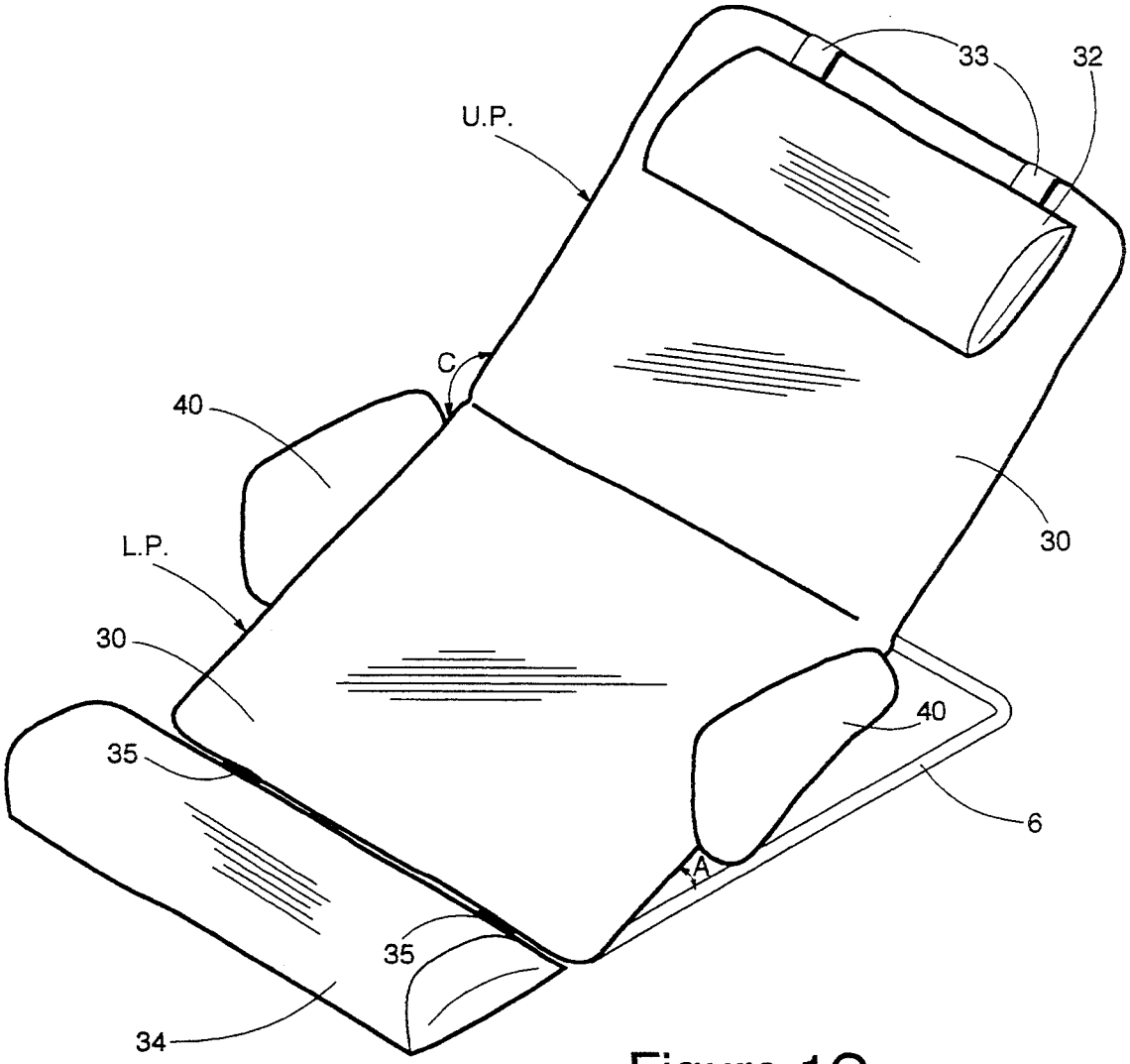
FIG. 1G is an isometric view of the embodiment shown in FIG. 1F with cushions and upholstery.

FIG. 1G is an isometric view of the embodiments shown in FIGS. 1A, 1B, 1C, 1D, and 1F, but with the armrest frame 36 shown in FIG. 1F cushioned, upholstered, and attached to the finished backrest as shown in FIG. 1D. The armrest cushions 40 shown are merely representative, and can be designed to suit a variety of aesthetic and functional requirements. If the cushioning material for the armrest cushions 40 is very bulky on the top, it may be necessary to slip the armrest frame 36, shown in FIG. 1F, and armrest cushions 40 down the upholstered main U frame starting at the top above the head pillow, and moving all way down to the predetermined position. The reason for this is, if the top of the armrest cushion 40 is very bulky, it will not be easily pulled into position from the underside of the upholstered U frame 2. To put the armrest in place, the lower portions of the cushioned armrests would be contoured with concave channels on the inside parts, so the upholstered assembly can fit around the main cushion 26 shown in 1C and still be bulky on top.

Figure 1H:
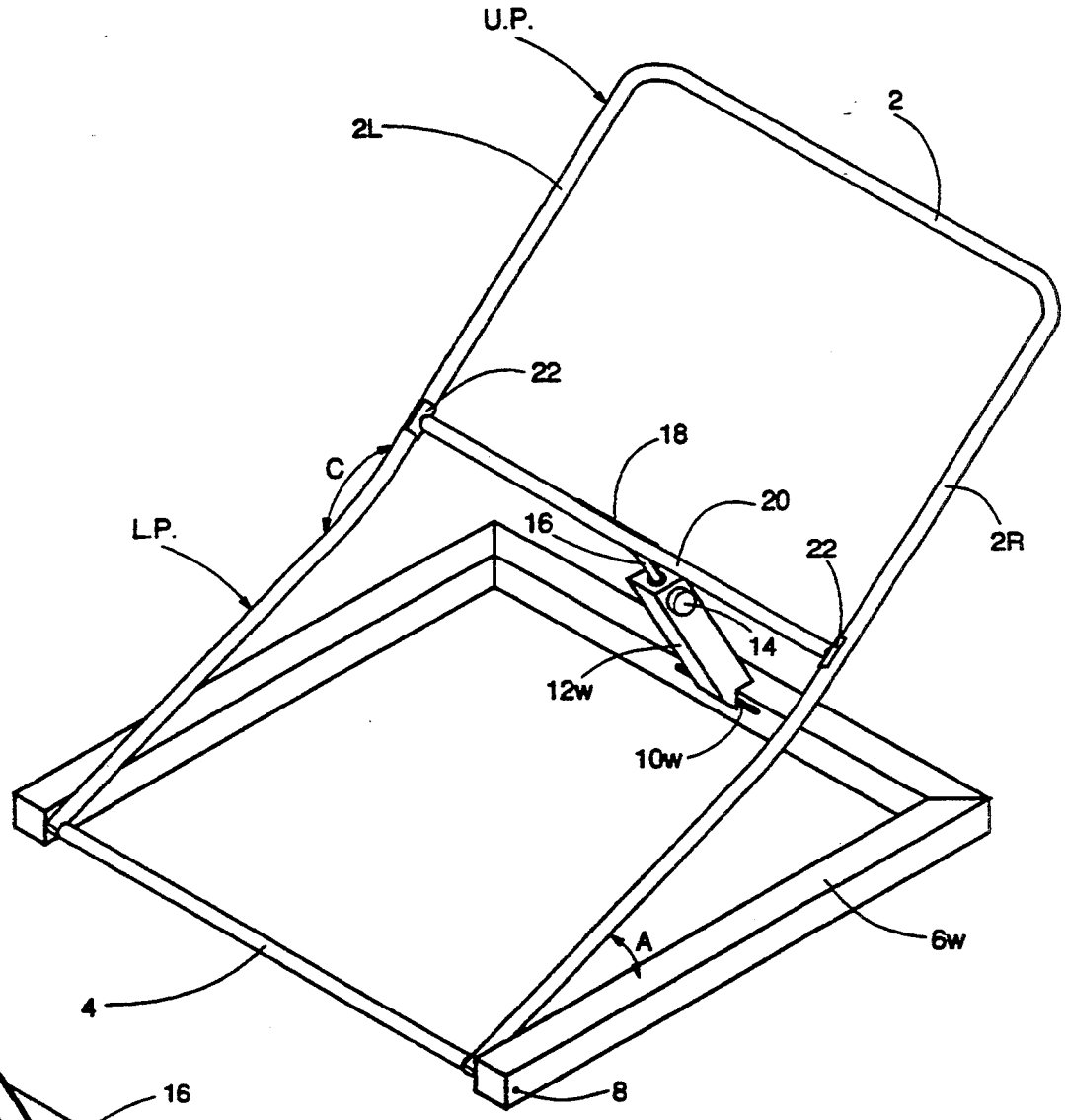
FIG. 1H is an isometric view of the embodiment shown in FIG. 1A, but with a wooden base U frame and wooden lower telescoping support piece.

FIG. 1H is an isometric view of the embodiments shown in FIGS. 1A and 1B but with a wooden base U frame **6*w* and a wooden lower telescoping piece 12*w*. By simply substituting wooden components for the base U shaped frame 6 and lower telescoping piece 12 shown in FIGS. 1A and 1B, the look of the backrest/leisure chair can be changed substantially. This makes it possible to economically manufacture backrests/leisure chairs to suit a wide variety of tastes without significantly having to alter the manufacturing methods. Except for the base U frame and the lower telescoping piece, most other parts can be the same on either a wood look frame, or a metal look frame. In the drawing, the wooden base U frame 6*w* is made of three pieces of wood, joined at the mitered corners with screws, dowels or another common woodworking joint. The lower telescoping piece 12*w* is made of another piece of wood, but with a hole in it which is appropriate for the upper telescoping piece 16 to be inserted in it. The lower telescoping piece 12*w* is secured to the base U frame with a pivoting mechanism shown as 10*w*. The securing knob 14 is the same as shown in FIGS. 1A and 1B, except instead of being mounted to the lower telescoping piece 12, it is mounted to the wooden lower telescoping piece 12*w***.

Figure 1I:
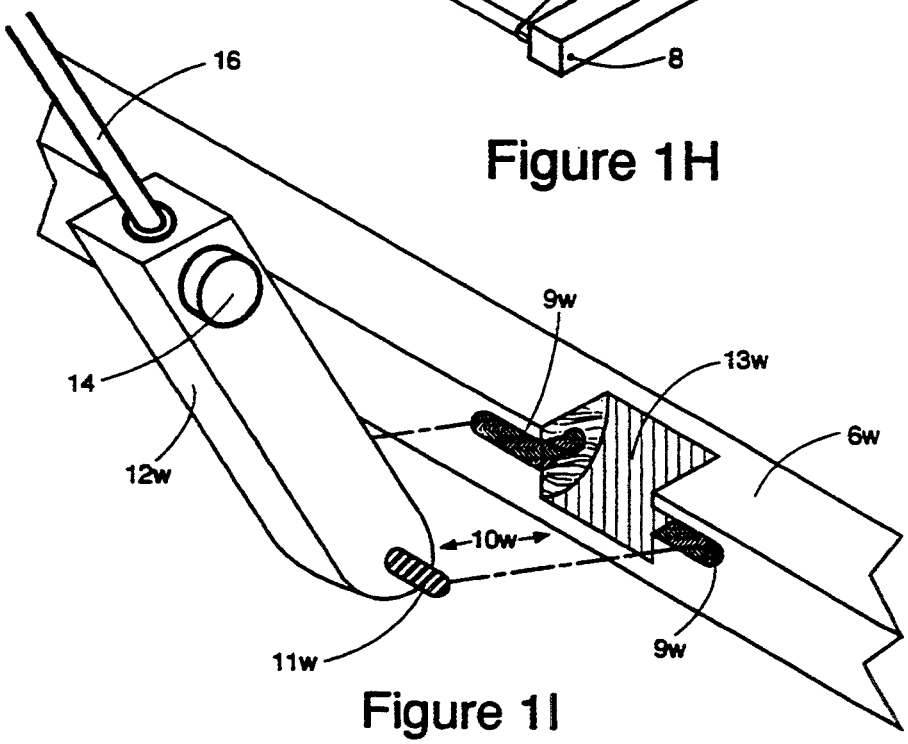
FIG. 1I is an exploded isometric view of the wooden pivoting mechanism shown in FIG. 1H.

FIG. 1I is an exploded isometric view of the wooden pivoting mechanism shown in FIG. 1H. In the drawing, the wooden base U frame **6*w* has a notch for the wooden lower telescoping piece 12*w* to pivot 13*w* and a channel for the pivoting pin 9*w*. Note that the channel for the pivoting pin 9*w* is made so that when the pivoting pin 11*w* is inserted all the way into the generally round portion of the channel, it will be locked in place so that it cannot come out easily. The channel 9*w* can be made using a router with a bit of the shape shown. The notch 13*w* can be made either using dado blades of the proper diameter, or with some other kind of grinding tool of the proper diameter. The bottom of the wooden lower telescoping piece can be formed using a jig saw which cuts the bottom in the shape shown. Of course there are other ways of locking the pivoting pin 11*w* into the channel 9*w* such as inserting the pivoting pin 11*w* into the proper position, and then screwing screws from the bottom so that the screws will go into the channel 9*w* right in front of the pivoting pin 11*w* in such a way that they are like posts that prevent the pivoting pin 11*w* from moving out of position. The pivoting pin 11*w* would probably be made of a strong metal such as steel, and would be inserted into a hole drilled into the lower telescoping piece 12*w*. It is also possible to make a pivoting fitting on wood using the same principle as the pivoting fitting 10 shown on FIG. 1A, but for aesthetic reasons in some applications it may be desirable to make a pivoting fitting as shown in FIGS. 1H and 1I**.

Figure 1J:
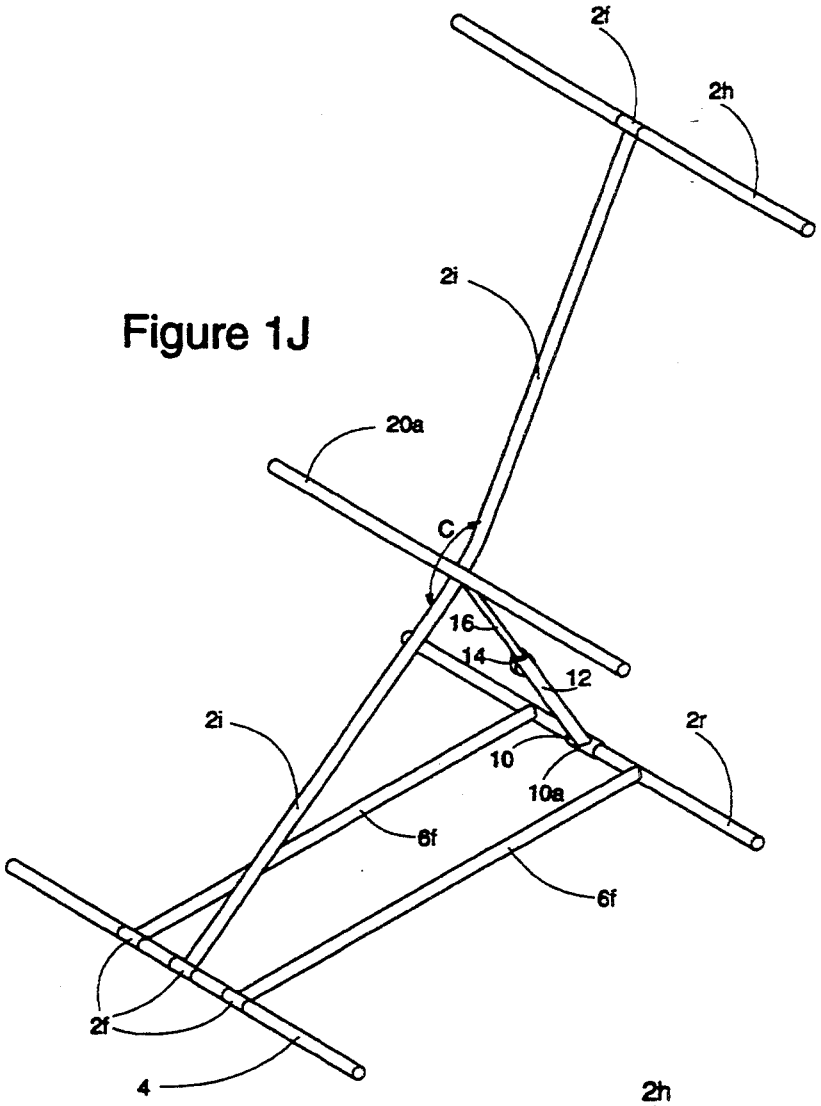
FIG. 1J is an isometric view of a variation of the embodiment shown in FIG. 1A using modified "I" or "T" frames instead of U shaped frames.

FIG. 1J is an isometric view of a frame of an embodiment of the present invention with a generally wedge shaped frame using "I", "T" and/or "II" type frames. The purpose of this is to suggest some of the variations possible with a frame similar to the one shown in 1A. Though many references were made to U shaped frames, a generally wedge shaped frame could be made with generally "I" shaped frames, generally "T" shaped frames, "X" shaped frames, "V" shaped frames, etc., or various modifications of these such as, but not limited to, side by side "II" frames or "I" frames with a middle cross member. Though most of these other types of frames are not specifically shown in the drawings, FIGS. 1J, 1K and the other drawings with their descriptions should suggest and provide enough information to someone knowledgeable and skilled in the art related to this invention ways of making many other embodiments of this invention. One way of making a generally wedge shaped frame with generally "I" shaped frames in place of the U shaped frames would be to take the frame shown in FIG. 1A, remove all the sides of the U shaped frames (2L, 2R and the sides of the base U shaped frame 6—which would be the two sides which do not have the pivoting fitting 10) and replace each set of sides with a center frame or frames of about the same length and shape. The result would look like the embodiment shown in FIG. 1J. In the drawing, there is a main "I" shaped frame **2*i* with an obtuse angle C, which has two "T" fittings 2*f* at both the top and the bottom ends. At the top there is a cross member 2*h* (which is comparable to the top of the main U frame 2 in FIG. 1A) which is attached with a "T" fitting 2*f*. At the bottom, there is a bottom spacer bar 4 attached with a "T" fitting 2*f*. At the obtuse angle C, there is a cross bar 20*a* which can be attached either with a crossover fitting, or in a manner similar to what is described for FIG. 1K below. The two front to back members of the base frame 6*f* are pivotally attached to the bottom spacer bar 4 with "T" fittings 2*f*. The other ends are attached to the base frame cross member 6*r*. There is a pivoting telescoping support system 10, 10*a*, 12, 14, and 16 (similar to the one described for FIGS. 1A and 1B) attached to the base frame cross member. A support sheet for this frame would be similar in construction and assembly to the alternate support sheet 24*a* described for FIG. 1K. Cushions would be installed in a manner similar to that described for FIG. 1C** and others.

Figure 1K:
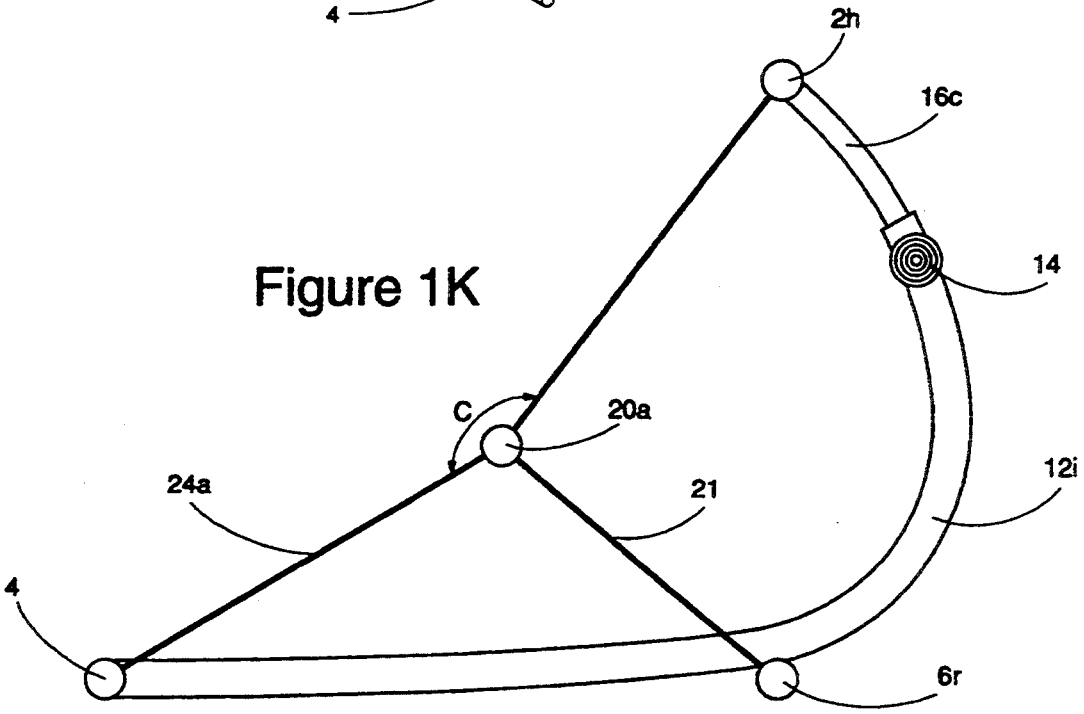
FIG. 1K is a side view of another variation of the type of embodiment shown in FIG. 1A.

FIG. 1K is a side view of a generally wedge shaped frame which is another variation of the type of embodiment shown in FIG. 1A. In this embodiment, there are four cross pieces about 21" long—the bottom spacer bar 4, the base cross member **6*r*, the top cross member 2*h*, and the cross bar at the obtuse angle 20*a*. The bottom spacer bar 4 is attached to the curved main frame and lower telescoping piece 12*i* with a "T" fitting similar to 2*f* in FIG. 1J. The base cross member 6*r* is attached to the underside of the curved main frame 12*i*, either by directly welding it, or using a crossover fitting. If a crossover fitting is used, the unit could be shipped in a relatively flat box, and all of the cross pieces could be put on after shipping. The top cross member 2*h* is attached to the curved upper telescoping piece 16*c* with a "T" fitting similar to 2*f* in FIG. 1J. The curved upper telescoping piece 16*c* is inserted into the curved main frame and lower telescoping piece 12*i*, and secured with the securing knob on a threaded base 14. The alternate support sheet 24*a* is made of a material such as canvas or something else suitable for supporting the weight of a person's back and head. When the alternate support sheet 24*a* is used with a generally wedge shaped frame like shown in FIG. 1K, together they make two similarly sized support surfaces. There is a casing for each of the cross pieces 4, 20*a*, and 2*h* sewn in the alternate support sheet 24*a* at the bottom, middle and top of the support sheet. In the center of the casing (center as measured from side to side) for the top and bottom cross pieces 4 and 2*h*, there is a piece of material that has been cut out which is big enough so the casing can fit around the "T" fittings mentioned above. To put the frame together with the support sheet 24*a*, the bottom cross member 4 would be slipped through the casing half way, so that it will be sticking out in the center where the material had been removed. Next the part of the bottom cross member 4 that was sticking out would be slipped through the bottom "T" fitting, and then through the rest of the casing on what is now the other side of the "T" fitting. The bottom cross member 4 would then be secured to the "T" fitting with a screw or the like. Next the same process would be repeated for the top cross member 2*h*. After that, the cross bar at the obtuse angle 20*a* would be slipped all the way into the casing in the middle. Finally, a cable or rope 21 would be slipped through the cross bar 20*a* (which is really a tube) at the obtuse angle 20*a* and secured to the base cross member 6*r*. The cable or rope 21 would be secured by slipping it through the base cross member 6*r*, or by wrapping it around 6*r* near each of the ends of 6*r*, and fastening it in a manner used with ropes or cables such as a knot or a crimping splice. It should also be noted that this procedure could be used to make the obtuse angle C adjustable, by having the top cross member 2*h* work like a window shade so that it can give or take slack in the support sheet 24*a*, and at the same time the length of the cable or rope 21 could be adjusted. Obviously, to make the top cross member 2*h* work like a window shade, the casing would have to be secured so it wouldn't slip when the top cross member 2*h* is rolled to adjust the slack, and also the screw or whatever that secures the top cross member 2*h* to the "T" fitting would have to be able to lock the top cross member 2*h* in any position that it might be adjusted to. To increase the obtuse angle C the cable or rope 21 would be lengthened, and the top cross member 2*h* (from the view shown) would be rolled in a clockwise direction to take out the appropriate amount of slack. To decrease the obtuse angle C, the reverse procedure would be followed. Cushions and upholstery would be installed in a manner similar to that described for FIG. 1C** and others.

Figure 2A:
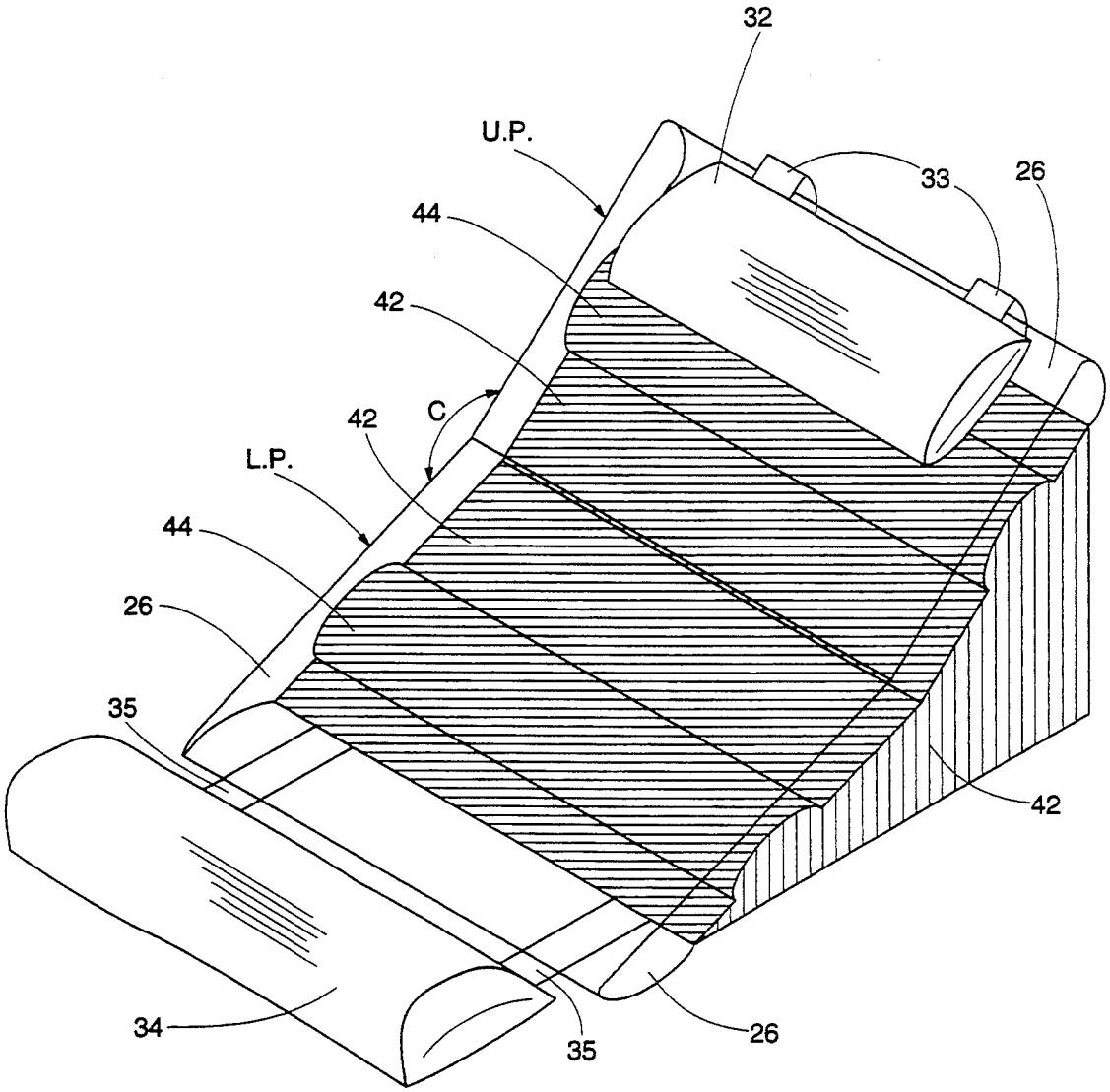
FIG. 2A is an isometric view of an embodiment of the present invention using a support foundation made of a high firmness polyurethane foam, a styrofoam or a similar material. In this view, the main cushion is shown clear to show the support foundation.

FIG. 2A is an isometric view of an embodiment of the present invention using a high firmness support foundation 42 made of styrofoam or the like. The main or top cushion 26 is shown clear in this drawing to show the support foundation 42. The support foundation 42 could be made from a variety of materials including a high firmness polyurethane foam, styrofoam, etc. which would be generally solid, or it can be made of something like fiberglass, plywood or a plastic wherein the top, sides and back are made of the material, but inside is hollow. In the drawing, the leisure chair is shown so it can be used in either a reclining position as shown, or in a more upright position if it were rotated 90 degrees so that what is shown as the back of the support foundation would become the bottom of the support foundation, and what is shown as the bottom becomes the back. To switch positions, it would also become necessary to switch the positions of the seat cushion 34 and the head pillow 32. In doing this, the straps for the head pillow 33 become the straps for the seat cushion, and the straps for the seat cushion 35 become the straps for the head pillow. This would be accomplished by making the straps with a quick lock and release mechanism similar to those on seat belts for baby strollers. Since the backrest/leisure chair can be dual position, it is necessary to have a lumbar support for both positions. In the drawing, there are lumbar support contours 44 on the support structure of both the lower portion L.P. and on the upper portion U.P. Though not shown this way, these lumbar supports could be part of the main cushion 26 similar to the way it is shown in FIG. 1C instead of being attached to the support foundation 42. Of course, when the leisure chair is put in the more upright position, the lower portion L.P. would become the upper portion U.P. and vice versa. Also in FIG. 2A, there is an obtuse angle C which is similar to the obtuse angle C shown in FIG. 1C.

The leisure chair shown in FIG. 2A works the same way as the leisure chair shown in FIG. 1C except that instead of being adjustable, it is dual position. It should be pointed out that though FIG. 2A shows a leisure chair that is dual position, it is of course possible to make it for use in just one position. The position chosen could be upright, reclining, or somewhere in between. In FIG. 2A the head pillow 32 is attached to straps for the head pillow 33 which are secured to the support foundation 42. The seat cushion 34 is attached to straps for the seat cushion 35 which are secured to the high firmness support foundation. Though the methods of securing the straps to the support foundation will vary with the type of material the support foundation is made of, the straps must be secured well enough to the support foundation to keep the seat cushion from moving away from the support foundation when a person is sitting on it. This may require using some sort of metal anchoring system into the high firmness support foundation 42. For example, for a styrofoam support foundation 42 a metal anchor could be put in place while the foundation is being molded, so that when the styrofoam sets, the anchor would be securely attached to the styrofoam, and the anchor would be made so that a strap could be attached to it. One way of doing this would be to have a ring on the exposed portion of the anchor so that the strap could go around it. Other methods should be apparent to people knowledgeable in the art of working with materials suitable for making a high firmness support foundation.

The way of making the high firmness support foundation 42 will depend on the type of material chosen. Styrofoam, plastic, or fiberglass would probably be molded out of one piece. If the chosen material was a flexible polyurethane foam cushion with an ILD of about 60, it could be cut into shape with a band saw from a large piece of slab material. It could also be made out of plywood, with lumbar supports made of firm polyurethane foam installed to the plywood decks that form the slope of the foundation.

There are two other ways to make a high firmness support foundation and the backrest/leisure chair of this type of embodiment. Both methods involve having an internal high firmness member or members. The first method requires a mold for doing injection molding of the soft foam over the firm internal support foundation. The mold would be about the same size and shade as the foundation 42 with the soft top cushion 26 over it shown in FIG. 2B. A firm foundation of a similar size and shade as shown in FIG. 2A, except with about 1" (could be more than 1") trimmed off on the back, the bottom, and each of the two sides, would be put into the mold. This firm foundation would be held in place in the mold so that the back, the bottom, and each of the two sides would be about 1" away from the back, the bottom, and each of the two sides of the mold. The mold would be sealed closed, and a flexible foam material would be injected into the mold so that the finished product would be about the same size and shade of the foundation 42 with the soft top cushion 26 over it shown in FIG. 2B. The result would be a molded one piece generally wedge shaped foundation with soft top cushion which also has the bottom, the back, and each of the two sides cushioned with the soft cushion material.

Figure 2B:
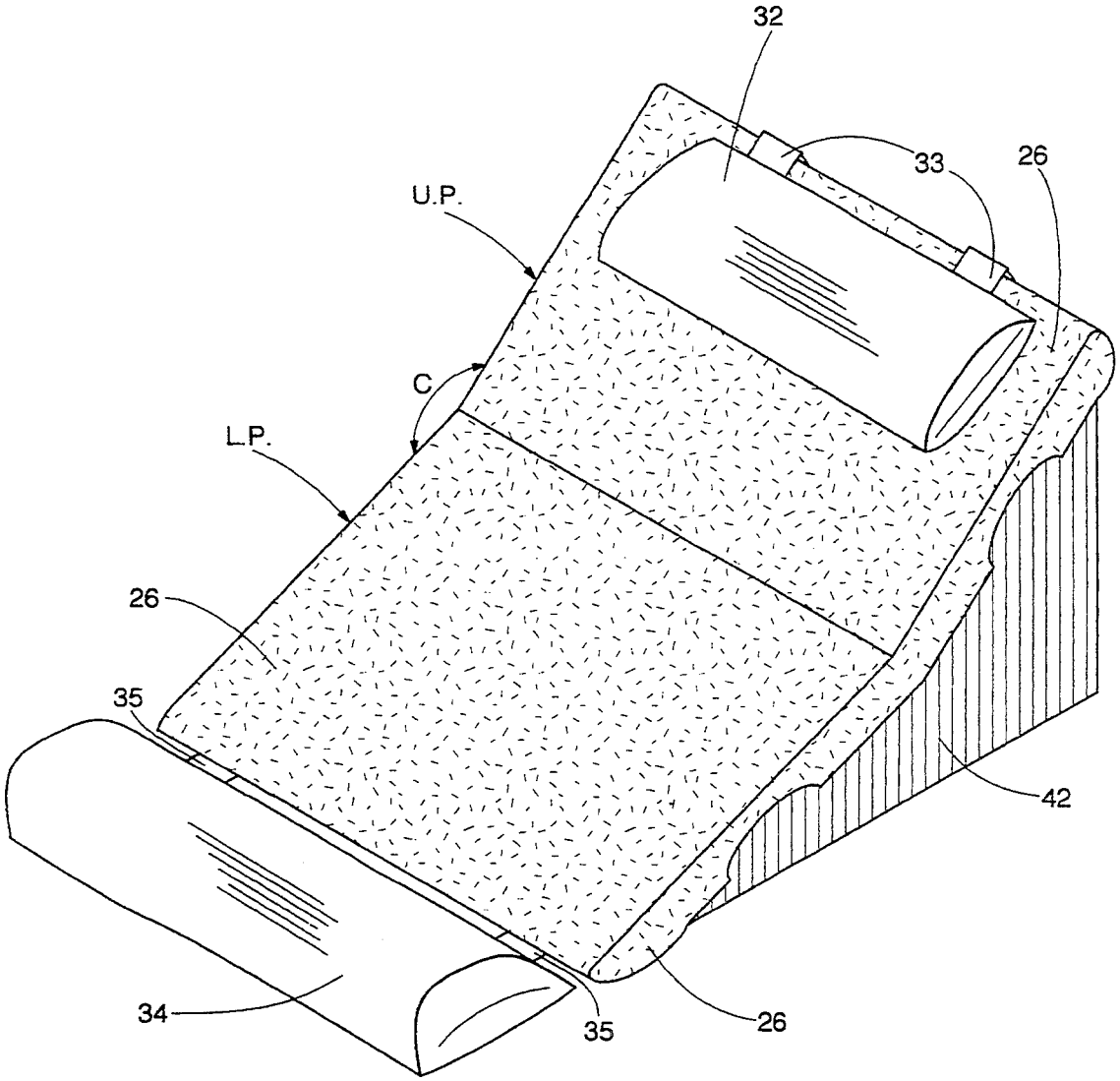
FIG. 2B is an isometric view of the embodiment shown in FIG. 2A but showing the main cushion normally.

Another way to make an embodiment similar to the one shown in FIG. 2B is to make both a generally wedge shaded foundation and top cushion out of a relatively soft foam material but use firm internal support members to provide the equivalent of a relatively firm foundation. The generally wedge shaded foundation and top cushion would be of about the same size and shape as those shown in the embodiment in FIG. 2B, except there would be no lumbar support contours 44 like those shown in FIG. 2A. The soft wedge shaped foundation and top cushion could be made in one piece or made of two pieces in a manner similar to that shown for FIGS. 2A through 2C. To provide lumbar supports, cavities or hollows would be made in the generally wedge shaped foundation and top cushion, and a relatively firm generally cylindrical, generally semi-cylindrical, or other shaped insert would be inserted therein according to the methods described either under OPERATION OF INVENTION—Method of Cushion Manufacture or in my previous patent application contained herein and shown in FIGS. 8 through 18. The cavities or hollows and the firm internal support members would be placed at the position where each of the lumbar supports 44 in FIG. 2A are placed. The embodiment made after using the procedures described would have the effect of providing a relatively firm generally wedge shaped foundation, a softer top cushion, and a means for supporting occupant's lumbar region in a relatively natural lordotic curve, and is to be considered as such for the purposes of the claims.

FIG. 2B is an isometric view of the embodiment shown in FIG. 2A, but showing the main cushion 26 normally. In a preferred embodiment, the lower portion L.P. when measured from the bottom edge near the seat cushion 34 to the obtuse angle C is between about 16 inches and about 18 inches. Also, in the same preferred embodiment, the upper portion U.P. when measured from the obtuse angle C to the top edge near the head pillow 32 is between about 16 inches and about 18 inches.

Figure 2C:
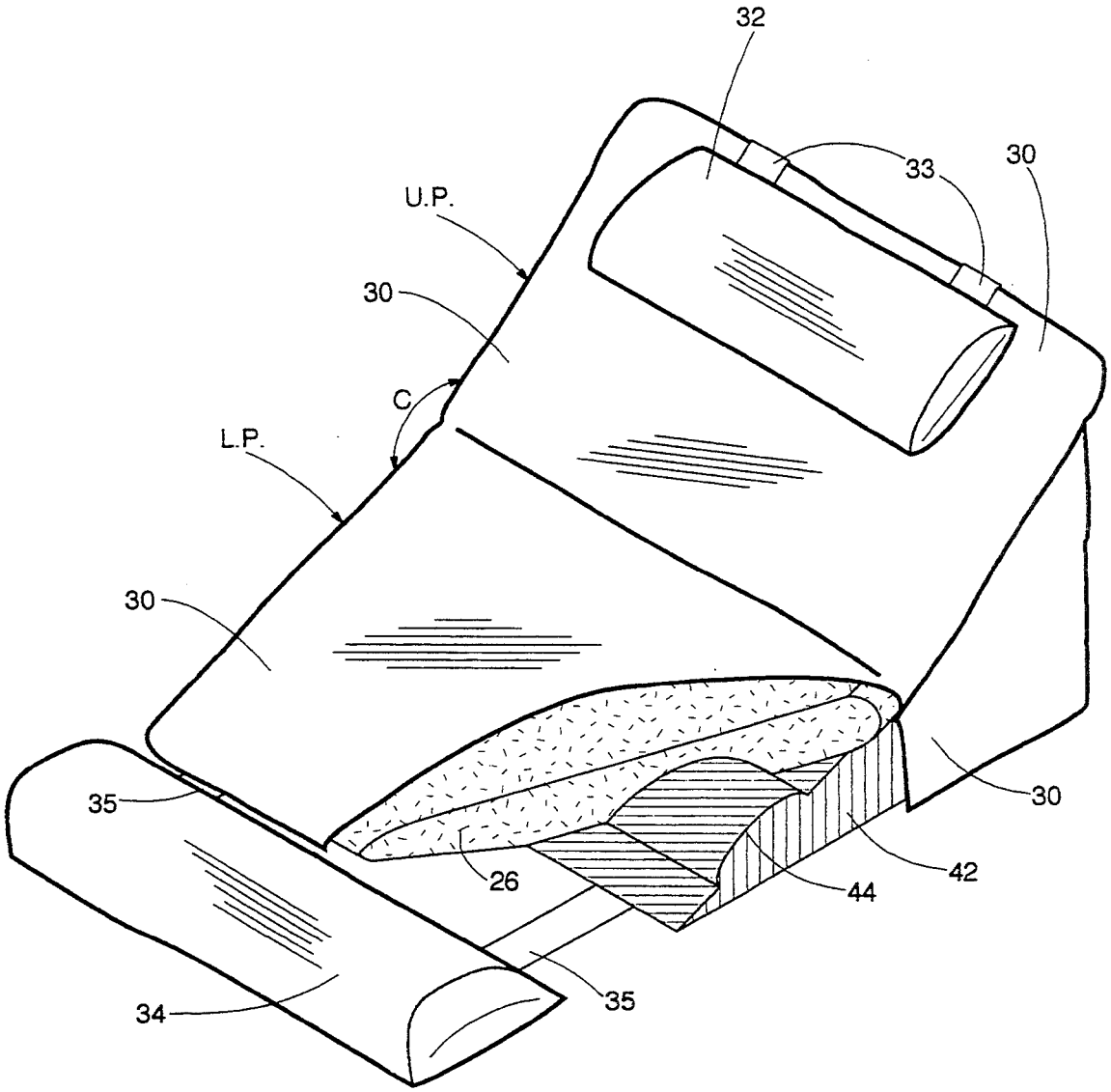
FIG. 2C is an isometric view of the embodiment shown in FIGS. 2A and 2B with a cutaway showing the support foundation, main cushion, and upholstery.

FIG. 2C is an isometric view of the embodiment shown in FIGS. 2A and 2B with a cutaway showing the support foundation 42, main cushion 26, and upholstery 30. The cutaway shows how a lumbar support 44 and the main cushion 26 are shaped to fit with each other. The main cushion 26 has a hollow or recess that corresponds to each of the firmer generally semi-elliptically shaped cylindrical contours that are the lumbar supports 44, and of course the main cushion 26 is placed over the support foundation 42. The main cushion 26 is attached to the support foundation 42 with a glue suitable for polyurethane foam or the like. The upholstery 30 is secured around the support foundation 42 and of course around the main cushion 26.

Figure 2D:
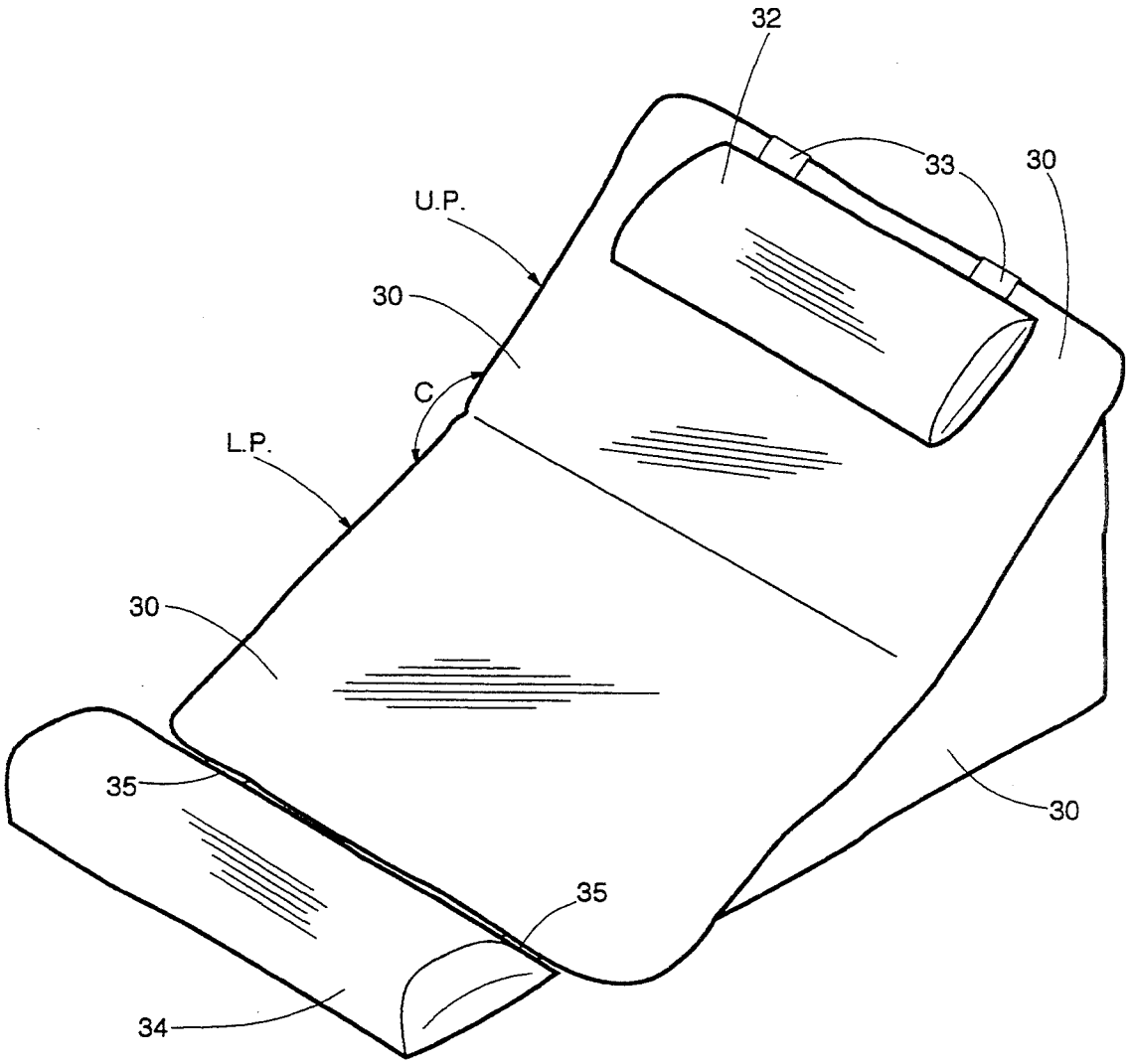
FIG. 2D is an isometric view of the embodiment shown in FIGS. 2A, 2B, and 2C with upholstery.

FIG. 2D is an isometric view of the embodiment shown in FIGS. 2A, 2B, and 2C with upholstery.

Figure 3A:
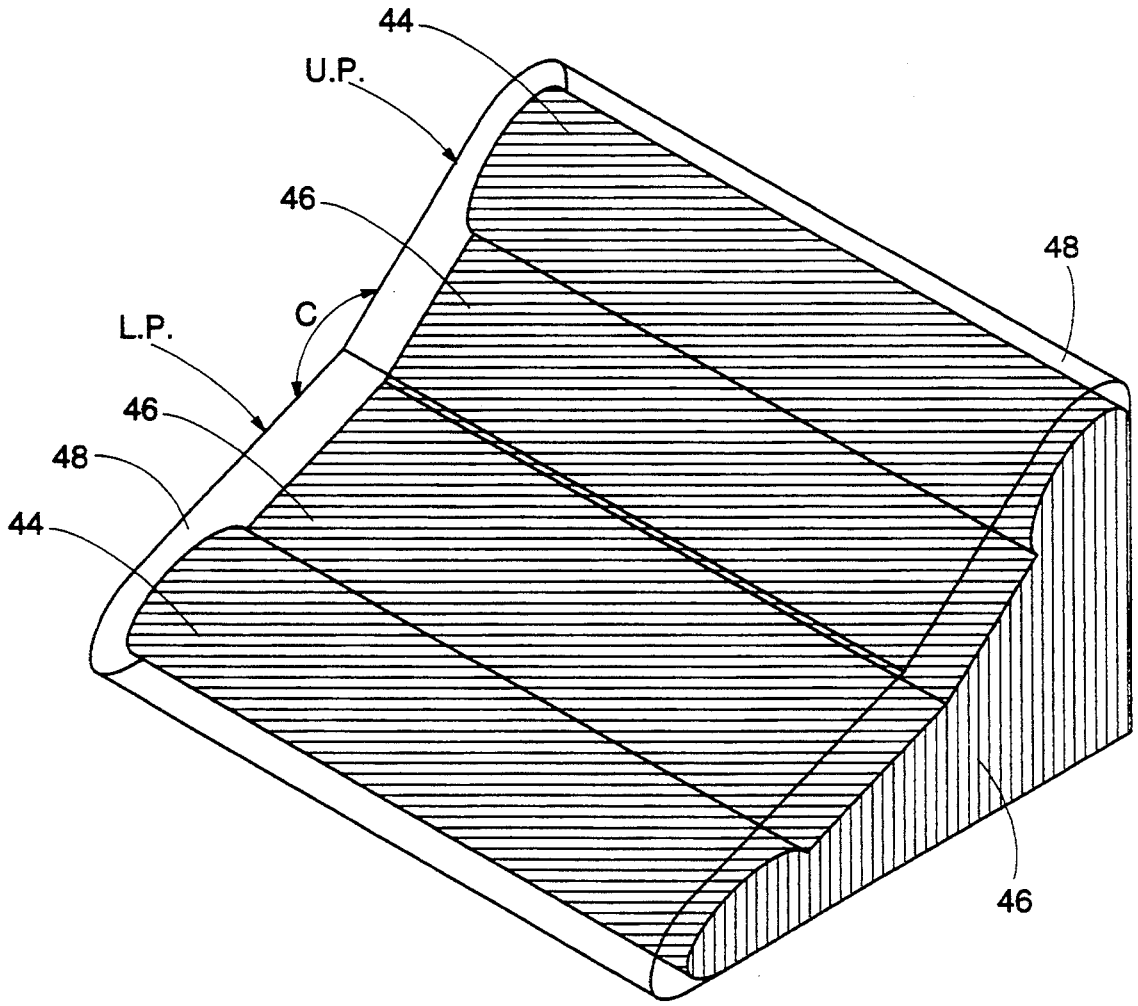
FIG. 3A is an isometric view of an embodiment of the present invention using a high firmness support foundation for use in a bed or sofa. In this view the main cushion is shown clear to show the support foundation.

FIG. 3A is an isometric view of an embodiment of the present invention using a generally wedge shaped high firmness foundation for use in bed or on a sofa. In this view, the modified main cushion 48 is shown clear to show the modified high firmness support foundation 46. In the drawing, the modified high firmness support foundation 46 is made of a material such as styrofoam or flexible polyurethane foam with an ILD of about 50 or 60 pounds. If the foundation 46 is made of styrofoam, it would probably be shaped in an injection type mold, whereas if the foundation 46 was made of flexible polyurethane foam it could either be formed in a mold, or cut and shaped out of a large piece of slab cushion material with a band saw or the like. The modified foundation 46 is similar to the firm foundation 42 shown in FIGS. 2A, 2B, and 2C, except it is a bit smaller, and the lumbar supports 44 start at or near the top and bottom edges. The reason the modified high firmness support 46 and the modified main cushion 48 shown in FIG. 3A are smaller than their counterparts the high firmness support foundation 42 and the main cushion 26 in FIG. 2A is that a person sitting on a bed or sofa will sink a few inches into the bed or sofa. When the person's body sinks down into the sofa or mattress, that means that there is less of the person's lower back left to support, because some of the person's back is now below the level of the backrest. Also, since the person sinks into the mattress or sofa, the need for a seat cushion like 34 on FIG. 2C to keep the user from slipping down is greatly reduced—especially with a good mattress with independent springs. This is because the natural give of a bed or sofa provides a natural seat cushion, and since most of the weight is focussed on the point where the buttocks meet the mattress, the user will sink into the mattress in a way that will prevent slipping down—eliminating the need for a seat cushion. One other possible difference between the modified high firmness support foundation 46 and the high firmness support foundation 42 shown in FIG. 2A is that it would probably only be appropriate to make the modified support foundation out of a softer lighter material such as flexible polyurethane foam or styrofoam, since it will be desirable to put it on a bed or sofa. Materials such as plywood or fiberglass are so hard that few people would want to put it on a bed or sofa. There would also be a safety concern with a backrest made to be used above the floor, if it were made of a heavier or harder material. If such a backrest fell on someone, it could cause injury, especially if it were to fall on a small child.

There are two other ways to make a high firmness support foundation and the backrest of this type of embodiment. Both methods involve having an internal high firmness member or members. The first method requires a mold for doing injection molding of the soft foam over the modified firm internal support foundation. The mold would be about the same size and shape as the modified foundation 46 with the modified soft top cushion 48 over it shown in FIG. 3A or FIG. 3B. A modified firm foundation of a similar size and shape as shown in FIG. 3A, except with about 1" (could more than 1" if desired) trimmed off on the back, the bottom, and each of the two sides, would be put into the mold. This modified firm foundation would be held in place in the mold so that the back, the bottom, and each of the two sides would be about 1" away from the back, the bottom, and each of the two sides of the mold. The mold would be sealed closed, and a flexible foam material would be injected into the mold so that the finished product would be about the same size and shape of the modified foundation 46 with the soft top cushion 48 over it shown in FIG. 3B. The result would be a molded one piece generally wedge shaped modified foundation with modified soft top cushion which also has the bottom, the back, and each of the two sides cushioned with the soft cushion material.

Figure 3B:
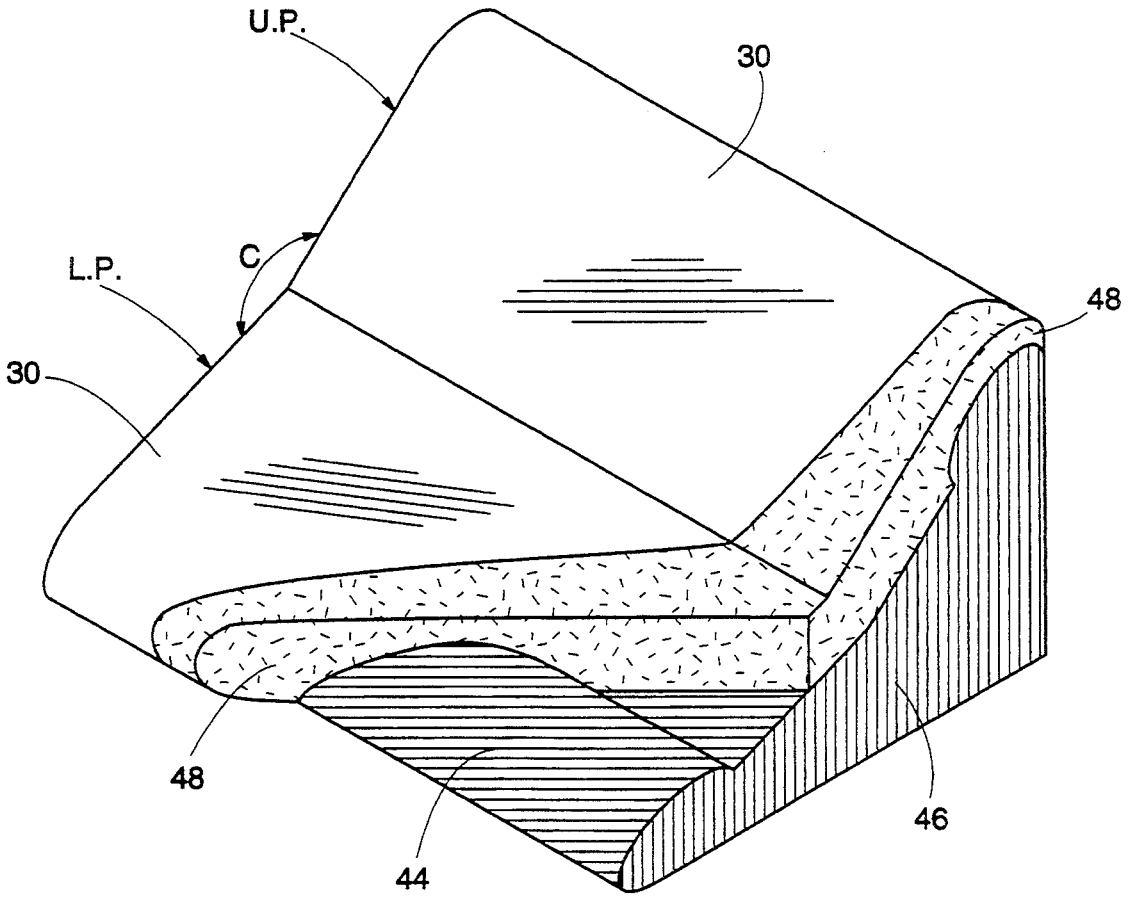
FIG. 3B is an isometric view of the embodiment shown in FIG. 3A with a cutaway showing the support foundation and the main cushion.

Another way to make an embodiment similar to the one shown in FIG. 3B is to make both a generally wedge shaped modified foundation and top cushion out of a relatively soft foam material but use firm internal support members to provide the equivalent of a relatively firm foundation. The generally wedge shaped foundation and top cushion would be of about the same size and shape as those shown in the embodiment in FIG. 3B, except there would be no lumbar support contours 44 like those shown in FIG. 3A. The soft wedge shaped foundation and top cushion could be made in one piece or made of two pieces in a manner similar to that shown for FIGS. 3A and 3B. If made in one piece, it could be cut out of a piece of slab foam material with a band saw. To provide lumbar supports, cavities or hollows would be made in the modified generally wedge shaped foundation and top cushion, and a relatively firm generally cylindrical, generally semi-cylindrical or other shaped insert would be inserted therein according to the methods described either under OPERATION OF INVENTION—Method of Cushion Manufacture or in my previous patent application contained herein and shown in FIGS. 11 through 21. The cavities or hollows and the firm internal support members would be placed at the position where each of the lumbar supports 44 in FIG. 3A are placed. The embodiment made after using the procedures described would have the effect of providing a relatively firm generally wedge shaped foundation, a softer top cushion, and a means for supporting occupant's lumbar region in a relatively natural lordotic curve, and is to be considered as such for the purposes of the claims.

FIG. 3B is an isometric view of the embodiment shown in FIG. 3A with a cutaway showing the modified support foundation 46, the modified main cushion 48, and upholstery 30. The modified main cushion 48 is made of relatively soft material such as flexible polyurethane foam with an ILD of about 20 pounds. The drawing shows how the modified main cushion 48 is shaped to fit over the lumbar supports 44 on the modified high firmness support foundation 46. The modified main cushion 48 would be glued to the support foundation 46 with a glue suitable for polyurethane foam or the like. The modified main cushion 48 has a hollow or recess that corresponds to each of the firmer generally semi-elliptically shaped cylindrical contours that are the lumbar supports 44, and of course the modified main cushion 48 is placed over the modified support foundation 46. In a preferred embodiment, the lower portion L.P. of the modified main cushion 48 is between about 12 inches and about 14 inches when measured from the bottom or front edge to the obtuse angle C. The obtuse angle C is between about 160 degrees and about 170 degrees and in a preferred embodiment is about 165 degrees. The upper portion U.P. is about the same size as the lower portion L.P. The backrest shown is dual position, and so it has contoured lumbar supports 44 on the modified high firmness support foundation 46. The slope of the lower portion L.P. of a preferred embodiment of the backrest is about 30 degrees. This means that the slope of the upper portion U.P. of the backrest is about 45 degrees. When the backrest is put in the alternate or upright position (the back becomes the bottom, and the bottom becomes the back), the slope of what will now become the lower portion L.P. (formerly the upper portion U.P.) will be about 45 degrees, while the upper portion U.P. (formerly the lower portion) will be about 60 degrees. Though the backrest is shown as dual position, it can of course be made for use in a single position. To make it for use in a single position, only one lumbar support would be required, and it would probably be desirable to make the slope of the lower portion L.P. between 30 degrees and 45 degrees.

Figure 3C:
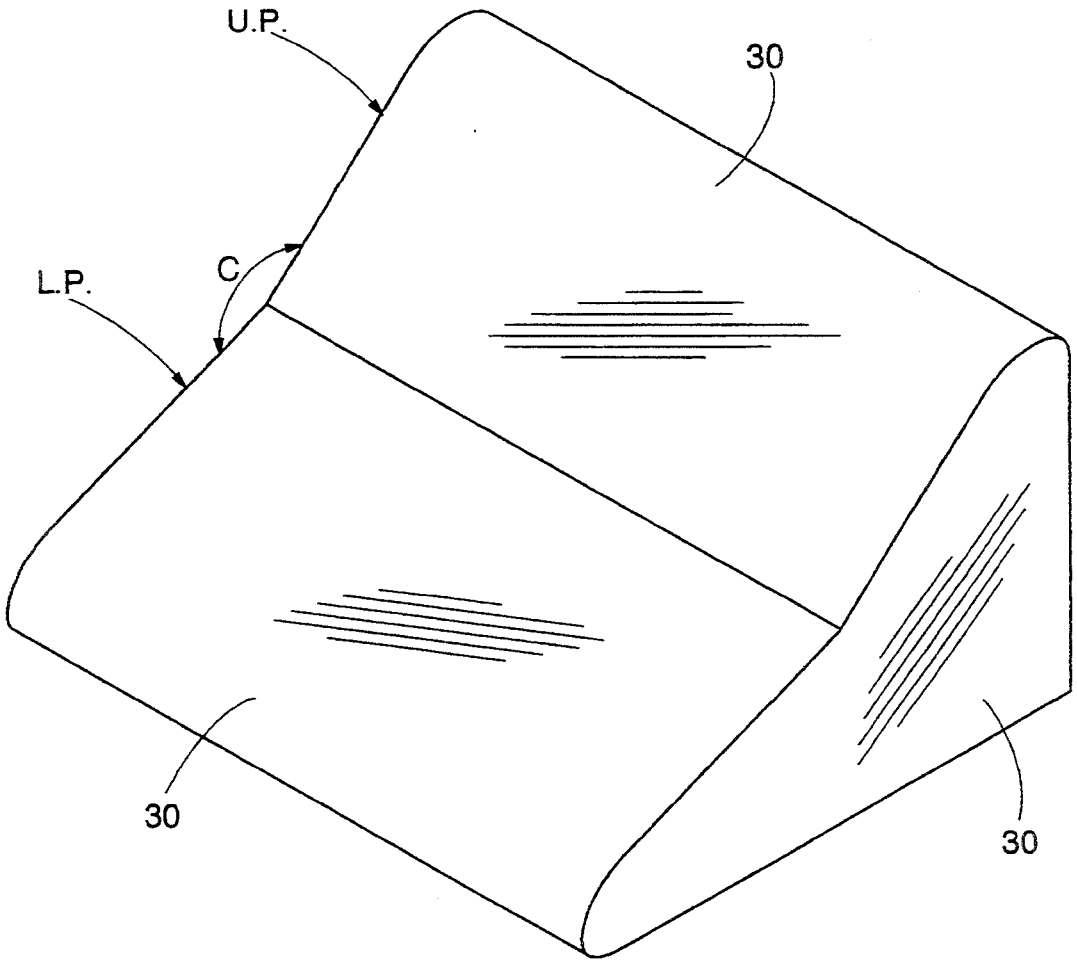
FIG. 3C is an isometric view of the embodiment shown in FIGS. 3A and 3B with support foundation, main cushion and upholstery.

FIG. 3C is an isometric view of the embodiment shown in FIGS. 3A and 3B with finished upholstery 30. It should be noted that there is no attached head pillow with this. The reason for this is that a user can supply their own pillow, especially when the backrest is used in bed or on a sofa. Though a head pillow could be attached, it does not seem to be essential, and the additional bulk a head pillow adds does not seem to justify the convenience provided when a person already has a pillow in bed or on a sofa.

Figure 4:
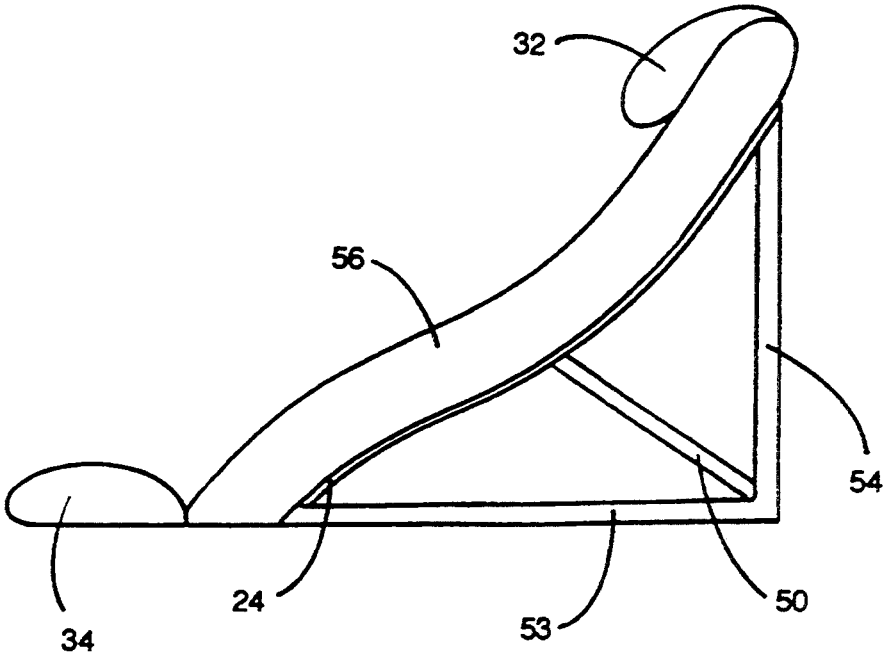
FIG. 4 is a side view of an embodiment of the present invention without an internal lumbar support, but with a contoured lower cushion and frame or structure to provide the lower back support without the lumbar support.

FIG. 4 is a side view of a generally wedge shaped embodiment of the present invention without an internal lumbar support, but with a convex contoured lower cushion and frame or structure to provide the lower back support without the internal lumbar support. The convex contour is designed to support the lumbar region of the user's back in a relatively natural lordotic curve. In the drawing, there is a frame comprising a base support 53, a vertical support member 54, and an optional diagonal support member 50. Since the drawing is only a side view, it should be noted that the opposite side is constructed the same way, and that there are cross members between the two sides so that the frame is generally similar to the construction of the frame shown in FIG. 1H, except it is not adjustable as shown, and has two vertical support members 54—one on each side. Other differences in the frame include the fact that the embodiment shown in FIG. 4 can have an optional diagonal support member 50 or one on each side. The optional diagonal support member(s) could provide additional support for the support sheet 24 if it were made out of a molded plywood type product and did not have use a main U shaped frame similar to that shown in FIG. 1A. In such a case, the molded plywood would be considered part of the frame as the occupant supporting member. The optional diagonal support member could also be used with a main U shaped frame (not shown) either to provide additional support, or it could be adjustable like the telescoping piece 12, 14, and 16 shown in FIG. 1A to adjust what would be analogous to obtuse angle C on FIG. 1 if the main U shaped frame had a pivoting joint at obtuse angle C. If a main U shaped frame is used, it would have a convex curve as shown on the lower portion of the frame, and could be made just like the embodiment shown in FIG. 1C, except without the lumbar support.

Figure 5A:
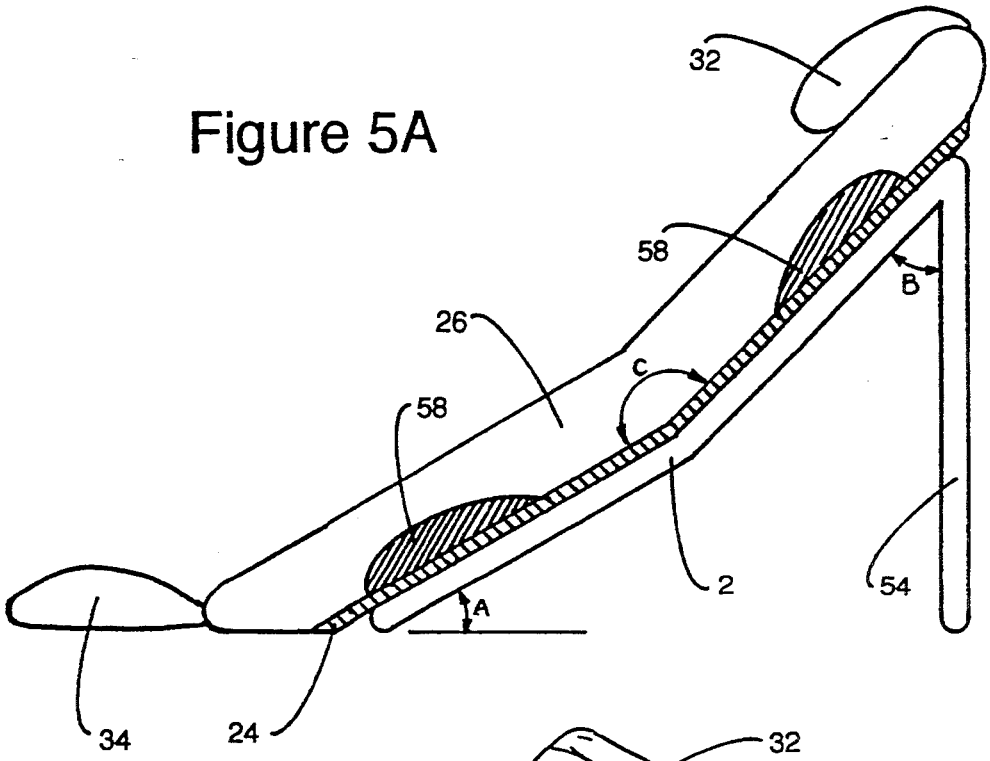
FIG. 5A is a side view of an embodiment of the present invention which is dual position instead of adjustable.

FIG. 5A is a side view of an embodiment of the present invention which is dual position instead of adjustable, but uses many of the same principles of construction as the leisure chair shown in FIG. 1C. Basically, the generally wedge shaped frame for this embodiment has all the same components as the frame shown in FIG. 1A, except the parts numbered 10 through 22 (the telescoping support pieces and the pivoting crossbar pieces), and for better understanding, it is helpful to think of angle B on FIG. 5A as angle A on FIG. 1A. In FIG. 5A, the main U frame 2, is the occupant supporting member, and is welded or otherwise securely joined to the vertical portion of a support U frame 54 (which is analogous to the base U frame 6 in FIG. 1A) at an acute angle B. Since this embodiment is dual position, there are two high firmness lumbar supports 58 positioned as shown. The main cushion 26 is made with channels or hollows to fit with the two lumbar supports 58. As shown, in the dual position leisure chair, the upper portion and lower portion are both about the same size, and in a preferred embodiment, the size is about 17 inches. The support sheet 24 is shown like plywood, but it could be like the one shown in FIG. 1C. Also, note that there are no straps shown, but the seat cushion and head pillow seem to be right next to the upholstery. This could be accomplished by making the upholstery 30 for the seat cushion 34, main cushion 26 and head pillow 32 out of a continuous piece of material, by sewing the upholstery for these together, or by using VELCRO strips or zippers where the seat cushion 34 and head pillow 32 meet the upholstery 30 for the main cushion. Using a continous piece of material or sewing the head 32 and seat 34 cushions to the main cushion 26 would prevent the cushions from being individually removable, which would be appropriate if the chair was single position instead of dual position, or if the all the cushions 26, 32, and 34 could be rotated when the position is changed. This can be accomplished by making all the cushions easily removable like cushions on most outdoor furniture. This way the position can be easily changed and the cushions can be easily resecured to the frame with string ties. Of course, straps could be used if desired as shown in FIG. 1C.

Figure 5B:
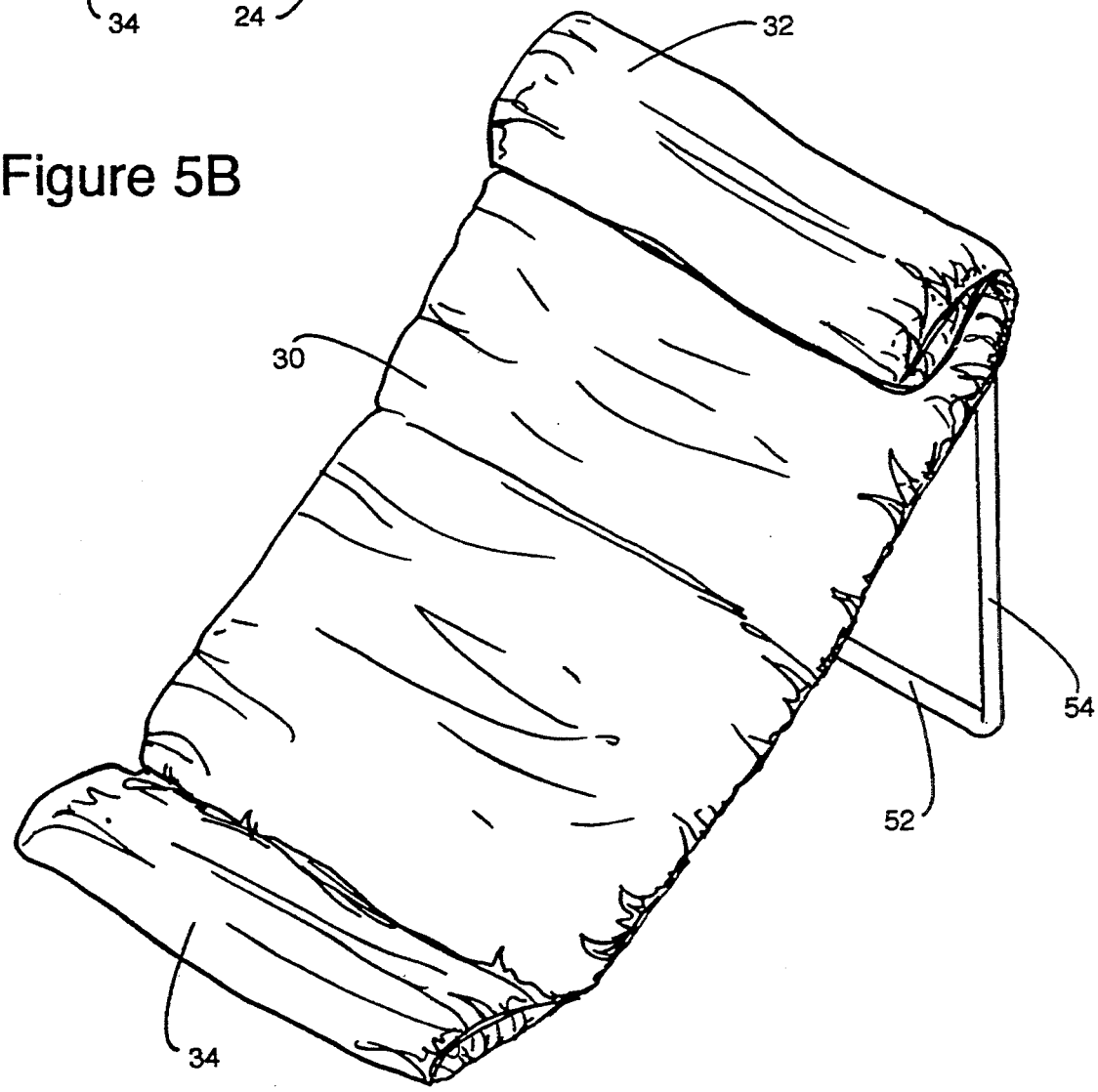
FIG. 5B is an isometric view of the embodiment shown in FIG. 5A shown in the reclining position.

FIG. 5B is an isometric view of the embodiment in FIG. 5A shown in the reclining position with upholstery 30 on it. The drawing shows how the vertical support member 54 is U shaped and has a base portion 52.

Figure 5C:
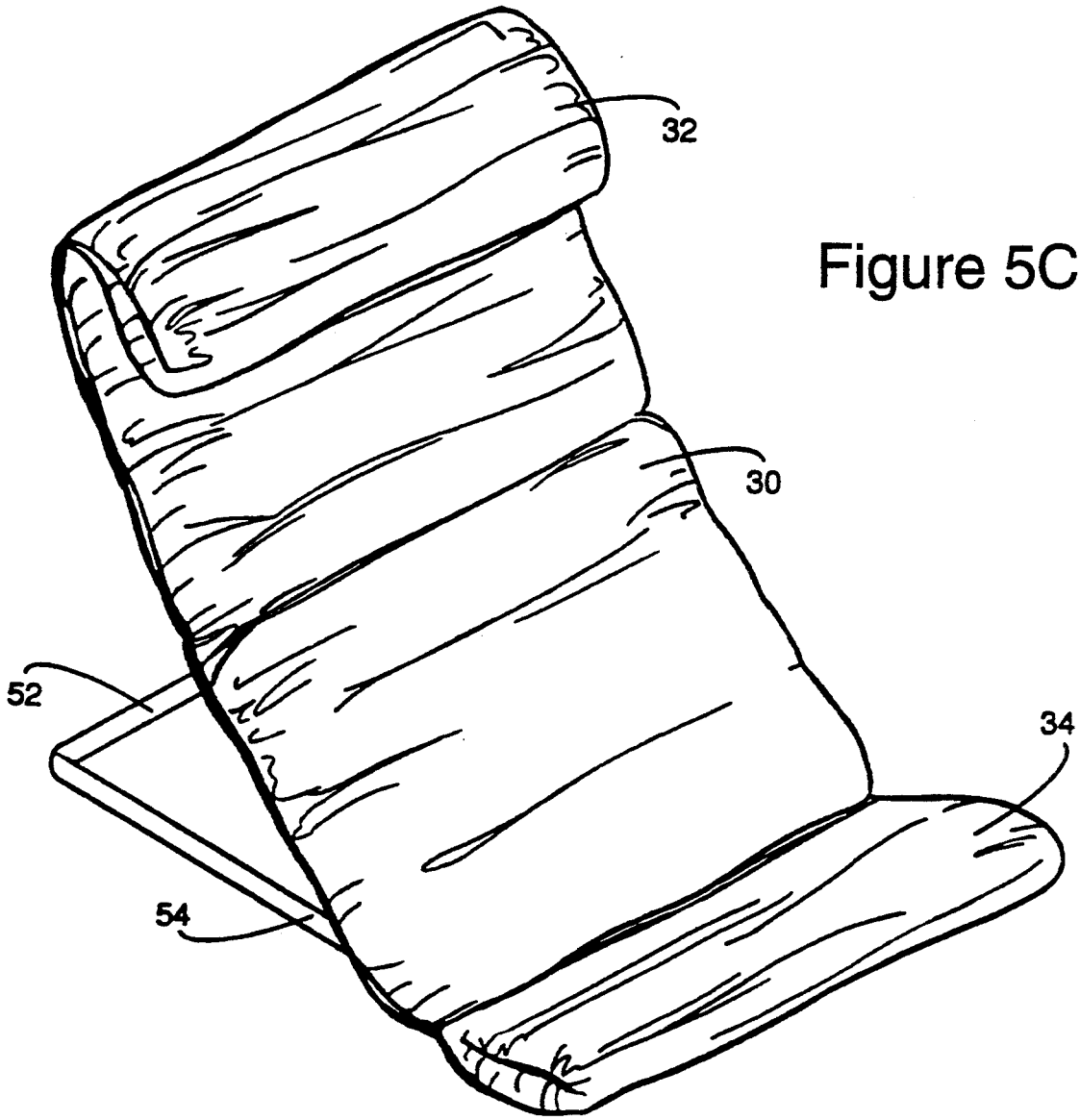
FIG. 5C is an isometric view of the embodiment shown in FIG. 5A and 5B but shown in an alternate more upright position.

FIG. 5C is an isometric view of the embodiment shown in FIGS. 5A and 5B, but shown in an alternate more upright position. In the drawing, what was the vertical support member 54 and the base portion 52, are now both shown as part of a base U shaped frame. Note that the head pillow 32 has been moved to what is now the top portion of the leisure chair, and that the seat cushion 34 has been moved to what is now the lower end of the cushion. It should be pointed out that if tubular steel is used, it may be necessary to put a steel gusset (not shown) or otherwise reinforce the joint formed at angle B on FIG. 5A to use the leisure chair in the upright position as shown in FIG. 5C. Another way to reinforce the joint at angle B would be to put a bar fabricated at the same angle as angle B inside the tubing. The bar could be about 6" long in each direction, and just slightly smaller than the tubing.

Figure 5D:
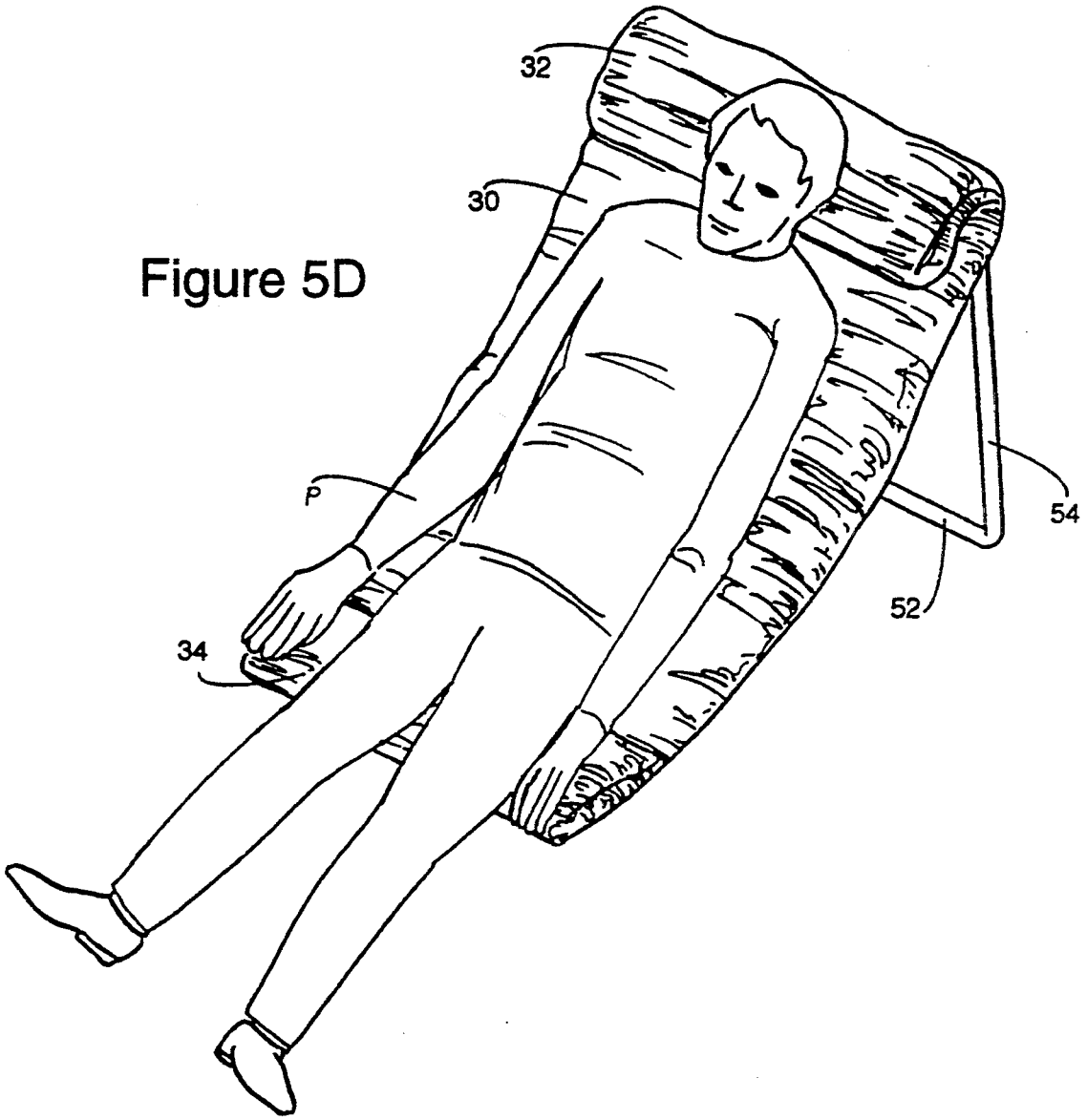
FIG. 5D is an isometric view of the embodiment shown in FIGS. 5A, 5B, and 5C with a person seated in it.

FIG. 5D is an isometric view of the embodiment shown in FIGS. 5A, 5B, and 5C with a person P seated in it when it is in the reclining position.

Figure 6A:
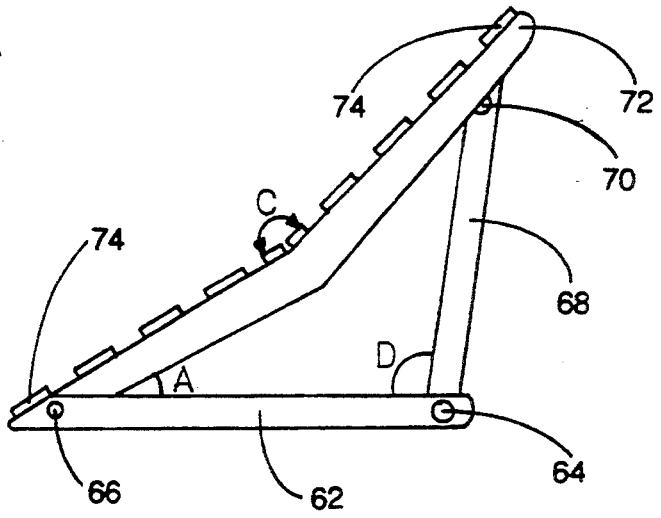
FIG. 6A is a side view of a support frame of an embodiment of the present invention which can be adjusted by changing the angle of the generally vertical support part.

FIG. 6A is a side view of another generally wedge shaped frame of an embodiment of the present invention which can be adjusted by changing the angle of the generally vertical support 68. This embodiment is ideally suited for outdoor use such as at the beach, and also could be appropriate for indoor use. Since the drawing is a side view, it should be understood that the other side looks like a mirror image of FIG. 6A, and that except for the cross pieces (64, 66, and 74) there is one of each of the other parts shown, on each side. In the drawing, the side of the base support 62 has two holes, one for the pivoting lower cross member 64, and the other for the front pivoting point 66. The lower pivoting cross member 64 is made of a hardwood pole about 1" in diameter and about 21" long. The side pieces 62, 68, and 72 are made of a softwood such as pine, and are about 1½" thick. The side base support 62 is about 2" high, and about 23" long. To prevent the pivoting lower cross member 64 from coming out of position, a ⅛" deep grove is cut around the pole 64 about ¾" in from each end. When the sides of the base support are put into place around each end of the pole 64, a screw is screwed in from the bottom of the side of the base support 62 to exactly fit in the groove of the pole 64 mentioned above. This permits the pole 64 to pivot, but prevents it from moving from side to side. It should be mentioned that instead of putting a hole in the side of the base support 62 as shown, the pivoting lower cross member 64 can also be mounted on the top of the side of the base support 62 right above where the hole would be. This can be done by using a ¼"×¾"×2½" U bolt on each side that will fit into the grooves on the pole 64 mentioned above. The U bolt will be placed upside down, so if it were shown on the drawing, it would look like an upside down U or lower case n. This means that the nuts would be bolted from the bottom, and of course the nuts could be countersunk so they would not be visible from the side. There are also other ways of pivotally attaching the pivoting lower support member 64 to the sides of the base support 62 which should be apparent to those knowledgeable in the art related to this invention.

The front pivoting point 66 is a carriage bolt about ⅜"×4" that goes through the hole in the side of base support 62, goes through two slip washers, goes through a hole in the slope frame side piece 72, and then is fastened with a washer and a nut. An alternative would be to use a setup similar to the bottom spacer bar 4 shown in FIG. 1A. The vertical support pieces 68 are attached to the pivoting lower cross member 64 and are positioned on the pivoting lower cross member 64 so that there will be a space of about 1½" between the sides of the base support 62 and the vertical supports 68. This space is necessary to enable the frame to collapse as shown in FIG. 6C. Though not shown in FIG. 6A, it may be desirable to put some kind of a sway brace between the vertical supports 68 to keep the leisure chair from wobbling. A sway brace could consist of a 15"×6" piece of plywood that could be surface mounted to the vertical support pieces 68. The 6" would be the height, and the 15" would be the horizontal outside measurement from one vertical support 68 to the other. The sway brace could be placed anywhere on the vertical supports 68 in the manner described. Of course there are numerous other ways to provide sway support that would be known to those knowledgeable in the field related to this invention.

At the top of the vertical support, there is the upper cross member 70. The upper cross member 70 is made of a hardwood pole with a diameter of about 1" and a length of about 16". As shown, the upper cross member 70 is attached by inserting it through a 1" hole in the vertical support 68 and then securing with screws and/or glue. It should be pointed out that there are other ways of doing this known to those knowledgeable in the art relating to this invention. The slope frame side pieces 72 can be cut out of a 2×6 or 2×8 piece of wood such as pine. It should be noted that the slope frame side piece 72 is shown slightly thicker near angle C. This is for added strength. Also, the upper portion of the each of the slope frame side pieces 72 has a series of notches on their inside portions to correspond with the upper cross member 70. These notches could be made with a router using either a 1" round nosed bit or a 1" straight double flute router bit. Though shown in FIG. 6A as though they go in only about ½", they could go in about 1" so that the upper cross member 70 would be completely concealed. The number of notches made depends on how many positions seem to be desired. There could be three notches for low, medium, and high positions, or there could be a notch every 2" or so for more adjustments. It is also possible to use surface mounted pegs to hold the upper cross member 70 in position, in place of the notches. Pegs would be mounted on the underside of the upper portion of the slope frame side pieces in place of the notches. If pegs are used, the upper cross member will be made about 17" long. Also, there should be one notch put in the lower portion of each of the slope frame side pieces 72, to line up with the upper cross member 70 when the frame is collapsed. This is so that when the frame is collapsed as shown in FIG. 6C, the vertical supports 68 will not stick out below the sides of the base support 62. The slope frame side pieces 72 has dimensions and obtuse angle C similar to the sides of the main U frame in other embodiments, though the thickness of the material may be different.

On the top or face of the slope frame side pieces 72, are face sheathing pieces 74. The face sheathing pieces 74 form the support sheet. When the face sheathing pieces 74 are used with a generally wedge shaped frame like shown in FIGS. 6A–6E, together the face sheathing pieces and the frame make two similarly sized support surfaces. These are ⅜"×3"×20" strips of wood to work in the same way as the support sheet 24 shown in FIG. 1C. Notice that the face sheathing pieces 74 will extend about 1" on either side farther than slope frame side pieces 72. The main cushion 26 shown in FIG. 6D will extend about 2" on either side farther than the face sheathing pieces 74. The face sheathing 74 is nailed or stapled to the slope frame sides 72, and may have spacing between each piece as shown in FIG. 6A. It is certainly possible to make this frame of many different materials such as hardwood, plastic, resin, fiberglass, tubular aluminum, etc., and the face sheathing 74 could be made of fabric, wood strips of different sizes, webbing, etc. Someone skilled in the art should know numerous possibilities for making this invention with different materials, fastening means, adjustment means, and dimensions.

For the purposes of the claims, it should be noted that when the frame described is assembled as described, there is a base generally U shaped frame formed by the two sides of the base support 62 and the pivoting cross member 64, and there is a generally rectangular shaped main backrest frame formed by the two slope side frame pieces 72 and the top cross member and the bottom cross member. In the drawing, the top cross member and bottom cross member are to top and bottom face sheathing members 74. The reader will see that if rigid face sheathing 74 is used, it becomes part of the frame, as well as being the support sheet. If the face sheathing was made of fabric or something that did not have rigid strength, it would be necessary to have another type of cross member at the top and bottom of the slope frame side pieces 72 to tie them together. Either way, the slope frame side pieces 72 and whatever cross members tie them together form a generally rectangular shaped main backrest frame, which is the occupant supporting member. The front pivoting point 66 is the means for joining the main backrest frame to the base U shaped frame.

Figure 6B:
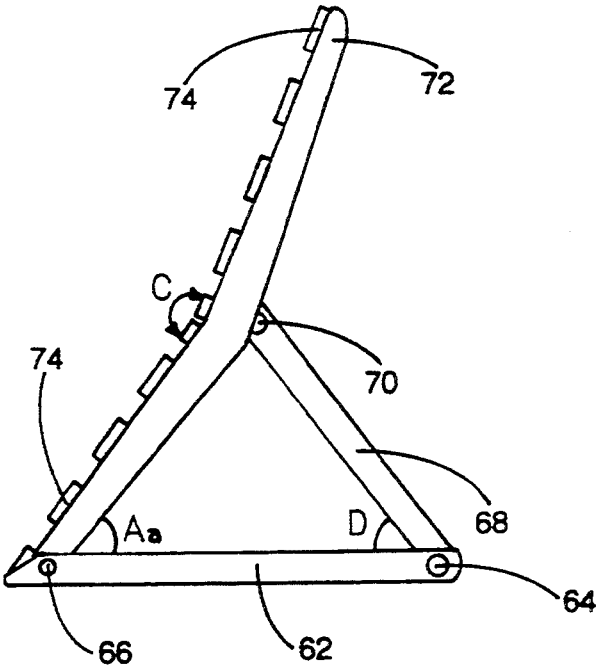
FIG. 6B is a side view of the support frame of the embodiment shown in FIG. 6A, but shown in a more upright position.
Figure 6C:
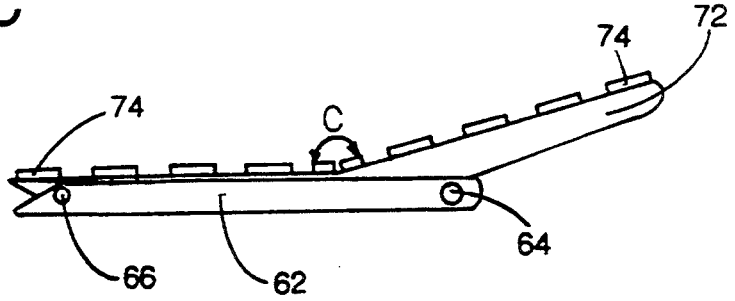
FIG. 6C is a side view of the support frame of the embodiment shown in FIGS. 6A and 6B, but shown collapsed for shipping or storage.

FIG. 6B is a side view of the support frame of the embodiment shown in FIG. 6A, but shown in a more upright position.

In FIG. 6A, angle D is shown to be about 90 degrees, and angle A is about 30 degrees. As the top of the vertical support 68 is moved toward angle A, the slope of the generally wedge shaped frame increases as measured at angle A. FIG. 6B shows how when angle D decreases, angle A increases, resulting in the frame being in a more upright position. Note that the upper cross member 70 is now in a notch that is closer to angle C on the slope frame side piece 72. The increased angle A is designated as Aa which represents angle A alternate position. It should be noted that this same type of leisure chair frame could be made by putting the pivoting cross member 64 on the slope side pieces 72 and putting the "upper" cross member and notches on the sides of the base support 62. This would be similar to the way some adjustable outdoor lounge chairs are made. Also, it is possible to make the slope frame side pieces 72 foldable by putting a hinge or something similar at the point where angle C is. The slope frame pieces 72 could then fold so that the face sheathing on the lower portion meets the face sheathing on the upper portion. With the hinge there must be a catch to lock the slope frame side pieces in place for when it is used normally.

One thing not shown on the drawings is a safety strap to prevent the leisure chair frame from collapsing accidentally, which could happen if the upper cross member 70 fell out of the notch it is supposed to be in. This could happen if the upper portion of the slope frame side pieces 72 were lifted without lifting the upper cross member 70. This could cause the vertical supports 68 to fall down, and the chair could collapse as shown in FIG. 6C. To prevent this, a safety strap is secured around a face sheathing piece 74 near the center of the upper portion of the slope frame side pieces 72. The safety strap has a loop sewn into it large enough to fit over a face sheathing piece 74, and at the other end it has a snap hook. The sewn loop end of the safety strap is slipped over the face sheathing piece 74 before the face sheathing piece is attached to the slope frame side pieces 72. Then the face sheathing 74 is attached, leaving the safety strap with the snap hook dangling under the face sheathing 74. With the snap hook leading, the safety strap is wrapped around the upper cross member 70 and secured by having the snap hook catch a part of the safety strap that is above the upper cross member 70. Essentially, all this means is there is a safety strap with one loop around a face sheathing piece 74 and one loop around the upper cross member 70. The loop around the upper cross member 70 is closed with the snap hook. The safety strap is just long enough to permit the vertical support piece 68 to move to all the way from a position like that shown in FIG. 6A to a position like that shown in FIG. 6B, but not out of that range. The safety strap can also be used to wrap around the pivoting cross member 64 when the wedge shaped frame is collapsed for storage or transport. This is why a snap hook is included on one end of the safety strap.

FIG. 6C is a side view of the support frame of the embodiment shown in FIGS. 6A and 6B, but shown collapsed for shipping or storage.

Figure 6D:
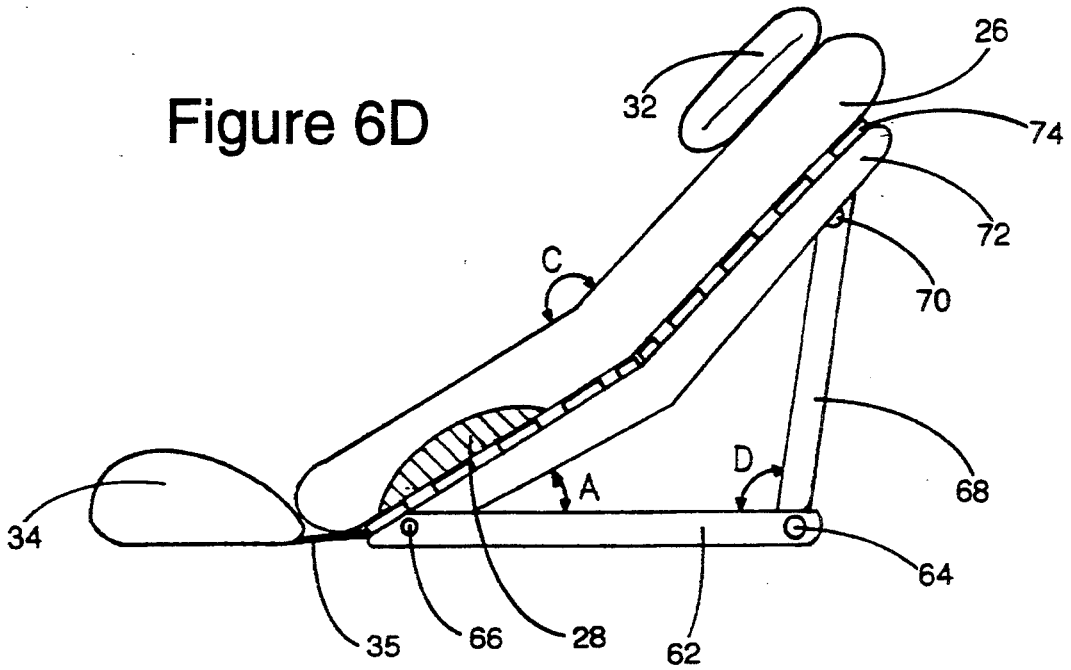
FIG. 6D is a side view of the embodiment shown in FIGS. 6A, 6B, and 6C, but with cushions and lumbar support.

FIG. 6D is a side view of the embodiment shown in FIGS. 6A, 6B, and 6C, but with cushions and a lumbar support. The main cushion 26 is similar to the one described in FIG. 1C. This cushion is upholstered like a reversible cushion, and would be attached to the face sheathing 74 with straps in a manner similar to that used for cushioned patio furniture. In the drawing, there is a seat cushion 34, with straps 35 which attach the seat 34 to the face sheathing 74. A head pillow 32 is also shown.

Figure 6E:
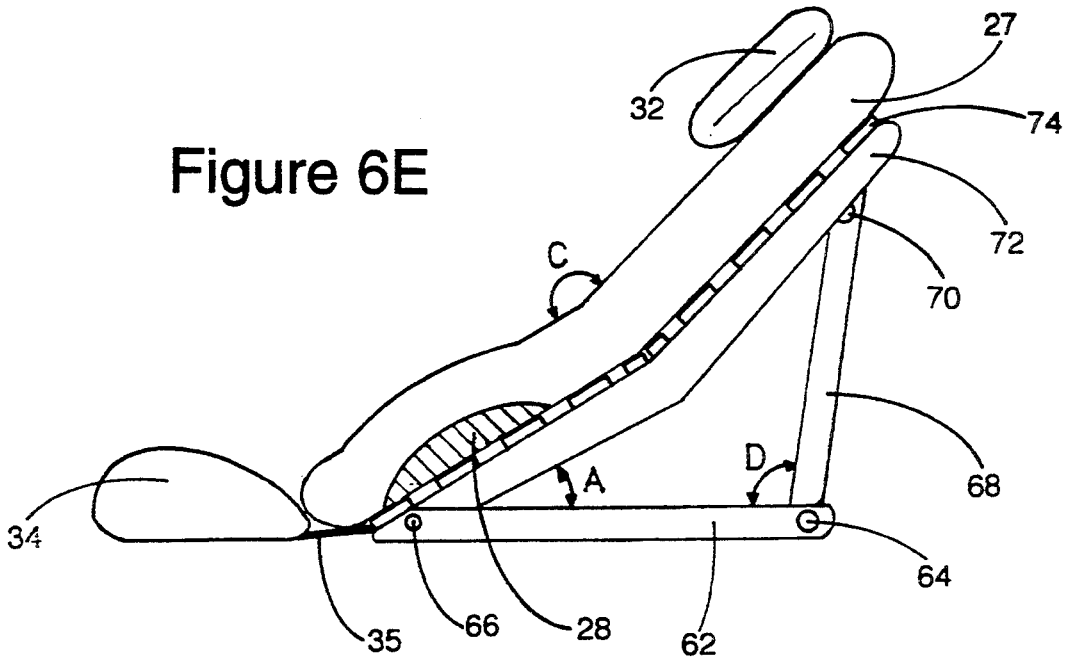
FIG. 6E is a side view of the embodiment shown FIGS. 6A, 6B, and 6C, but with an ordinary type cushion over a lumbar support, and also showing the seat cushion and head pillow.

FIG. 6E is a side view of the embodiment shown in FIGS. 6A, 6B, and 6C, but with an ordinary type cushion over a lumbar support, and also showing the seat cushion and head pillow. This drawing just shows another way to provide lumbar support for the leisure chairs. The lumbar support 28 is similar to that shown in FIG. 1C, but it is not placed in a hollow in the cushion 27. The cushion 27 is just like an ordinary type cushion with no hollow, and hence it becomes contoured when put over the lumbar support 28. This cushion could be made of almost any kind of cushion material including cotton, polyester fiber, dacron, polyurethane foam, feathers, etc. The advantage of this type lumbar support can be economy and versatility in cushion choice, while the drawback is that it may not be as attractive as the cushions that do not show a contour.

Figure 6F:
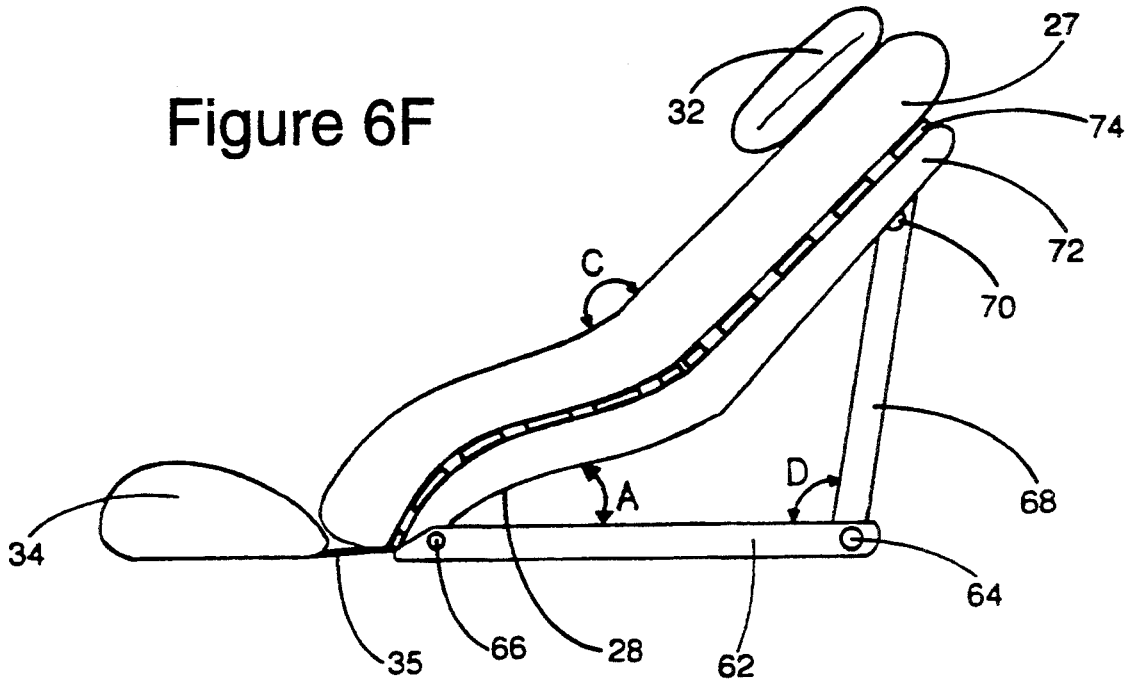
FIG. 6F is a side view of the embodiment shown in FIG. 6D, but with a convex curve on the lower portion of the slope.

FIG. 6F is a side view of the embodiment shown in FIG. 6D but with a lumbar support 28 formed by a convex curve on the lower portion of the slope frame piece 72 to provide a lumbar support without the internal lumbar support shown in FIG. 6D. The main cushion 27 is an ordinary cushion without a hollow or internal lumbar support.

OPERATION OF INVENTION—Method of Cushion Manufacture

Figure 7A:
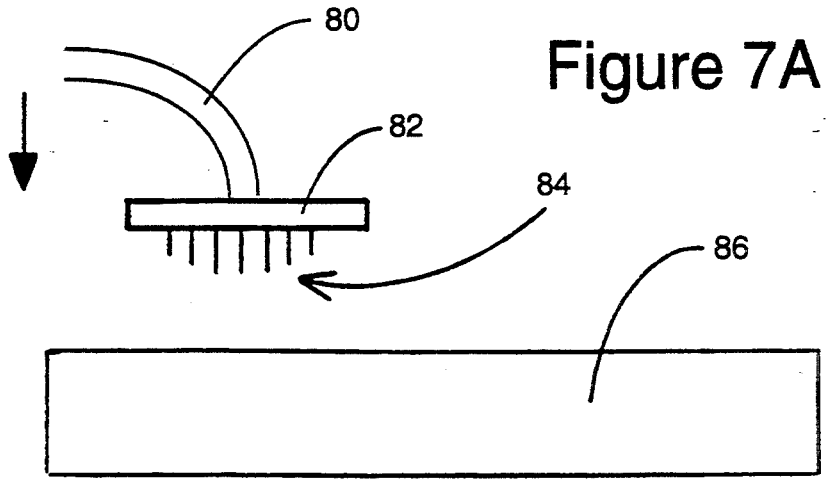
FIG. 7A is a side view of a cushion that is about to be pierced with injecting needles on a support base to produce a firm internal support member.

FIG. 7A is a side view of a cushion 86 that is about to be pierced with injecting needles 84 on a support base 82 to produce a firm internal support member similar to the lumbar support shown in FIG. 1C. In this drawing, there is a hose or hoses 80 which carry a firming means into the injector support base 82. The firming means is a chemical solution that will make a previously manufactured foam cushion firmer wherever the chemical solution contacts the foam cushion. In a preferred embodiment, the firming means are foaming chemicals as described below. From the injector support base 82, the chemicals are distributed to, and forced through the series of injecting needles 84. The injecting needles 84 work on the same principles as hypodermic needles, but need to have an inside diameter of about ⅛" since the viscosity of the foaming chemicals will not go through a much smaller opening efficiently. The cushion 86 is a typical previously manufactured flexible foam cushion made of polyurethane foam or the like. It would be made of a relatively soft grade of foam with an ILD (Indentation Load Deflection on 4" at 25%) between about 10 pounds and about 35 pounds.

Figure 7B:
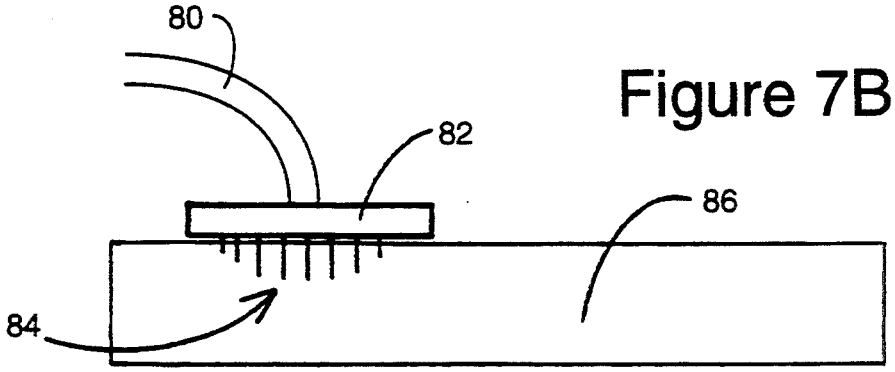
FIG. 7B is a side view of the cushion shown in FIG. 7A after being pierced with the injecting needles.

FIG. 7B is a side view of the cushion 86 shown in FIG. 7A after being pierced with the injecting needles 84. The cushion 86 is shown clear to show the injecting needles 84 in position. Note that the needles 84 are of different lengths, and the needles are positioned in such a way that the shape they form together is generally semi-elliptical. It should also be pointed out, that the injecting needles do not need to go as deep as of the depth of the desired firm internal support member. The reason for this is that when the foaming chemicals are injected into the cushion, the cushion 86 will soak them up to a fair extent. So the needles only need to pierce to about 1" from the desired finished depth, and the foaming chemicals will soak to the desired point. Since the cushion 86 is positioned face down, it appears that the soaking is caused by injection pressure, foaming pressure, capillary action, and gravity, but I do not wish to be bound by this belief. Because of the soaking action, it is only necessary to have about one injecting needle for about each square inch of firm internal support member to be produced.

The firming means can be the kind of chemicals used for foam-in-place seating such as is used for custom wheelchairs. The product names for a solution that works for this procedure are Isonate (R) 143L Modified MDI, Dabco 33-LV Catalyst, and FIPS POLYOL, all made or distributed by Dynamic Systems, Inc., Rt. 2, Box 182B, Leicester, N.C. 28748. The formulation of the above chemicals when combined was listed by the manufacturer as "SOFT". Though this chemical solution will work, it is anticipated that other chemical solutions, both foaming and non-foaming will also work to provide a firm internal support member. Depending on the chemicals used, the mixing of the chemicals can take place in the chemical hoses 80, before being put in the chemical hoses 80 or in the injector support base 82. Because of the speed with which the chemicals mentioned above begin foaming, in a preferred embodiment of this invention, each chemical is pumped through a separate hose, and there is a mixing means in the injector support base 82 or just inches away from the injector support base 82. Also in a preferred embodiment there are valves for each chemical coming into the support base 82 to prevent contamination of the fresh chemicals, and to control the process. The injector support base 82 shown is merely representative, and would of course be larger and more complex with valves and a mixing element. The means for mixing the chemicals can be similar to the mixing type valves currently used for ordinary type flexible foam injection molding. It is necessary to have enough pressure on the foam solution being injected, so that it can be forced through the injecting needles 84 and into the existing foam cushion 86.

The injecting needles could have different inside diameters to control the volume of the foaming chemicals to specific areas. It is further possible to have a number of holes in the walls of the injecting needles in addition to, or in place of the hole at the tip of the injection needles as was inferred above by the comparison to a hypodermic needle.

In a production setting, the preferred embodiment is envisioned on a motorized machine working like a drill press. The previously manufactured cushion 86 would be put into position, and the injector support base 82 with injecting needles 84 would be lowered so that they pierce the cushion 86 to the desired depth. Then a predetermined amount of foaming chemical would be injected into the cushion 86 through the injecting needles 84. After this, the injecting needles 84 would be withdrawn, and the foaming chemicals would soak into the cushion 86 and cure to the predetermined firmness. This procedure would be repeated for another cushion right after the first one.

Figure 7C:
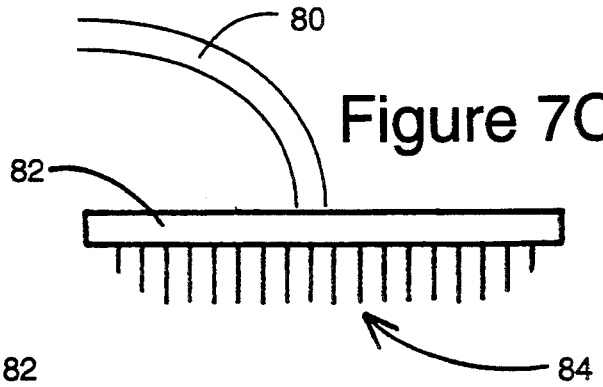
FIG. 7C is a front view of the injector support base and injecting needles shown in FIGS. 7A, 7B, and 7D.
Figure 7D:
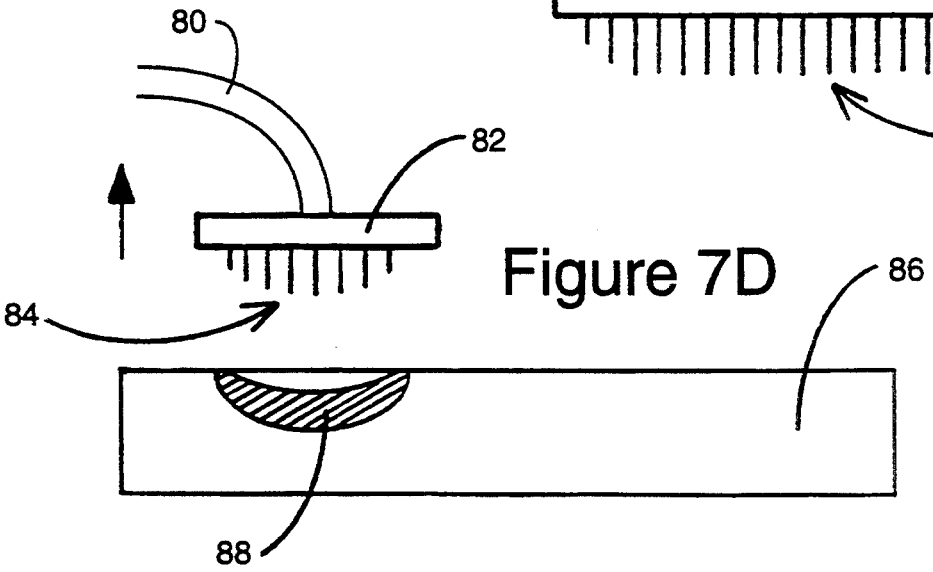
FIG. 7D is a cross section view of the cushion shown in FIGS. 7A and 7B, after the injecting needles shown in FIGS. 7A, 7B, and 7C have injected a foaming compound into the cushion. This drawing shows the firm internal support member that has been produced in the cushion, after the injecting needles have been withdrawn.

FIG. 7C is a front view of the injector support base 82 and injecting needles 84 shown in FIGS. 7A, 7B, and 7D. Comparing this view with one of the side views of the injector support base 82 and injecting needles 84 as in FIG. 7A, one can see how the 8 rows of 18 injecting needles are arranged. Such an arrangement would be suitable for making a lumbar support similar in size and shape to the one shown in FIG. 1C. The injecting needles 84 do not necessarily have to be in neat lines as shown, but could also be staggered, or put in another pattern. Also, on other embodiments, the number and sizes of the injecting needles could be altered to suit the need. It should also be possible to adapt this method to make different shapes of internal support members, including generally cylindrical support members.

FIG. 7D is a cross section view of the cushion 86 shown in FIGS. 7A and 7B, after the injecting needles 84 shown in FIGS. 7A, 7B, and 7C have injected a foaming compound into the cushion 86. This drawing shows the firm internal support member 88 that has been produced in the cushion 86, after the injecting needles 84 have been withdrawn. The internal support member is shaped like a generally semi-elliptical cylinder. Note that there is a soft spot or piece of regular cushion material right above the firm internal support member 88. This is because the foaming chemicals did not soak into this area. Though this small area is softer than the portion where the foaming chemicals soaked into, it should not affect the effectiveness of the firm internal support member.

There are a number of other possible ways of making the main cushion with an internal lumbar support. Essentially what is needed is to make a generally semi-oval shaped hollow or a generally semi-cylindrical shaped hollow or recess in the main cushion, and to make a firmer lumbar insert to be inserted therein. It is possible to do this with custom molded polyurethane foam, or with slab polyurethane foam cut to the right size. Some of the currently favored methods for making the cushions out of slab polyurethane foam include using a special router and router bits for use on foam cushion material. The router bit has either a blade or series of blades which is similar in principle to a round nosed router bit in woodworking. The round nosed bit would plunge into the main cushion body in the correct position, and move across at the proper depth for the proper distance as shown in FIG. 1C. For a 5" thick main cushion with an ILD (indentation load deflection on 4" at 25% of 24 pounds), a preferred depth is about 3", and the cutting diameter of the round nosed router bit would be about 10 inches. As shown in FIG. 1C, it is not necessary to make the hollow as long as the main cushion is wide, since the lumbar support 28 is only needed for the area that is as wide as a human abdomen. A hollow about 17" long is sufficient for most people. The hollow must be positioned so that the deepest point of the hollow is at the point where it will meet the deepest point of a sitting human's lumbar lordotic curve. This can be accomplished by putting the center of the lumbar support hollow about 9 inches from what will be the what will be the bottom edge (near the bottom spacer bar 4 shown on FIG. 1C) of the underside of the main cushion. The high firmness lumbar insert is made using a rounding bit to cut the negative of the pattern cut by the round nosed bit mentioned above. A similar result could be obtained using a band saw, though the ends would not be tapered as shown in FIG. 1C.

Other methods of accomplishing the making a lumbar support hollow include using rotating knives similar to those used on a power plane used for wood. With this method, the radius of the "drum" formed by the rotating knives is about 7 inches, and the drum is about 17 inches long. The rotating knives would be lowered about 3" into a 5" cushion to form a generally semi-elliptically shaped cylindrical hollow. Of course the rotating knives would be lowered at the proper position as mentioned above, and lifted when the operation is complete. Similar to this, various rotating milling type cutters of a similar size and shape, or various dado type blades could be used to accomplish this. For the methods using rotating knives or the like, the hollow would have straight ends, so the lumbar support that would be inserted in the hollow could be shaped with a band saw using currently used methods for making foam cylinders, known to those knowledgeable in the art related to this invention.

Another simple way of achieving the hollow would be to make the main cushion in layers. For a main cushion that will be a total of 5" thick, there could be a 2" layer on top with no holes or hollow. Beneath the 2" layer could be a 3" layer with a hole in the location where the lumbar support is to go, in roughly the size and shape of the lumbar support that will be inserted. The hole could be cut with an ordinary home electric knife, similar to the kind that families cut meats with. The hole does not need to be perfect in shape since the main cushion material is somewhat elastic and flexible. After the top cushion is put on top of the cushion with the hole in it, the hole becomes similar to the lumbar hollow described above.

CUSHIONS PREVIOUSLY DESCRIBED

Figure 8:
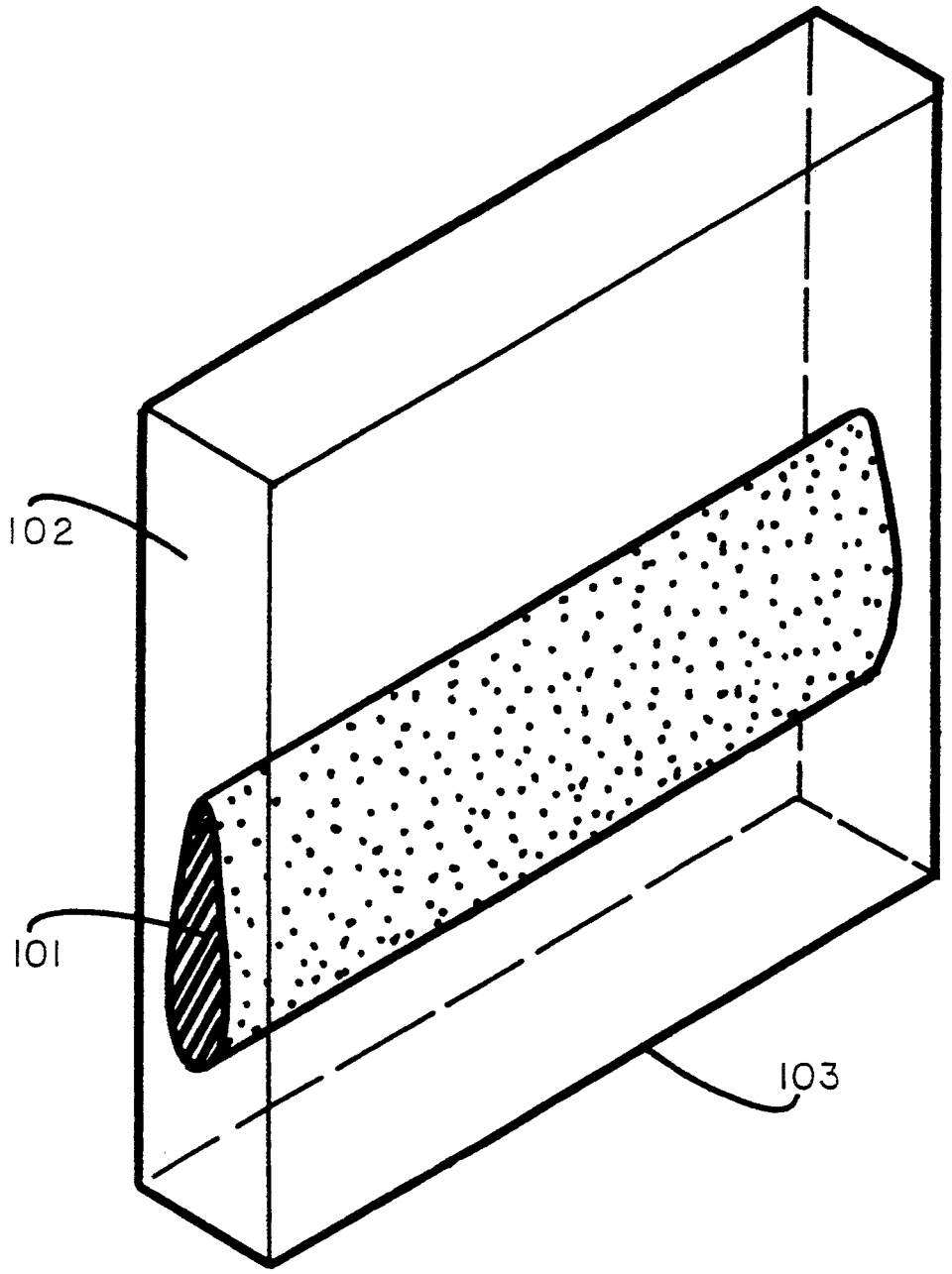
FIG. 8 is a perspective view of a typical embodiment of the present invention.

The drawings and descriptions for FIGS. 8–18 of the cushions like those used in the backrests/leisure chairs of the present invention which were in large portion contained in my previous application are:

FIG. 8 shows a perspective view of a reversible backrest cushion embodying the present invention. In the drawing, a rectangular cushion body 102 is shown with an internal lumbar support member 101. The cushion material of 102 is made of a relatively soft, or low to medium firmness flexible polyurethane foam, and has an oval shaped cylindrical core removed. Removal of the cylindrical core results in a horizontal tubular cavity shaped like an oval cylinder, that was then filled with a firmer polyurethane foam oval cylinder 101 of the same size and shape. The face or body contacting surface of the cushion 103 is what the person seated in a chair or the like using the cushion, would put his or her back against. The tubular cavity and firm foam support member are shaped, sized and positioned to provide good support to the lumbar region of the user's body. Details on size, shape, and position of the cavity and support member are included under Operation of the Invention and Further Details.

Figure 9:
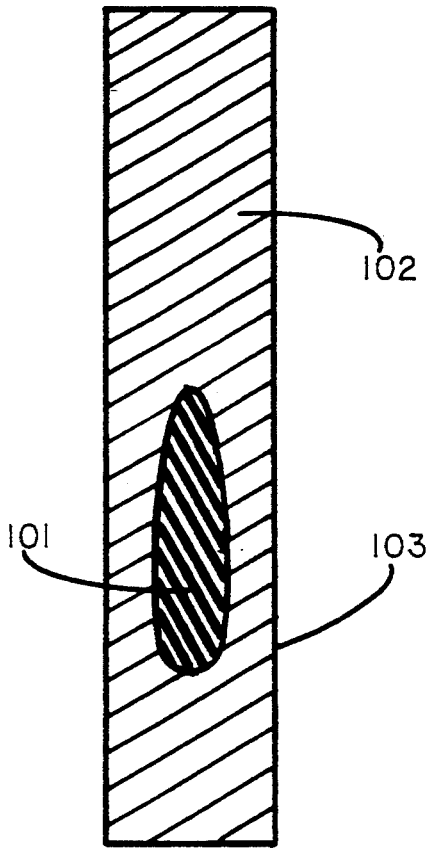
FIG. 9 is a side or cross section view of a reversible backrest cushion embodying the present invention.

FIG. 9 shows a side or cross section view of the same cushion as FIG. 8. Again, 101 is the firmer foam lumbar support member, 102 is the low to medium firmness cushion body, and 103 is the face or body contacting surface of the cushion. This cushion is for use on chairs and the like that are designed with removable and reversible cushions, but can also be used with chairs and the like with fixed in place cushions. Though 103 is shown as the body contacting surface, it should be noted that if this were a reversible cushion, it would have two body contacting surfaces which are opposite one another. So 103 is a body contacting surface, and the side opposite 103 could also be a surface that contacts the user's body. This provides the opportunity to make a reversible cushion that can offer two different degrees of lumbar support. This could be achieved either by placing the lumbar support 101 closer to the body contacting surface 103, or by making the lumbar support 101 extend further on one side instead of being symmetrical. The lumbar support 101 could be made more pronounced on the side of the body contacting surface 103, and less pronounced on the opposite side. One way of doing this would be to have the lumbar support member be a cylinder that is generally oval on the side toward 103, and generally elliptical on the side opposite 103. The result would be greater lumbar support when 103 is used as the body contacting surface, and less lumbar support when the side opposite 103 is used as the body contacting surface.

Figure 10:
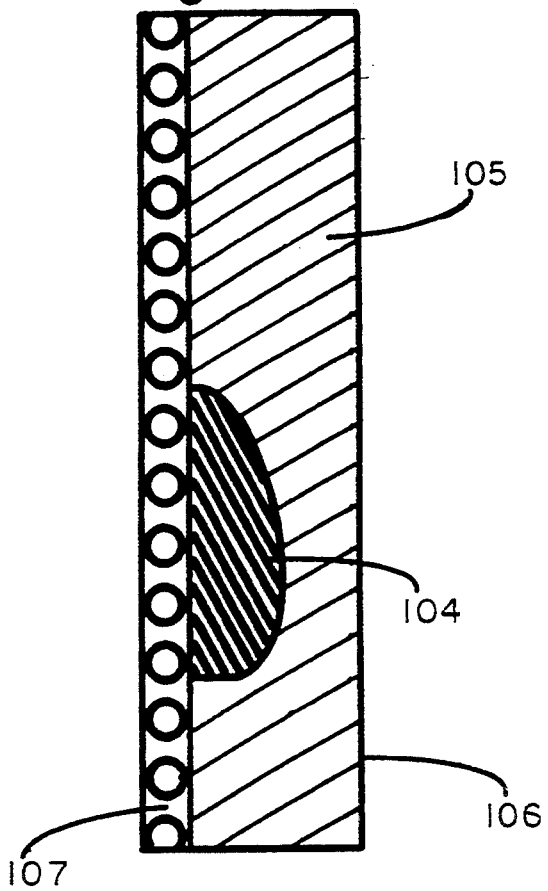
FIG. 10 is a side or cross section view of a fixed backrest cushion embodying the present invention.

FIG. 10 shows a side or cross section view of a typical fixed cushion embodying the present invention. This cushion is for chairs or the like where the cushions are usually not removable or reversible. In the drawing, 104 is a firm flexible polyurethane foam lumbar support member in a generally semi-cylindrical shape, 105 is a relatively soft or low to medium firmness flexible polyurethane foam cushion body, 106 is the face or body contacting surface of the cushion, and 107 is the back or base that the cushion is mounted against. This back or base could be made of springs, fabric, metal, plywood, etc. The cushion body 105 has had a horizontal, generally semi-cylindrical hollow made in it on the side opposite the body contacting surface. The semi-cylindrical hollow is sized, shaped, and positioned to provide greater support to the lumbar region of a user's spine, when filled with the firm support member 104. The hollow is contoured to be a generally round, oval, elliptical, teardrop shaped, or other shaped, semi-cylinder.

Figure 11:
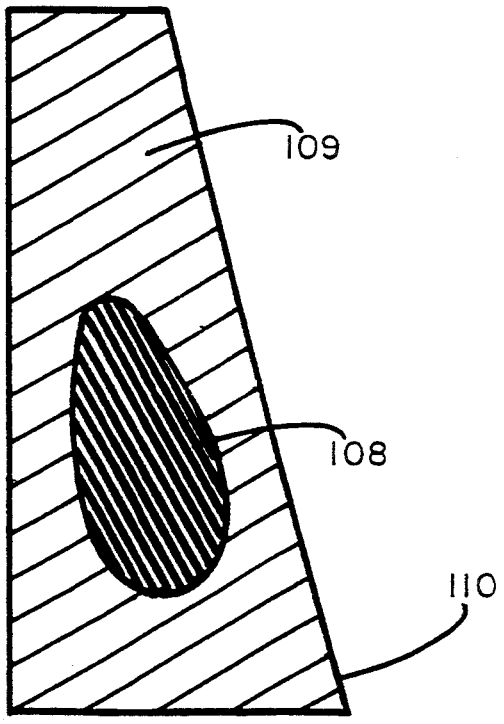
FIG. 11 is a side or cross section view of a backrest cushion, such as would be used for reading in bed, embodying the present invention.

FIG. 11 shows a side or cross section view of a typical backrest cushion, like those used for sitting up in bed, embodying the present invention. In the drawing, 108 is a firm flexible polyurethane foam oval shaped cylinder lumbar support member, 109 is a low to medium firmness flexible polyurethane foam cushion body with tubular cavity shaped like an oval cylinder, and 110 is the face or body contacting surface.

FIG. 12 is an illustration showing how a typical backrest cushion not embodying the present invention, fails to properly support the user's back. In the drawing, 111 is a basic cushion of the prior art, 112 is the face or body contacting surface of the cushion, and next to the cushions is a view of what happens to a user's spine and body when a backrest fails to provide good lumbar support. Without the proper lumbar support, the spine is unnaturally curved, which places more stress on the back, causing fatigue and discomfort.

FIG. 13 is an illustration showing how the backrest cushion, shown in FIGS. 8 and 9, embodying the present invention, does properly support the user's back. In the drawing, 101 is a high firmness flexible polyurethane foam oval cylinder lumbar support member, 102 is a low to medium firmness flexible polyurethane foam cushion body, 103 is the face or body contacting surface of the cushion, and next to the cushion is a view of what happens to a person's spine and body when they are properly supported with a cushion embodying the present invention. FIG. 13 illustrates how the natural curve of the back is maintained through use of the lumbar support. Maintaining this position reduces stress, strain, and fatigue on the spine and back muscles, making the user more comfortable for extended periods of time.

FIG. 14 is a side or cross section view of a backrest cushion embodying the present invention with a loose fill cushioning material in the front or body contacting portion of the cushion body. In the drawing, 115 is a firm flexible polyurethane foam lumbar support member shaped like an oval cylinder, 116 is a loose or fiber fill cushioning material used as the face or body contacting portion of the cushion, 113 is a low to medium firmness flexible polyurethane foam portion of the cushion body, and 114 is the face or body contacting surface of the cushion. The polyurethane foam portion of the cushion body 113 has a horizontal, generally semi-cylindrical hollow or cavity as shown, which holds the lumbar support in place. A small amount of adhesive could be used at the areas that the lumbar support 115 and the polyurethane foam cushion body 113 contact each other. The adhesive would prevent the lumbar support member 115 from moving out of position. The loose or fiber fill material 116 could be cotton, polyester, shredded foam rubber, feathers, down, dacron, etc. Loose fill cushions can be especially soft and comfortable, but most do not provide really good support to the lumbar region. FIG. 14 shows a cushion that can be especially soft and comfortable, and at the same time it is very supportive. It may be advantageous to either enclose the soft fill material in a liner, or secure whatever covering is used to the solid polyurethane cushion body, to keep the loose fill from getting between the covering and the solid foam. For some applications, some kind of quilting means may be beneficial to keep the loose cushioning material in place, and properly distributed. Quilting means refers to using fabric to create pockets to lock the loose fill material in place in the same way down winter jackets are made to keep all the down from settling to the bottom of the jacket. Though FIG. 14 shows a backrest cushion similar to the type used for sitting up in bed, the principle can be applied to reversible, and fixed in place cushions of the type shown in FIGS. 8, 9, 10, and 11.

DESCRIPTION OF CORING TOOL/OPERATION OF CORING TOOL

Figure 15:
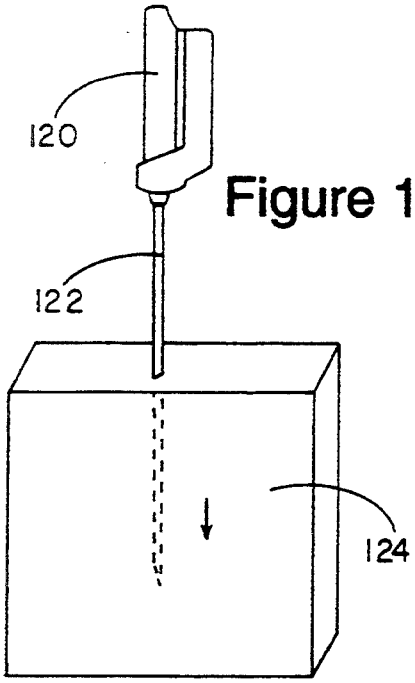
FIG. 15 is a slightly perspective view of a tool and system for removing a core from a cushion of slab polyurethane type foam. This figure shows the beginning of the process to remove a core.

FIG. 15 is a slightly perspective view of a coring tool for removing a core from a cushion of slab polyurethane foam. In the drawing, 120 is a motor that drives a pair of alternately reciprocating blades 122 to cut a core from a cushion body of slab polyurethane foam 124. The coring tool works in much the same manner as an electric knife used by families to slice meats such as ham or turkey. The major difference is that the point is sharpened, enabling it to pierce as well as cut. FIG. 15 shows the beginning of the coring process as the alternately reciprocating blades 122 are piercing the foam cushion 124. When the cushion 124 is pierced all the way through, the blades 122 will be in a position to cut the core out.

Figure 16:
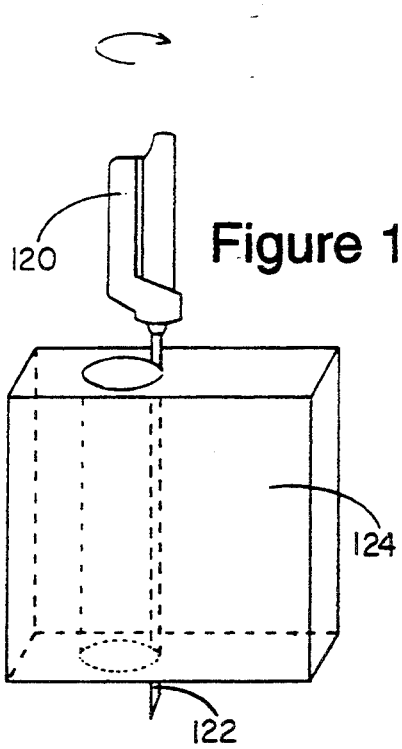
FIG. 16 is a slightly perspective view of the elements and process as shown in FIG. 15 near the completion of the cutting phase of core removal.

FIG. 16 is a slightly perspective view of the coring tool and process shown in FIG. 15, but after the piercing and cutting have been completed. In FIG. 16 the alternately reciprocating blades 122 had pierced to below the bottom of the cushion 124, and had cut the cushion in a predetermined size and shape—in this case a elliptically shaped cylinder. The direction of the cutting operation is shown above the motor for the knife 120. Though shown like a hand tool, the coring tool can be guided and automated for mass production applications.

Figure 17:
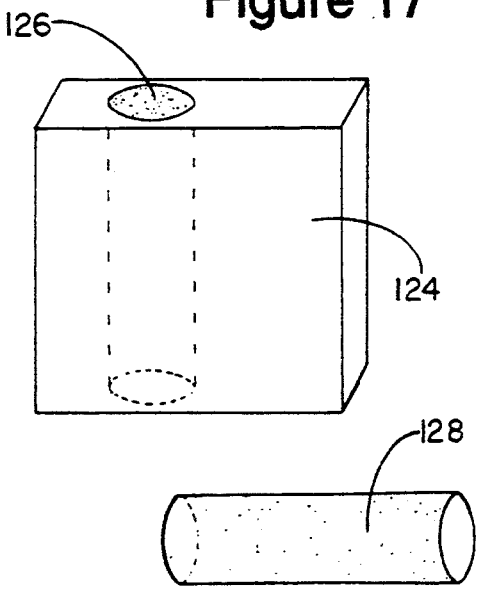
FIG. 17 is a slightly perspective view of the elements and process shown in FIG. 16 after the core has been removed.

FIG. 17 is a slightly perspective view of the cushion 124 after the coring tool shown in FIGS. 15 and 16 has been removed. Additionally, the core 128 has been removed, leaving a generally tubular cavity 126 within the cushion body 124. This tubular cavity 126 will later be filled with a cylinder of the same size and shape made of a higher firmness polyurethane foam cushion.

Figure 18:
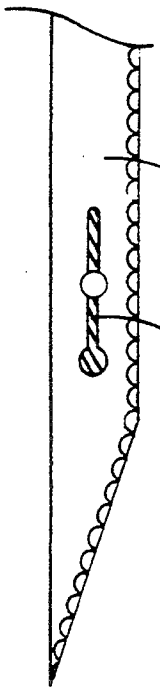
FIG. 18 is a side view of a design for the point of a cutting blade for the tool shown in FIG. 15.

FIG. 18 shows a detail of the point of the blades 122 shown in FIGS. 15 and 16 The blades 122 come to a sharp point to enable them to pierce the foam cushion. FIG. 18 also shows how the blades 122 are joined at 123, in a manner similar to a household electric knife with an interlocking post and hollow track that enable the blades to alternately move back and forth. These blades can be very similar to those in household electric knives, such as those used for cutting meats like ham or turkey.

There are other possible ways to provide a tubular cavity in cushions to insert a firm support member for the various applications, or to shape the support member. Some of the anticipated methods could include using a band saw, special routers for foam rubber, hot wire cutting tools, and using layers of cushion, instead of the single slab piece of foam as shown, to make the cavity without special knife shown. To describe how the layers of cushion could work, the body contacting layers would be plain and the middle layer(s) could be cut in a variety of ways to put a firm lumbar insert in it. It is also anticipated that for some applications, the firm foam support member may not extend the width of the cushions, and means to accomplish this are anticipated. Also, anticipated is the concept of putting a tubular cavity in a cushion that is molded in place, by using a mold that will leave a tubular cavity or hollow in the finished cushion body. These and other methods should be apparent to those knowledgeable in the art relating to this invention.

OPERATION OF CUSHION PREVIOUSLY DESCRIBED AND FURTHER DETAILS

Most cushioned chairs, sofas, backrests, etc. can be made with cushions embodying the present invention by substituting cushions embodying the present invention for the cushions not embodying the present invention. Normally, there would be no need to alter the way of making a chair, sofa, backrest, etc., though it is important that cushions be put in the right positions. Failure to properly position cushions embodying the present invention could result in problems like having the lumbar support member on a backrest cushion behind the shoulders instead of behind the lumbar region.

The size, shape, and firmness of the internal support member is dictated by the shape and/or amount of support to be directed at a particular part of the user's body, and the size (thickness), shape (planar, concave, convex, etc.), and firmness of the cushion body. For lumbar support, the internal support member would be a contoured cylinder that generally follows the curve of the lumbar region of the user's back, but depending on the characteristics of the cushion, the lumbar support could contoured to be a round, oval, teardrop shaped, elliptical or other shaped cylinder. If the cushion body was relatively soft and thin, the support member would be more elliptical, but if the cushion body were thicker and firmer, the support member would probably be thicker, and probably closer to an oval or circular cylinder. For cushions that are not reversible, the lumbar support would probably be a semi-cylinder of one of the shapes mentioned above. There is a relationship between the size, shape, and firmness of the internal support member. For example, an internal support member with an ILD of 70 lbs could provide as much support as a thicker internal support member with an ILD of 50 pounds. The size, shape, and firmness of both cushion and internal support member can be engineered for many uses and personal preferences.

An advantage of the present invention is that it can be effective with cushions of a great variety of sizes, shapes, and degrees of firmness. The size, shape, and firmness of a cushion will determine the size, shape, and firmness of the internal support member. For an example of how this can be done, consider the reversible backrest cushion of FIG. 9. If the cushion of FIG. 9 is 5" thick with an ILD (indentation load deflection on 4" at 25%) of 18 pounds, and the body contacting surface 103 is flat, then the internal support member might be a 3" thick oval cylinder with an ILD of 60 pounds. On the other hand, if the cushion in FIG. 9 is 3" with an ILD of 23 pounds and has a flat body contacting surface, then the internal support member might be 1¼" thick with an ILD of 60 pounds, and an oval shape that is a little more elliptical than for the 5" cushion.

The tubular cavity and firm foam support member are shaped, sized, and positioned to provide good support to the lumbar region of the user's body. The position could be determined based on average heights of the lumbar region for people in a country or area, or could be custom designed for one individual. In the United States, the average height for the center of the radius of the lumbar region on a seated person is about 9½ inches above the seat, so this would probably be the best height to position the widest point of the lumbar support insert.

The location of the internal support member within the cushion is determined by where the key parts of the user's body will be when the person is seated properly. For the lumbar support, it is important to take into consideration how much the person is likely to sink into the seat cushion. Failure to do so will result in a less than optimal lumbar support. The proper positions can be easily determined by someone knowledgeable in the field based on average dimensions of the human anatomy.

The angle of a cushion might also be considered when considering the size, shape, and firmness of the internal supports—especially as it gets toward a reclining position, because this causes the weight of the user to be redistributed.

As mentioned previously, one advantage of the present invention is that it makes it possible to make cushions softer, but with more support where it is needed. This is because the typical monodensity foam cushion has to be firm enough to provide minimal support to key areas such as the lumbar region of the back, but this firmness is not only in one area, it is all over. Therefore, with the present invention, it is possible to have the main cushion with an ILD lower than the typical monodensity cushion used in chairs, etc., and at the same time provide better support.

It should be pointed out, that for some applications, a small amount of adhesive may be required to secure the support member to the cushion body.

This invention can be used with cushions having convex, flat, concave, or contoured body contacting surfaces. The invention can also be used on cushions that are covered with a loose dacron filling or the like before upholstering. It is expected that most cushions would be mass produced to be appropriate and comfortable for most people. It is possible to make them in stock sizes to be trimmed by furniture manufacturers. However, it is critical that if a cushion is trimmed, it must be trimmed so that the internal supports will be at the right height and position when put on chairs and the like. Also, it is possible that furniture manufacturers could make the cushions themselves for each particular chair or the like that they make.

Finally, it should be pointed out that there is no perfect cushion which is "best" for everyone. Just as people have preferences on the firmness of the mattress they sleep on, it is probably also true that people have preferences on what the best cushion is to them. The above specifications provide a way of making cushions which are acceptable to many people, and can be suitable for mass production. However, it is also to be understood that the invention is suitable for people with many preferences, and the idea can be used in mass production using one standard set of specifications, or in a plurality of standard sets of specifications, or custom made to individual consumer's preferences. The basic principles of engineering cushions to specific needs are to have the cushion body and the firm internal support member work together to more evenly distribute the load of a sitting person's body, and to provide comfort and proper alignment for the user.

SEAT CUSHIONS

The present invention also relates to seat cushions, and though not specifically shown in the drawings, the same principles used with the backrest cushions can be applied to seat cushions. An internal support member could be positioned under the buttocks of the user to prevent the user from sinking down too far. For greater comfort, the buttocks support would be less convex than the lumbar support, so that the pressure from the weight of the person would not be focussed at one point. In fact, the buttocks support member would likely be flat or a little concave so that the cushion better conforms to the shape of the buttocks and thereby relatively evenly distributes the user's weight focussed at that point.

CONCLUSIONS, RAMIFICATIONS, AND SCOPE OF INVENTION

Thus the reader will see that the leisure chairs and backrests of this invention are economical, attractive, useful, compact, and very comfortable for sitting or reclining.

Although my above description contains many specificities, these should not be construed as limiting the scope of the invention, but merely as providing illustrations of the presently preferred embodiments of this invention. Many other variations are possible. This invention can be made a number of ways, with a wide variety of materials, it can be made with a number of accessories as part of it or to used be with it, and the principles of this invention can be applied to a number of other uses.

For example, the dual position leisure chairs or backrests can instead be made single position at an angle that would be some happy medium between those shown and described. Also, there are alternative ways of providing the lumbar supports on chairs using the frame structure and support sheet, such as providing additional fabric to reinforce the fabric on the support sheet in the area of the lumbar region. The result of this would be that when a user sits on the chair, the regular main support sheet fabric would stretch more than the reinforced section providing an inherent lumbar support. Such reinforcing could be graduated so that the stretched material would make a smooth transition to the lumbar region. Such a method could be very useful, especially on outdoor type furniture that may not have cushions. Also, the chairs can be made with the frame support system collapsible, adjustable, and/or flexible at the areas of the obtuse angle.

It may be obvious that there are numerous ways of making the chairs adjustable, such as those seen on numerous types of lawn chairs and lounges. It is even possible to eliminate any kind of generally vertical support piece (such as the telescoping pole) altogether by using an interlocking type adjustment mechanism at the points where the main U frame meets the base U frame, near the screws 8 shown on FIG. 1A. An interlocking adjustment mechanism could be similar to those used for reclining seats on cars, could be like those used on some wheelchairs for reclining, could use some kind of mechanism similar to what is used in a ratchet wrench, etc. Such an adjustment mechanism would make it possible to adjust angle A. It is further possible to make the adjustment function motorized so that the user could press a button to adjust the angle while sitting in the chair.

The backrest/leisure chair can be made a bit like a rocking chair by having a vertical support member with a moving counterweight mechanism or a spring mechanism that would expand and contract as a person rocks back and forth (or up and down). Another way to make the backrest/leisure chair like a rocking chair would be to curve the base portion in a manner similar to a regular rocking chair, and also provide a frame and platform to support and attach the seat cushion to the main frame assembly so that the seat cushion would move with the rest of the backrest/leisure chair when it rocks.

The backrests/leisure chairs can be made for multiple users like a love seat by making it wider, can be made in children's sizes, and can be made in tall sizes. The look of the leisure chairs can be changed drastically, by making chairs fully upholstered with no exposed wood or metal frame, and making them with styles similar to those used on wide variety of typical upholstered armchairs. It is also possible that another high firmness cushion insert could be placed behind the shoulder area as well as the lumbar region to assist in orienting the upper body. The support surface can be made somewhat concave from the left side to the right side to correspond with the shape of the chest/abdomen etc. of the human body. And though the backrests/leisure chairs are more comfortable with the lumbar supports described, for more economical backrests/leisure chairs, an ordinary cushion without any means for providing a specific lumbar support can be used for the main cushion, and could be placed over the support sheet. Other embodiments can be made stackable so that a number of chairs could be stored easily, inflatable or use inflatable cushions, with the upper portion curved slightly, with a head pillow as an integral part of the upper portion, or could be made in a manner similar to the way automobile seats are made, with a process where the slope frame is put in a mold and a cushion is injection molded around the frame.

The backrests/leisure chairs can be made of a great variety of materials. The frames can be made of wood, metal tubing, other structural metal, plastics, fiberglass, resin, glue laminated wood, etc. The support sheet can be made of fabric, leather, vinyl tubing, wicker, cane, webbing, metal sheets, plywood, wire and springs etc. The cushion can be made of a variety of materials including cotton, feathers, polyurethane foam, polyester fill, dacron fill, shredded foam, etc.

Other methods, materials, and techniques that can be applied to making backrests and leisure chairs of this invention are known or will be known in the industry relating to this invention.

The backrests/leisure chairs of this invention are suitable for being used with a number of accessories. One such accessory is a work surface such as a desk top adapted for use with the chair. Also, a specially designed type of ottoman or legrest can be used with the backrest/leisure chair. The area under the slope can be designed to hold a storage compartment for books or something similar. Since the backrest/leisure chair is near the floor, special lights for reading may be desired. It is also possible to attach a device to hold a book, using principles similar to those used in the type of lamps used by draftsmen.

The principles of this invention can be applied to futon designs, to chaise type lounges or other type lounges.

It should also be very clearly pointed out that many of the possibilities shown and/or described in the embodiments herein are interchangeable between embodiments. For example, a chair with a support foundation could have armrests, or could have the lower portion made with a convex contour like FIG. 4, etc.

Accordingly, the scope of the invention should be determined not by the embodiments illustrated, but by the appended claims and their legal equivalents.

CUSHIONS PREVIOUSLY DESCRIBED

Thus the reader will see that the cushions with internal support members and the method of manufacture of this invention can be an economical way to make cushions very comfortable and supportive, can be used for cushions of many sizes and shapes, can be used with solid flexible polyurethane foam as the front or body contacting portion of the cushion or with a loose fill material as the front portion of the cushion, can be used for reversible cushions or cushions which are fixed in place, can provide a clearly defined lumbar support in backrest cushions, and can be made with polyurethane in economical slab form. Also, this invention is not just limited to use in slab foam cushions, but can be used with formed in place cushions as well.

Although the above description contains many specificities, these should not be construed as limiting the scope of the invention, but merely as providing illustrations of some of the presently preferred embodiments of this invention. For example, the inserts themselves could be made of a multidensity elastic foam. This could be done by using an adhesive to join cushions of various density in an engineered pattern, and then cutting the insert in the shape required. And though reference was made to flexible polyurethane foam as the material used, the invention can work with any elastic foam material whether it be latex, foam rubber, or some other flexible foam material.

I claim:

1. A backrest/leisure chair comprising:

(a) a frame having an occupant supporting member oriented to form an acute angle with a horizontal plane such as a floor, ground surface, couch or bed, said occupant supporting member being supported in the acute angle orientation by a base support frame connected to said occupant supporting member, wherein said base support frame contacts said horizontal plane generally underneath said occupant supporting member, said occupant supporting member having a lower portion and an upper portion, and including a means forming an obtuse angle thereon for supporting occupant's thoracic curve at a generally midpoint on said occupant supporting member which orients the upper portion of said occupant supporting member at a higher angle than the lower portion, said occupant supporting member further having a convex contour on the lower portion of said occupant supporting member for supporting the lumbar curve of the user in a relatively natural lordotic curve;

(b) a support sheet means, wherein the means is selected from a group consisting of webbing, a plurality of slats, springs, wires, a sheet of fabric, plywood, and other products that can comprise a sheet, secured to the occupant supporting member, and capable of supporting the weight of the back, shoulders, and head of a reclining human; and (c) at least one main backrest cushion secured on top of said support sheet with an upholstery means; and (d) a seat cushion having an attachment means for securing it to the lower portion of the frame, suitable for providing comfort to the buttocks when sitting on the floor, and at the same time preventing the occupant of said leisure chair from slipping down out of position.

2. The backrest/leisure chair of claim 1 wherein said acute angle is formed between the base frame and the lower portion of the occupant supporting member, and wherein an interconnecting means extends between the base frame and the occupant supporting member to adjust the acute angle.

3. The backrest/leisure chair of claim 1 wherein the frame has means for supporting armrests secured to the lower portion of the occupant supporting member of the frame.

4. The backrest Leisure chair of claim 1 wherein the seat cushion and main back rest cushion each have a width which is measured from side to side, a length which is measured perpendicularly from the width, wherein the width of the seat cushion and the width of the main backrest cushion are of a similar size, and the length of the seat cushion is substantially less than the length of the backrest cushion.

5. The backrest/leisure chair of claim 1 wherein a pillow is provided for a head rest, and wherein the pillow has an attachment means to secure it near the top of the frame.

6. The backrest/leisure chair of claim 1 wherein the obtuse angle means for supporting the occupant's thoracic curve orients the portion of the occupant's back above the occupant's thoracic curve at a higher angle relative to a horizontal plane than the portion of the frame below the generally midpoint.

7. The backrest/leisure chair of claim 1 wherein said obtuse angle is between about 160 degrees and about 170 degrees.

8. The backrest/leisure chair of claim 1 wherein the acute angle of the lower portion of the occupant supporting member relative to a horizontal plane is between about 20 degrees and about 70 degrees.

9. The backrest/leisure chair of claim 1 wherein the main backrest cushion is an ordinary cushion having an upper and lower portion.

10. The backrest/leisure chair of claim 1 further including a cushion pad surface mounted to the support sheet as a means for supporting the natural lordotic curve of the lumbar region of the occupant's back.

11. A backrest/leisure chair comprising:

(a) a frame having an occupant supporting member oriented to form an acute angle with a horizontal plane, said occupant supporting member being supported in the acute angle orientation by a base support frame connected to said occupant supporting member, wherein said base support frame contacts said horizontal plane generally underneath said occupant supporting member, said occupant supporting member having a lower portion and an upper portion, and including a means forming an obtuse angle thereon for supporting occupant's thoracic curve at a generally midpoint on said occupant supporting member which orients the upper portion of said occupant supporting member at a higher angle than the lower portion;

(b) a support sheet means, wherein the means is selected from a group consisting of webbing, a plurality of slats, springs, wires, a sheet of fabric, plywood, and other products that can comprise a sheet, secured to the occupant supporting member, and capable of supporting the weight of the back, shoulders, and head of a reclining human;

(c) a main backrest cushion having an upper and lower portion, and having means for supporting the occupant's lumbar region in a relatively natural lordotic curve, wherein said means for supporting a natural lordotic curve is a firm internal support member which is a generally semi-elliptically shaped cylinder within the cushion, said cushion is secured on top of said support sheet; and (d) a seat cushion having an attachment means for securing it to the lower portion of the frame, suitable for providing comfort to the buttocks when sitting on the floor, and at the same time preventing the occupant of said leisure chair from slipping down out of position.

12. The backrest/leisure chair of claim 11 wherein said acute angle is formed between the base frame and the lower portion of the occupant supporting member, and wherein an interconnecting means extends between the base frame and the occupant supporting member to adjust the acute angle.

13. The backrest/leisure chair of claim 11 wherein the frame has means for supporting armrests secured to the lower portion of the occupant supporting member of the frame.

14. The backrest Leisure chair of claim 11 wherein the seat cushion and main back rest cushion each have a width which is measured from side to side, a length which is measured perpendicularly from the width, wherein the width of the seat cushion and the width of the main backrest cushion are of a similar size, and the length of the seat cushion is substantially less than the length of the backrest cushion.

15. The backrest/leisure chair of claim 11 wherein said generally wedge shaped frame or parts thereof can be made of wood or wood like components.

16. The backrest/leisure chair of claim 11 wherein a pillow is provided for a head rest, and wherein the pillow has an attachment means to secure it near the top of the frame.

17. The backrest/leisure chair of claim 11 wherein the obtuse angle means for supporting the occupant's thoracic curve orients the portion of the occupant's back above the occupant's thoracic curve at a higher angle relative to a horizontal plane than the portion of the frame below the generally midpoint.

18. The backrest/leisure chair of claim 11 wherein said obtuse angle is between about 160 degrees and about 170 degrees.

19. The backrest/leisure chair of claim 11 wherein the acute angle of lower portion of the occupant supporting member relative to a horizontal plane is between about 20 degrees and about 70 degrees.

20. The backrest/leisure chair of claim 11 wherein said firm internal support member within the cushion for supporting the natural lordotic curve is an insert located in a strategically placed hollow in said lower portion of the cushion.

21. The backrest/leisure chair of claim 11 wherein said seat cushion provides more support than said main backrest cushion, the seat cushion being of a firmer or thicker material than the main cushion.

22. A backrest/leisure chair with a main backrest cushion, a seat cushion, a lumbar support means for supporting an occupants lumbar region in a relatively natural lordotic curve below the surface of the cushion, and having a frame comprising:

(a) a generally rectangular shaped main backrest frame having a top, a bottom, and two parallel sides, the sides having an obtuse angle at their generally midpoint such that the part of the frame below said generally midpoint is at a lower angle relative to a horizontal plane as compared with the part of the frame above said generally midpoint, and wherein the part of the backrest frame sides below said generally midpoint is integral and continuous with the part of the backrest frame sides above said generally midpoint;

(b) a base generally U-shaped frame; and (c) a means for joining said generally rectangular shaped main backrest frame to said base generally U-shaped frame, said means for joining the backrest frame to the base U-shaped frame being positioned near the ends of the base U-shaped frame and near the sides below the midpoint of the main backrest frame in such a way that the base U-shaped frame is generally horizontally positioned and the main backrest frame is positioned at an acute angle to the base U-shaped frame.

23. The backrest/leisure chair frame of claim 22 further including a means to adjust the acute angle of the main backrest frame with respect to the base U-shaped frame for the purposes of enabling an occupant to sit at a preferred angle, which ranges from generally upright to generally reclining, wherein the means to adjust the angle of the main backrest frame interconnects at it's highest point with the upper portion of the main backrest frame and at it's lowest point said means interconnects with the generally U-shaped base frame, and wherein said means is placed in a generally vertical manner, defining the frame in a generally wedge shape with the main backrest frame oriented at the acute angle forming the face of the wedge, the base frame forming the base of the wedge, and the generally vertical means interconnecting the base frame with the upper portion of the backrest frame forming the back of the wedge.

24. The backrest/leisure chair frame of claim 23 wherein said means to adjust the acute angle of the main backrest frame with respect to the base U-shaped frame comprises a telescoping support, pivotally attached to the base U-shaped frame and to a crossbar on the main backrest frame.

25. The backrest/leisure chair frame of claim 23 wherein said means to adjust the acute angle of the main backrest frame with respect to the base U-shaped frame comprises pivoting a generally vertical support member attached to a pivoting cross member, wherein the pivoting portion is interconnected with the base U-shaped frame and the upper portion is interconnected to the main backrest frame.

26. The backrest/leisure chair frame of claim 22 further including a spacer bar between the sides of the main backrest frame positioned near the obtuse angle to help keep the frame in the proper shape.

27. The backrest/leisure chair of claim 22 wherein the frame has a convex contour on the lower portion of said occupant supporting member for supporting the lumbar curve of the user in a relatively natural curve.

28. The backrest/leisure chair frame of claim 22 wherein the base U-shaped frame and pivoting mechanism are of a wood like product.

* * * * *